US007396639B2

(12) United States Patent
Suzuki et al.

(10) Patent No.: US 7,396,639 B2
(45) Date of Patent: Jul. 8, 2008

(54) PHOTOTHERMOGRAPHIC MATERIAL AND IMAGE FORMING METHOD

(75) Inventors: Keiichi Suzuki, Kanagawa (JP); Minoru Sakai, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 11/437,772

(22) Filed: May 22, 2006

(65) Prior Publication Data

US 2006/0292503 A1 Dec. 28, 2006

(30) Foreign Application Priority Data

Jun. 27, 2005 (JP) ..... 2005-187134

(51) Int. Cl.
*G03C 5/16* (2006.01)
*G03C 1/498* (2006.01)

(52) U.S. Cl. ..... 430/350; 430/523; 430/533; 430/534; 430/535; 430/619; 430/631

(58) Field of Classification Search ..... 430/523, 430/350, 631, 961, 945, 533, 534, 535, 619
See application file for complete search history.

(56) References Cited

U.S. PATENT DOCUMENTS 6,190,854 B1 * 2/2001 Sampei ..... 430/617
2005/0260529 A1 * 11/2005 Oyamada et al. ..... 430/348
2006/0210933 A1 * 9/2006 Sakai et al. ..... 430/619

FOREIGN PATENT DOCUMENTS

JP 2004-309641 * 11/2004
JP 2004309641 * 11/2004
JP A 2004-309641 11/2004

* cited by examiner

*Primary Examiner*—Thorl Chea
(74) *Attorney, Agent, or Firm*—Margaret A. Burke; Sheldon J. Moss

(57) ABSTRACT

The present invention provides a photothermographic material having, on at least one side of a support, an image forming layer including at least a photosensitive silver halide, a non-photosensitive organic silver salt, a reducing agent, and a binder, and a non-photosensitive outermost layer which is disposed on the same side of the support as the image forming layer, wherein the non-photosensitive outermost layer contains a copolymer having at least the following monomer (M1) and monomer (M2) as copolymerization components, and a maximum surface roughness (Rt) on the image forming layer side is 1.5 μm or less; wherein monomer (M1) is a monomer having a salt or salt forming group, or a poly(alkylene oxide) group and having an unsaturated bond which performs radical polymerization; and monomer (M2) is a monomer containing a fluorine atom and having an unsaturated bond which performs radical polymerization.

An image forming method is also provided.

10 Claims, No Drawings

PHOTOTHERMOGRAPHIC MATERIAL AND IMAGE FORMING METHOD

CROSS-REFERENCE TO RELATED APPLICATION

This application claims priority under 35 USC 119 from Japanese Patent Application No. 2005-187134, the disclosure of which is incorporated by reference herein.

BACKGROUND OF THE INVENTION

1. Field of the Invention

The present invention relates to a photothermographic material and an image forming method using the same.

2. Description of the Related Art

In recent years, in the field of films for medical diagnosis and in the field of films for graphic arts, there has been a strong desire for decreasing the amount of processing liquid waste from the viewpoints of protecting the environment and economy of space. Technology is therefore required for light-sensitive photothermographic materials which can be exposed effectively by laser image setters or laser imagers and thermally developed to obtain clear black-toned images of high resolution and sharpness, for use in medical diagnostic applications and for use in photographic technical applications. The light-sensitive photothermographic materials do not require liquid processing chemicals and can therefore be supplied to customers as a simpler and environmentally friendly thermal processing system.

While similar requirements also exist in the field of general image forming materials, images for medical imaging in particular require high image quality excellent in sharpness and granularity because fine depiction is required, and further require blue-black image tone from the viewpoint of easy diagnosis. Various kinds of hard copy systems utilizing dyes or pigments, such as ink jet printers and electrophotographic systems, have been marketed as general image forming systems, but they are not satisfactory as output systems for medical images.

Thermal image forming systems utilizing organic silver salts are known. In particular, photothermographic materials generally have an image forming layer in which a catalytically active amount of a photocatalyst (for example, silver halide), a reducing agent, a reducible silver salt (for example, an organic silver salt), and if necessary, a toner for controlling the color tone of developed silver images are dispersed in a binder. Photothermographic materials form black silver images by being heated to a high temperature (for example, 80° C. or higher) after imagewise exposure to cause an oxidation-reduction reaction between a silver halide or a reducible silver salt (functioning as an oxidizing agent) and a reducing agent. The oxidation-reduction reaction is accelerated by the catalytic action of a latent image on the silver halide generated by exposure. As a result, a black silver image is formed on the exposed region. Further, the Fuji Medical Dry Imager FM-DPL is an example of a medical image forming system using photothermographic materials that has been made commercially available.

In addition to photographic properties, film physical properties of surfaces are very important for the photothermographic material. For example, production of the photothermographic material comprises steps of coating solutions on a long roll support, drying the coated film, winding the dried film, and finishing such as slitting and cutting to provide a roll state or a sheet state. In the above steps, the material is conveyed at a high speed while being wound or unwound.

Moreover, in an image forming step, the material is also conveyed at a high speed in a sheet state or a roll state. A method of providing surface roughness by coating matting agents on the film surface to decrease contact area and thereby reduce conveying resistance has been generally employed for conventional photographic materials and is also effective for photothermographic materials to improve conveying suitability thereof.

Japanese Patent Application Laid-Open (JP-A) No. 2004-309641 discloses the use of antistatic agents to prevent electrostatic trouble occurring during conveying of a film at a high speed. As the antistatic agent used for the material, the use of a fluorocarbon surfactant is disclosed. All patents, patent publications, and non-patent literature cited in this specification are hereby expressly incorporated by reference herein.

On the other hand, the manufactured photothermographic materials have such a problem that adhesion to themselves or to each other occurs during storage in a roll state or when the materials are stacked and stored in a sheet state. To prevent this problem, addition of matting agents to the outermost layer of the material is widely employed.

All chemicals required for image formation are incorporated within the coated layers of a photothermographic material in advance. After image formation, these chemicals remain in the material as reaction products or unreacted components. As a result, all of the chemicals exert complicated influences on photographic properties and film physical properties of the photothermographic materials, and also on the storage stability thereof.

Therefore, it is desired that surface compositions of the photothermographic materials satisfy not only the film physical properties of the surfaces, but also the overall characteristics required for the photothermographic materials.

SUMMARY OF THE INVENTION

The present invention has been made in view of the above circumstances and provides a photothermographic material and an image forming method with the following aspects.

A first aspect of the invention is to provide a photothermographic material comprising, on at least one side of a support, an image forming layer comprising at least a photosensitive silver halide, a non-photosensitive organic silver salt, a reducing agent, and a binder, and a non-photosensitive outermost layer which is disposed on the same side of the support as the side having thereon the image forming layer, wherein 1) the non-photosensitive outermost layer comprises a copolymer having at least the following monomer (M1) and monomer (M2) as copolymerization components; and 2) a maximum surface roughness (Rt) on the image forming layer side is 1.5 μm or less; wherein monomer (M1) is a monomer having a salt or salt forming group, or a poly(alkylene oxide) group and having an unsaturated bond which performs radical polymerization; and monomer (M2) is a monomer containing a fluorine atom and having an unsaturated bond which performs radical polymerization.

A second aspect of the invention is to provide an image forming method for forming an image by imagewise exposing and thermally developing the photothermographic material according to the first aspect, wherein the imagewise exposure is a scanning exposure by a laser beam, and an irradiation angle of the laser beam is from 3 degrees to 45 degrees with respect to a normal line on an exposure surface of the photothermographic material.

A third aspect of the invention is to provide an image forming method for forming an image by imagewise exposing and thermally developing the photothermographic material according to the first aspect, wherein the imagewise exposure and thermal development are conducted while conveying the photothermographic material at a conveying speed of 16 mm/second or higher.

DETAILED DESCRIPTION OF THE INVENTION

An object of the present invention is to provide a photothermographic material, which is excellent in surface film properties and produces images with excellent sharpness and high image quality, and an image forming method using the same.

Photothermographic materials have an advantage of being capable of forming an image only by heating after imagewise exposure, but slight variations in uniformity of the imagewise exposure and the heating cause unevenness in image density. Therefore many efforts have been made to improve the precision of the exposure and heating means in the image forming apparatus. However, it has been found that improvement thereof cannot avoid the problem of unevenness in image density, which is generated on both ends of the processed sheets. The present inventors analyzed the problem and found that the reason for the problem has a close relationship with the matting agents included in the photothermographic materials. The inventors have conducted intense research of means of improvement and thereby arrived at the first aspect of the present invention.

Moreover, the inventors found that the photothermographic material of the present invention is especially effective for an image forming method in which the material is subjected to imagewise exposure by a scanning exposure with a laser beam, and thereby arrived at the image forming methods of the second and the third aspects of the present invention.

1. Brief Description of the Invention

The photothermographic material of the present invention has, on at least one side of a support, an image forming layer including at least a photosensitive silver halide, a non-photosensitive organic silver salt, a reducing agent, and a binder, and a non-photosensitive outermost layer which is disposed on the same side of the support as the side having thereon the image forming layer, wherein the non-photosensitive outermost layer includes a copolymer having at least the following monomer (M1) and monomer (M2) as copolymerization components, and a maximum surface roughness (Rt) on the image forming layer side is 1.5 μm or less.

Monomer (M1) is a monomer having a salt or salt forming group, or a poly(alkylene oxide) group and having an unsaturated bond which performs radical polymerization.

Monomer (M2) is a monomer containing a fluorine atom and having an unsaturated bond which performs radical polymerization.

Preferably, the copolymer contains from 0.5% by weight to 80% by weight of the monomer (M1) and from 20% by weight to 99.5% by weight of the monomer (M2).

Preferably, the copolymer further contains a monomer (M3) that has an unsaturated bond which performs radical polymerization and is different from either of the monomer (M1) and the monomer (M2), as a copolymerization component. More preferably, the copolymer contains from 0.5% by weight to 79.5% by weight of the monomer (M3).

Preferably, the monomer (M2) is a fluorine atom-containing acrylate monomer or a fluorine atom-containing methacrylate monomer. More preferably, the monomer (M2) is a monomer represented by the following formula (P):

$$(Rf)_p\text{-L-OCOC(R)}{=}CH_2 \qquad \text{Formula (P)}$$

wherein Rf represents a fluoroalkyl group having 1 to 20 carbon atoms and 1 or more fluorine atoms; p represents 1 or 2; L represents a bond or a hydrocarbylene group containing 1 to 12 carbon atoms; and R represents a hydrogen atom or a methyl group.

Preferably, the copolymer is a latex.

Preferably, the photothermographic material of the present invention has a back layer on the opposite side of the support from the side having thereon the image forming layer, and a maximum surface roughness (Rt) of the back layer surface is from 3 μm to 10 μm.

Preferably, the photothermographic material of the present invention has an average gradation of from 2.5 to 4 on a photographic characteristic curve.

Preferably, 50% by weight or more of a binder of the non-photosensitive outermost layer is gelatin.

The photothermographic materials are preferably subjected to imagewise exposure by a scanning exposure with a laser beam and thermal development to form an image, wherein an irradiation angle of the laser beam is from 3 degrees to 45 degrees with respect to a normal line on an exposure surface of the photothermographic material.

Preferably, the imagewise exposure and thermal development are conducted while conveying the photothermographic material at a conveying speed of 16 mm/second or higher.

2. Photothermographic Material

In the present invention, a photographic characteristic curve is a D-log E curve representing a relationship between the common logarithm (log E) of an exposure value, i.e., the exposure energy, and the optical density (D), i.e., a scattered light photographic density, by plotting the former on the abscissa and the latter on the ordinate. In the present invention, an average gradation represents a gradient of a line joining the points (fog+optical density of 0.25) and (fog+optical density of 2.0) on the photographic characteristic curve (i.e., the value equal to tan θ when the angle between the line and the abscissa is θ).

An average gradation according to the invention is preferably in a range of from 1.8 to 4.3, and more preferably in a range of from 2.5 to 4.0.

(Surface Physical Property)

The photothermographic material of the present invention is characterized in that a maximum surface roughness (Rt) on the surface of the image forming layer side is 1.5 μm or less. The maximum surface roughness (Rt) is preferably 1.3 μm or less, and more preferably 1.1 μm or less. By setting the maximum surface roughness (Rt) in the range described above, a photothermographic material with excellent sharpness and high image quality is obtained.

The maximum surface roughness (Rt) described above can be attained by eliminating all matting agents generally included in the outermost layer, or using extremely small amounts of matting agents so that the matting agents substantially cause no roughness on the surface.

The photothermographic material of the present invention preferably has a back layer on the opposite side of the support from the image forming layer side, wherein the back layer has a maximum surface roughness (Rt) of from 3 μm to 10 μm. More preferably, the maximum surface roughness (Rt) is in a range of from 3 μm to 8 μm, and even more preferably from 4 μm to 8 μm. In the region where the maximum surface roughness (Rt) exceeds the upper limit of the above range, image quality of the photothermographic material is deteriorated. Further, in the region where the maximum surface roughness (Rt) is less than the lower limit of the above range, the material exhibits an unfavorable increase in adhesion trouble or electrostatic trouble.

The maximum surface roughness (Rt) of the back layer surface varies depending on the addition amount of a matting agent in the back outermost layer, the mean particle size of the matting agent, and the particle size distribution of the matting agent, and thus, a value of the maximum surface roughness within the desired range can be obtained by adjusting the factors described above.

The maximum surface roughness (Rt) used in the present invention is a parameter defined in JIS B 0601 and is a value obtained for a cross section curve. Many methods for obtaining the cross section curve are well known in the art, but in the present invention, the following method is applied.

<Measuring Method of Maximum Surface Roughness (Rt)>

The cross section curve (surface form) for the photothermographic material of the present invention is obtained by using a measuring instrument utilizing a needle contact method described in JIS B 0670.

(Copolymer Containing a Fluorine Atom)

In the present invention, the photothermographic material contains a copolymer which has at least the following monomer (M1) and monomer (M2) as copolymerization components in the outermost layer on the image forming layer side.

Monomer (M1) is a monomer having a salt or salt forming group, or a poly(alkylene oxide) group and having an unsaturated bond which performs radical polymerization.

Monomer (M2) is a monomer containing a fluorine atom and having an unsaturated bond which performs radical polymerization.

Preferably, the copolymer contains from 5% by weight to 99.5% by weight of the monomer (M2), and more preferably from 20% by weight to 99.5% by weight.

Further preferably, the copolymer contains from 0.5% by weight to 60% by weight of the monomer (M1) and from 40% by weight to 80% by weight of the monomer (M2).

Preferably, the copolymer further contains a monomer (M3) that has an unsaturated bond which performs radical polymerization and is different from either of the monomer (M1) and the monomer (M2), as a copolymerization component. More preferably, the copolymer contains from 0.5% by weight to 79.5% by weight of the monomer (M3), and even more preferably from 0.5% by weight to 59.5% by weight of the monomer (M3).

Preferably, the copolymer is a latex.

As the monomer having a salt or salt forming group in (M1), an anionic monomer, a cationic monomer, and an amphoteric monomer are described, and as the monomer having a poly(alkylene oxide) group in (M1), a non-ionic monomer can be described. In more detail, examples of the anionic monomer include an unsaturated carboxylic acid monomer, an unsaturated sulfonic acid monomer, an unsaturated phosphoric acid monomer, and the like; examples of the cationic monomer include an unsaturated tert-amine-containing monomer, an unsaturated ammonium salt-containing monomer, and the like; examples of the amphoteric monomer include N-(3-sulfopropyl)-N-(methacryloyloxy)ethyl-N,N-dimethylammonium betaine, N-(3-sulfopropyl)-N-(methacryloylamino)propyl-N,N-dimethyl ammonium betaine, 1-(3-sulfopropyl)-2-vinyl pyridinium betaine, and the like; examples of the non-ionic monomer include an unsaturated poly(oxyethylene oxide)monomer, an unsaturated poly(oxypropylene oxide)monomer, and the like.

Specifically, concerning the anionic monomer, examples of the unsaturated carboxylic acid monomer include acrylic acid, methacrylic acid, crotonic acid, itaconic acid, maleic acid, fumaric acid, their anhydrides, and their monoalkyl esters, and examples of the vinyl ethers include carboxyethyl vinylether, carboxypropyl vinylether, and the like.

Examples of the unsaturated sulfonic acid monomer include styrene sulfonic acid, 2-acrylicamide-2-methylpropane sulfonic acid, 3-sulfopropyl methacrylic acid ester, bis-(3-sulfopropyl)-itaconic acid ester, and the like, and salts thereof, and also sulfuric acid monoester of 2-hydroxyethyl methacrylic acid and a salt thereof.

Examples of the unsaturated phosphoric acid monomer include vinyl phosphonic acid, vinyl phosphate, acid phosphoxyethyl methacrylate, acid phosphoxypropyl methacrylate, bis(methacryloyloxyethyl)phosphate, diphenyl-2-(methacryloyloxyethyl)phosphate, diphenyl-2-(methacryloyloxy)ethyl phosphate, dibutyl-2-(methacryloyloxyethyl)phosphate, dibutyl-2-(acryloyloxyethyl)phosphate, dioctyl-2-(methacryloyloxyethyl)phosphate, and the like.

Examples of the cationic monomer include unsaturated tert-amine-containing monomer, unsaturated ammonium salt-containing monomer, and the like. Specifically, examples include mono-vinyl pyridines such as vinyl pyridine, 2-methyl-5-vinyl pyridine, 2-ethyl-5-vinyl pyridine, and the like; styrenes having a dialkyl amino group such as N,N-dimethylamino styrene, and N,N-dimethylamino methyl styrene; esters having a dialkylamino group of acrylic acid or methacrylic acid such as N,N-dimethylaminoethyl methacrylate, N,N-dimethylaminoethyl acrylate, N,N-diethylaminoethyl methacrylate, N,N-diethylaminoethyl acrylate, N,N-dimethylaminopropyl methacrylate, N,N-dimethylaminopropyl acrylate, N,N-diethylaminopropyl methacrylate, N,N-diethylaminopropyl acrylate; vinyl ethers having a dialkylamino group such as 2-dimethylaminoethyl vinyl ether; acrylamides or methacrylamides having a dialkylamino group such as N-(N',N'-dimethylaminoethyl)methacrylamide, N-(N',N'-dimethylaminoethyl)acrylamide, N-(N',N'-diethylaminoethyl)methacrylamide, N-(N',N'-diethylaminoethyl)acrylamide, N-(N',N'-dimethylaminopropyl)methacrylamide, N-(N',N'-dimethylaminopropyl)acrylamide, N-(N',N'-diethylaminopropyl)methacrylamide, N-(N',N'-diethylaminopropyl)acrylamide; and quaternized compounds thereof by well-known quaternizing agent such as a halogenated alkyl compound (with an alkyl group having 1 to 18 carbon atoms, and as halogen, chloride, bromide, or iodide), halogenated benzyl compounds such as, for example, benzyl chloride, or benzyl bromide, alkyl esters (with an alkyl group having 1 to 18 carbon atoms) of alkylsulfonic acid or arylsulfonic acid such as methane sulfonic acid, benzenesulfonic acid, or toluenesulfonic acid, and dialkylsulfate (with alkyl groups having 1 to 4 carbon atoms).

Examples of the non-ionic monomer include esters of unsaturated carboxylic acid monomer and poly(alkylene oxide) addition product with polyoxyalkylene glycol or lower alcohols, and the reaction products of allylglycidyl ether or glycidyl ether of unsaturated carboxylic acid monomer and poly(oxyalkylene oxide) addition product with polyoxyalkylene glycol or lower alcohols. For example, the compounds represented by the following formulae can be used.

$$CH_2{=}CHCH_2O{-}(CH_2CH_2O)_n{-}H$$

-continued $$R^1OOC-CH=CH-\underset{\underset{O}{\|}}{C}O-CH_2\underset{\underset{OH}{|}}{C}HCH_2O-(CH_2CH_2)_n-R^2$$

(in the formula $R^1$ is H, $CH_3$ or $$-CH_2\underset{\underset{OH}{|}}{C}HCH_2O-(CH_2CH_2O)_n-R^2,$$

and $R^2$ is H or $CH_3$)

$$CH_2=CH-\overset{\overset{O}{\|}}{C}O-(CH_2CH_2O)_n-H$$

$$CH_2=CH-\overset{\overset{O}{\|}}{C}O-(CH_2CH_2O)_n-CH_3$$

$$CH_2=\overset{\overset{CH_3}{|}}{C}-\overset{\overset{O}{\|}}{C}O-(CH_2CH_2O)_n-H$$

$$CH_2=\overset{\overset{CH_3}{|}}{C}-\overset{\overset{O}{\|}}{C}O-(CH_2CH_2O)_n-CH_3$$

$$CH_2=CH-\overset{\overset{O}{\|}}{C}O-CH_2\underset{\underset{OH}{|}}{C}HCH_2O-(CH_2CH_2O)_n-H$$

$$CH_2=\overset{\overset{CH_3}{|}}{C}-\overset{\overset{O}{\|}}{C}O-CH_2\underset{\underset{OH}{|}}{C}HCH_2O-(CH_2CH_2O)_n-H$$

$$CH_2=CH-\overset{\overset{O}{\|}}{C}O-CH_2\underset{\underset{OH}{|}}{C}HCH_2O-(CH_2CH_2O)_n-CH_3$$

$$CH_2=\overset{\overset{CH_3}{|}}{C}-\overset{\overset{O}{\|}}{C}O-CH_2\underset{\underset{OH}{|}}{C}HCH_2O-(CH_2CH_2O)_n-CH_3$$

(In the above formulae, n is an integer of 2 to 100)

In the present invention, as the monomer (M2), well-known compounds having polyfluoroalkyl group or perfluoroalkyl group, such as methacrylate, vinyl ester, vinyl ether, maleate, fumaleate, or α-olefin are described. More preferably, examples of the fluorine-containing monomer include monomers having a polyfluoroalkyl group or a perfluoroalkyl group with 4 or more carbon atoms.

Examples of these compounds are shown below, but the invention is not limited in these.

$CH_2=CHCO_2C_2H_4C_6F_{13}$ $CH_2=CHCO_2C_2H_4C_8F_{17}$ $CH_2=CHCO_2C_2H_4C_4F_9$ $CH_2=C(CH_3)CO_2C_2H_4C_6F_{13}$ $CH_2=CHCO_2C_2H_4C_{10}F_{21}$ $CH_2=C(CH_3)CO_2C_2H_4C_{10}F_{21}$ $CH_2=C(CH_3)CO_2C_2H_4C_8F_{17}$ $C_8F_{17}SO_2(C_3H_7)CH_2CH_2OCOCH=CH_2$ $C_8F_{17}SO_2(CH_3)CH_2CH_2OCOC(CH_3)=CH_2$

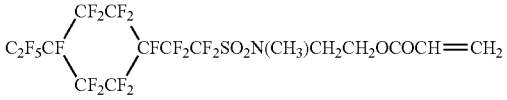

$C_7F_{15}CON(C_2H_5)CH_2CH_2OCOC(CH_3)=CH_2$ $C_8F_{17}(CH_2)_{11}OCOC(CH_3)=CH_2$

-continued $C_8F_{17}CH_2\underset{\underset{OH}{|}}{C}HCH_2OCOC(CH_3)=CH_2$ $(CF_3)_2CFO(CH_2)_5OCOCH=CH_2$ $C_2F_5(OCF_2CF_2)_5OCF_2CF_2CON(CH_3)CH_2CH_2OCOCH=CH_2$ $C_8F_{17}SO_2N(CH_2CH_2OCOCH=CH_2)_2$ $C_8F_{17}SO_2N(CH_3)(CH_2)_{10}OCOCH_2CH=CH_2$ $C_8F_{17}SO_2N(C_2H_5)CH_2CH_2OCOCH=CHCOOC_4H_9$ $C_6F_{13}SO_2N(CH_3)CH_2CH_2OCOCH=CH_2$ $C_8F_{17}SO_2NHCH_2CH_2SO_2CH=CH_2$ $CF_2=CF_2$ $CH_2=CHCO_2CH_2(CF_2)_4H$ $CH_2=CHCO_2CH_2(CF_2)_6H$ $CH_2=CHCO_2CH_2(CF_2)_8H$ $CH_2=C(CH_3)CO_2CH_2(CF_2)_4H$ $CH_2=C(CH_3)CO_2CH_2(CF_2)_6H$ $CH_2=C(CH_3)CO_2CH_2(CF_2)_8H$ $CH_2=C(CH_2COOC_2H_4C_4F_9)COOC_2H_4C_4F_9$ $CH_2=C(CH_2COOCH_2C_5F_{12}H)COOCH_2C_6F_{12}H$ $CH_2=CHCO_2CH_2CH_2OCH_2CH(OH)CH_2C_4F_9$ $CH_2=CHCO_2CH_2CH_2OCH_2CH(OH)CH_2C_6F_{13}$ $CH_2=C(CH_3)CO_2CH_2CH_2OCH_2CH(OH)C_8F_{17}$ $$CH_2=\overset{\overset{CH_2-COOC_2H_4C_4F_9}{|}}{C}-COOC_2H_4C_4F_9$$

$$CH_2=\overset{\overset{CH_2-COOCH_2C_6F_{12}H}{|}}{C}-COOCH_2C_6F_{12}H$$

Moreover, a macro monomer of the monomer described above is included. Preparation of the macro monomer can be easily performed by well-known recipes in the art.

For example, the above monomer is subjected to radical polymerization with thioglycolic acid, 2-mercapto ethanol, and the like in the presence of an initiator, and then an unsaturated bond which performs radical polymerization is introduced into one terminal end by reacting the resulting reaction products with glycidyl methacrylate, isocyanato ethyl methacrylate, and the like to form the above macro monomer.

The number-average molecular weight of the macro monomer is preferably 10,000 or less, and more preferably 5,000 or less.

Examples of the monomer (M3), that has unsaturated bond which performs radical polymerization and is different from either of the monomer (M1) and the monomer (M2), include well-known compounds such as methacrylate, vinyl ester, vinyl ether maleate, fumaleate, α-olefin, and the like.

Specific examples of these compounds include vinyl esters such as vinyl acetate, vinyl propionate, vinyl butyrate, vinyl pivalate, vinyl capronate, vinyl laurate, vinyl versate, vinyl cyclohexene carboxylate, or the like; vinyl ethers such as methyl vinyl ether, ethyl vinyl ether, n-propyl vinyl ether, isopropyl vinyl ether, n-butyl vinyl ether, isobutyl vinyl ether, t-butyl vinyl ether, n-pentyl vinyl ether, n-hexyl vinyl ether, n-octyl vinyl ether, 2-ethylhexyl vinyl ether, cyclohexyl vinyl ether, lauryl vinyl ether, or the like; mono-olefins such as ethylene, propyrene, or the like; maleates such as dimethyl maleate, diethyl maleate, dioctyl maleate, or the like; diolefins such as butadiene, isoprene, or the like; allyl compounds such as allyl acetate, or the like; methacrylate esters such as methyl methacrylate, ethyl methacrylate, n-butyl methacrylate, isobutyl methacrylate, 2-ethylhexyl methacrylate, n-octyl methacrylate, decyl methacrylate, dodecyl methacrylate, or the like; styrene monomers such as styrene, vinyl toluene, or the like; monomers such as acrylonitrile, or the like. And in addition to the above, macro monomers of the monomer described above is included.

Preparation of the macro monomer can be easily performed according to the well-known recipes in the art.

For example, the monomer described above is subjected to radical polymerization with thioglycol acid, 2-mercapto ethanol, and the like in the presence of an initiator, and then a radical polymerizable unsaturated bond is introduced into one terminal end by reacting the resultant reaction products with glycidyl methacrylate, isocyanato ethyl methacrylate, and the like to form the above macro monomer.

The monomer used can be selected from one, or two or more monomers mentioned above.

The monomer (M2) preferably contains a repeating unit A derived from a monomer of fluorine atom-containing acrylate or a monomer of fluorine atom-containing methacrylate.

Specifically, the repeating unit A can be derived from fluoromethacrylate represented by the following formula (P) or a mixture of fluoromethacrylate:

$$(Rf)pLOCOCR{=}CH_2 \qquad \text{Formula (P)}$$

wherein the substituent Rf represents a monovalent aliphatic organic group having 1 to 20 carbon atoms, more preferably 2 to 10 carbon atoms, and a fluorine atom. The backbone chain of Rf may be a straight chain, a branched chain, or a cyclic chain, and can contain a quaternary divalent oxygen atom or a trivalent nitrogen atom bonded only to the carbon atom directly. Rf is preferably completely fluorinated, but a hydrogen atom or a chlorine atom bonded to the carbon atom may be present as a substituent of the backbone chain of Rf. Rf preferably contains at least one perfluoromethyl terminal group. p is preferably 1 or 2.

The bonding group L represents a bond or a hydrocarbylene group having 1 to 12 carbon atoms. L is preferably a hydrocarbylene group having 1 to 12 carbon atoms. L may be arbitrary substituted and/or interrupted by a substituent with another atom such as O, P, S, or N, or an unsubstituted group. R represents one selected from a hydrogen atom or a methyl group. The mentioned fluoromethacrylate monomer preferably contains 30% by weight or more of fluorine atoms.

One example of the fluoromethacrylate useful for the present invention includes the compound described below:

$$CF_3(CF_2)x(CH_2)yOCOCR{=}CH_2$$

wherein x represents an integer of from 0 to 20, and more preferably an integer of from 2 to 10; y represents an integer of from 1 to 10; and R represents one selected from a hydrogen atom or a methyl group;

$$HCF_2(CF_2)xCH_2)yOCOCR{=}CH_2$$

wherein x represents an integer of from 0 to 20, and preferably an integer of from 2 to 10; y represents an integer of from 1 to 10; and R represents one selected from a hydrogen atom or a methyl group;

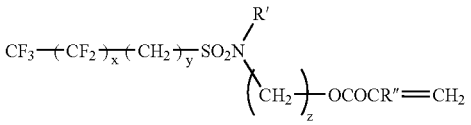

wherein x represents an integer of from 0 to 20, and preferably an integer of from 2 to 10; y represents an integer of from 1 to 10; z represents an integer of from 1 to 4; R' represents one selected from an alkyl group or an aryl alkyl group; and R" represents one selected from a hydrogen atom or a methyl group;

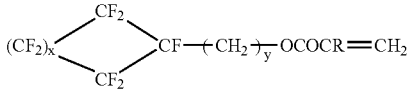

wherein x represents an integer of from 1 to 7; y represents an integer of from 1 to 10; and R represents one selected from a hydrogen atom or a methyl group;

$$CF_3(CF_2CF_2O)x(CF_2O)y(CH_2)zOCOCR{=}CH_2$$

wherein x+y represents an integer of from 1 to 20; z represents an integer of from 1 to 10; and R represents one selected from a hydrogen atom or a methyl group.

The copolymer according to the present invention may be either a random copolymer, a graft copolymer, or a block copolymer. A molecular weight of the copolymer is preferably, in terms of weight-average molecular weight, in a range of from about 5,000 to about 10,000,000, and more preferably from 5,000 to 1,000,000.

Concerning the composition of the fluorine atom-containing copolymer according to the present invention, preferred specific examples are shown below. However, the scope of the present invention is not limited to these examples.

TABLE 1

| | FL-1 | FL-2 | FL-3 | FL-4 | FL-5 |
|---|---|---|---|---|---|
| MMA | 50.8 | 49.8 | 0 | 0 | 50.8 |
| LaMA | 0 | 0 | 0 | 22 | 0 |
| EtMA | 0 | 0 | 85 | 0 | 0 |
| Fluorine-containing monomer-1 | 41.2 | 48.2 | 7 | 70 | 36.2 |
| 2-Acrylamido-2-methylpropanesulfonc acid | 8 | 0 | 0 | 0 | 0 |
| Acrylic acid | 0 | 2 | 8 | 0 | 8 |
| (Dimethylamino)ethyl methacrylate | 0 | 0 | 0 | 8 | 0 |
| Glycidyl methacrylate | 0 | 0 | 0 | 0 | 5 |

MMA: Methyl methacrylate
EtMA: Ethyl methacrylate
LaMA: Lauryl methacrylate
Fluorine atom-containing monomer-1: 1H,1H,2H,2H-Heptadecafluorodecyl methacrylate

TABLE 2

| | FL-6 | FL-7 | FL-8 |
|---|---|---|---|
| $CF_3(CF_2)7CH_2CH_2O{-}CH{=}CH_2$ | 72 | 0 | 0 |
| $CH_3(CH_2)_3{-}O{-}CH{=}CH_2$ | 14 | 0 | 0 |
| Thtrafluoroethylene | 0 | 25 | 0 |
| Propylene | 0 | 25 | 0 |
| Fluorine atom-containing monomer-2 | 0 | 0 | 50 |
| Graft monomer-3 | 0 | 0 | 40 |
| Acrylic acid | 0 | 50 | 0 |
| Maleic anhydride | 14 | 0 | 0 |
| Methacrylic acid | 0 | 0 | 10 |

Fluorine Atom-containing Monomer-2

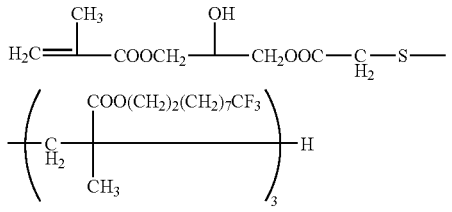

Graft Monomer-3

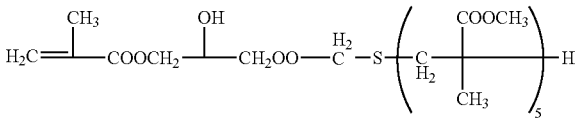

TABLE 3

| | FL-9 | FL-10 | FL-11 | FL-12 |
|---|---|---|---|---|
| MMA | 46.0 | 42.2 | 35.5 | 19.4 |
| BuA | 46.0 | 44.8 | 41.5 | 0 |
| Fluorine-containing monomer-4 | 5.0 | 10.0 | 20.0 | 40.0 |
| N-Methylolacrylamide | 1.0 | 1.0 | 1.0 | 1.0 |
| 2-Ethylhexyl acrylate | 0 | 0 | 0 | 37.6 |
| Acrylic acid | 2.0 | 2.0 | 2.0 | 2.0 |

BuA: Butyl acrylate
Fluorine-containing monomer-4: 2,2,2-Trifluoroethyl methacrylate

TABLE 4

| | FL-13 | FL-14 | FL-15 | FL-16 | FL-17 | FL-18 |
|---|---|---|---|---|---|---|
| Fluorine atom-containing monomer-5 | 5 | 15 | 25 | 20 | 5 | 10 |
| n-Butyl methacrylate | 90 | 60 | 65 | 70 | 83 | 78 |
| t-Butyl methacrylate | 0 | 20 | 0 | 0 | 0 | 0 |
| 2-Hydroxyethyl methacrylate | 0 | 0 | 5 | 5 | 10 | 10 |
| Acrylic acid | 5 | 5 | 5 | 5 | 2 | 2 |

Fluorine atom-containing monomer-5: β-(Perfluorooctyl) ethyl acrylate

FL-19: 33 parts of β-(perfluorooctyl)ethyl acrylate, 34 parts of β-(perfluorodecyl) ethyl acrylate, and 33 parts of β-(perfluorododecyl)ethyl acrylate Synthetic examples of some of the above specific examples are described.

<<Synthesis of FL-1>>

Into the reaction vessel with a stirrer, a reflux condenser, a dropping funnel, a thermometer, and a nitrogen gas inlet tube were added 64 parts of isopropyl alcohol, 4 parts of ion-exchange water, 14.8 parts of methyl methacrylate, 41.2 parts of 1H, 1H,2H,2H-heptadecafluorodecyl methacrylate, and 8 parts of 2-acrylamide-2-methylpropane sulfonic acid, while the dissolved oxygen was removed by bubbling of nitrogen gas.

On the other hand, 36 parts of dissolved-oxygen-removed isopropyl alcohol, 36 parts of methyl methacrylate and 0.07 parts of azobis-isobutyronitrile were added into the dropping funnel. After the temperature of the vessel was heated to 83±3° C., 2 parts of methyl ethyl ketone containing 0.13 parts of azobis-isobutyronitrile was added to the mixture, and the monomer was dropped from the dropping funnel in accordance with the consumption speed of the methyl methacrylate. After the finish of dropping the monomer, 3 parts of methyl ethyl ketone prepared by dissolving 0.2 parts of azobis-isobutyronitrile was added thereto and the reaction was continued over a period of 2 hours. Thereafter, 2 parts of methyl ethyl ketone prepared by dissolving 0.1 parts of azobis-isobutyronitrile was added and the reaction was continued over a period of 6 hours to give a homogeneous copolymer.

Thereafter, 15.5 parts of a 10% by weight aqueous solution of sodium hydroxide was added to the resultant copolymer to neutralize, and then 300 parts of ion-exchange water was added. The remaining methyl ethyl ketone was removed under the reduced pressure to form an aqueous dispersion of polymer FL-1 of the present invention.

<<Synthesis of FL-7>>

Into 1 liter stainless steel-made autoclave with stirrer were added 450 parts of dissolved-oxygen-removed methyl ethyl ketone and 5 parts of acrylic acid, and the inner gas was replaced by a nitrogen gas. After the inner gas was replaced by tetrafluoroethylene, the mixed monomer of propylene/tetrafluoroethylene=60 mol %/40 mol % was poured in the mixture and the inner pressure was set to 4.9 MPa.

The temperature was elevated after the start of stirring, and when the inner temperature reached to 70° C., 10 parts of methyl ethyl ketone prepared by dissolving 0.9 parts of benzoyl peroxide was poured and the mixed monomer having the same composition as the above was added while keeping the inner pressure at 13.7 MPa. Thereafter 145 parts of acrylic acid was added over a period of 8 hours. While keeping the inner temperature at 75° C., each monomer was added in accordance with the consumption speed of propylene and tetrafluoroethylene, during the process the inner pressure was kept in a range of from 12.7 Mpa to 13.7 MPa. Thereafter, at 3 hours later and at 6 hours later, 10 parts of methyl ethyl ketone prepared by dissolving 0.9 parts of benzoyl peroxide was added respectively and then after the reaction was continued over a period of 12 hours, the autoclave was cooled down and the volatile substances were evaporated, while the consumption amount of the mixed monomer reached to approximately 150 parts.

A composition of the obtained copolymer was measured by NMR method and the measurement resulted in a composition such as tetrafluoroethylene/propyrene/acrylic acid=25% by weight/25% by weight/50% by weight.

Thereafter, to 100 parts of the copolymer (solid content: 38.5 parts), 27 parts of triethylamine and 160 parts of ion-exchange water were added and then the remaining methyl ethyl ketone was removed under a reduced pressure to form an aqueous dispersion of polymer FL-7 of the present invention.

The synthesizing method of the polymer used for the present invention is not restricted to the above procedures, and any well-known method can be applied. Details can be referred to the literature described in JP-A Nos. 2-147601, 5-17538, 8-208936, and 11-288061.

The polymers of the present invention are commercially available, and AG-7000 (manufactured by Asahi Glass Co., Ltd.), NK Guard NDN-5E, NK Guard NDN-7E, and NK Guard NDN-2000 (all manufactured by Nicca Chemical Co., Ltd.) are described.

The solvent of the coating solution for the outermost layer may be either an organic solvent or an aqueous solvent, but an aqueous solvent is preferred. In the case of the aqueous solvent, the copolymer used in the present invention is preferably a hydrophobic polymer and preferably used in the form of polymer latex in the coating solution. Herein the polymer latex means the one in a dispersed state where fine particles of a water-insoluble hydrophobic polymer are dispersed in water.

The mean particle diameter and the particle diameter distribution of the dispersed particles are the same as described in the explanation of latex polymer described below.

The term "an aqueous solvent" means a solvent consisted of water or a mixture of water and 70% by weight or less of a water-miscible organic solvent. Examples of the water-miscible organic solvents include alcohols such as methyl alcohol, ethyl alcohol, or propyl alcohol, cellosolves such as methyl cellosolve, ethyl cellosolve, or butyl cellosolve, ethyl acetate, dimethyl formamide, and the like.

As a binder for the outermost layer according to the present invention, hydrophilic polymers such as gelatin, poly(vinyl alcohol), methyl cellulose, hydroxypropyl cellulose, carboxymethyl cellulose, or the like are preferred, and gelatin is more preferred. These hydrophilic polymers may be used in combination with the latex polymers described below.

When the above-mentioned copolymer is used, the content of polymer is preferably 20% by weight or higher, and more preferably from 30% by weight or higher, based on the total binder.

The coating amount of the polymer is in a range from 0.05 $g/m^2$ to 2.0 $g/m^2$, and more preferably from 0.1 $g/m^2$ to 1.0 $g/m^2$.

(Non-photosensitive Organic Silver Salt)

1) Composition

The non-photosensitive organic silver salt which can be used in the present invention is relatively stable to light but serves as to supply silver ions and forms silver images when heated to 80° C. or higher in the presence of an exposed photosensitive silver halide and a reducing agent. The organic silver salt may be any material containing a source supplying silver ions that are reducible by a reducing agent. Such a non-photosensitive organic silver salt is disclosed, for example, in JP-A No. 10-62899 (paragraph Nos. 0048 to 0049), European Patent (EP) No. 803,764A1 (page 18, line 24 to page 19, line 37), EP No. 962,812A1, JP-A Nos. 11-349591, 2000-7683, and 2000-72711, and the like. A silver salt of an organic acid, particularly, a silver salt of a long-chained aliphatic carboxylic acid (having 10 to 30 carbon atoms, and preferably having 15 to 28 carbon atoms) is preferable. Preferred examples of the silver salt of a fatty acid include silver lignocerate, silver behenate, silver arachidinate, silver stearate, silver oleate, silver laurate, silver capronate, silver myristate, silver palmitate, silver erucate, and mixtures thereof. In the invention, among these silver salts of a fatty acid, it is preferred to use a silver salt of a fatty acid with a silver behenate content of 50 mol % or higher, more preferably 85 mol % or higher, and even more preferably 95 mol % or higher. Further, it is preferred to use a silver salt of a fatty acid with a silver erucate content of 2 mol % or lower, more preferably, 1 mol % or lower, and even more preferably, 0.1 mol % or lower.

It is preferred that the content of silver stearate is 1 mol % or lower. When the content of silver stearate is 1 mol % or lower, a silver salt of an organic acid having low fog, high sensitivity and excellent image storability can be obtained. The above-mentioned content of silver stearate is preferably 0.5 mol % or lower, and particularly preferably, silver stearate is not substantially contained.

Further, in the case where the silver salt of an organic acid includes silver arachidinate, it is preferred that the content of silver arachidinate is 6 mol % or lower in order to obtain a silver salt of an organic acid having low fog and excellent image storability. The content of silver arachidinate is more preferably 3 mol % or lower.

2) Shape

There is no particular restriction on the shape of the organic silver salt usable in the invention and it may be needle-like, bar-like, tabular, or flake shaped.

In the invention, a flake shaped organic silver salt is preferred. Short needle-like, rectangular, cubic, or potato-like indefinite shaped particles with the major axis to minor axis ratio being 5 or lower are also used preferably. Such organic silver salt particles suffer less from fogging during thermal development compared with long needle-like particles with the major axis to minor axis length ratio of higher than 5. Particularly, a particle with the major axis to minor axis ratio of 3 or lower is preferred since it can improve the mechanical stability of the coating film. In the present specification, the flake shaped organic silver salt is defined as described below. When an organic silver salt is observed under an electron microscope, calculation is made while approximating the shape of a particle of the organic silver salt to a rectangular body and assuming each side of the rectangular body as a, b, c from the shorter side (c may be identical with b) and determining x based on numerical values a, b for the shorter side as below.

$$x=b/a$$

As described above, x is determined for the particles by the number of about 200 and those satisfying the relation: x (average)≧1.5 as an average value x is defined as a flake shape. The relation is preferably: 30≧x (average)≧1.5 and, more preferably, 15≧x (average)≧1.5. By the way, needle-like is expressed as 1≦x (average)<1.5.

In the flake shaped particle, a can be regarded as a thickness of a tabular particle having a major plane with b and c being as the sides. a in average is preferably from 0.01 μm to 0.3 μm and, more preferably from 0.1 μm to 0.23 μm. c/b in average is preferably from 1 to 9, more preferably from 1 to 6, even more preferably from 1 to 4 and, most preferably from 1 to 3.

By controlling the equivalent spherical diameter being from 0.05 μm to 1 μm, it causes less agglomeration in the photothermographic material and image storability is improved. The equivalent spherical diameter is preferably from 0.1 μm to 1 μm. In the invention, an equivalent spherical diameter can be measured by a method of photographing a sample directly by using an electron microscope and then image processing the negative images.

In the flake shaped particle, the equivalent spherical diameter of the particle/a is defined as an aspect ratio. The aspect ratio of the flake shaped particle is preferably from 1.1 to 30 and, more preferably, from 1.1 to 15 with a viewpoint of causing less agglomeration in the photothermographic material and improving the image storability.

As the particle size distribution of the organic silver salt, monodispersion is preferred. In the monodispersion, the percentage for the value obtained by dividing the standard deviation for the length of minor axis and major axis by the minor axis and the major axis respectively is preferably 100% or less, more preferably 80% or less and, even more preferably 50% or less. The shape of the organic silver salt can be measured by analyzing a dispersion of an organic silver salt as transmission type electron microscopic images. Another method of measuring the monodispersion is a method of determining of the standard deviation of the volume weighted mean diameter of the organic silver salt in which the percentage for the value defined by the volume weight mean diameter (variation coefficient) is preferably 100% or less, more preferably 80% or less and, even more preferably 50% or less. The monodispersion can be determined from particle size (volume weighted mean diameter) obtained, for example, by a measuring method of irradiating a laser beam to organic silver salts dispersed in a liquid, and determining a self correlation function of the fluctuation of scattered light to the change of time.

3) Preparation

Methods known in the art can be applied to the method for producing the organic silver salt used in the invention and to the dispersing method thereof. For example, reference can be made to JP-A No. 10-62899, EP Nos. 803,763A1 and 962, 812A1, JP-A Nos. 11-349591, 2000-7683, 2000-72711, 2001-163889, 2001-163890, 2001-163827, 2001-33907, 2001-188313, 2001-83652, 2002-6442, 2002-49117, 2002-31870, and 2002-107868, and the like.

When a photosensitive silver salt is present together during dispersion of the organic silver salt, fog increases and sensitivity becomes remarkably lower, so that it is more preferred that the photosensitive silver salt is not substantially contained during dispersion. In the invention, the amount of the photosensitive silver salt to be dispersed in the aqueous dispersion is preferably 1 mol % or less, more preferably 0.1 mol % or less, per 1 mol of the organic silver salt in the solution and, even more preferably, positive addition of the photosensitive silver salt is not conducted.

In the invention, the photothermographic material can be manufactured by mixing an aqueous dispersion of the organic silver salt and an aqueous dispersion of a photosensitive silver salt, and the mixing ratio between the organic silver salt and the photosensitive silver salt can be selected depending on the purpose. The ratio of the photosensitive silver salt relative to the organic silver salt is preferably in a range of from 1 mol % to 30 mol %, more preferably from 2 mol % to 20 mol % and, particularly preferably from 3 mol % to 15 mol %. A method of mixing two or more aqueous dispersions of organic silver salts and two or more aqueous dispersions of photosensitive silver salts upon mixing is used preferably for controlling photographic properties.

4) Addition Amount

While the organic silver salt of the invention can be used in a desired amount, a total amount of coated silver including silver halide is preferably in a range of from 0.1 g/m$^2$ to 5.0 g/m$^2$, more preferably from 0.3 g/m$^2$ to 3.0 g/m$^2$, and even more preferably from 0.5 g/m$^2$ to 2.0 g/m$^2$. In particular, in order to improve image storability, the total amount of coated silver is preferably 1.8 mg/m$^2$ or less, and more preferably 1.6 mg/m$^2$ or less. In the case where a preferable reducing agent of the invention is used, it is possible to obtain a sufficient image density by even such a low amount of silver.

(Reducing agent)

The photothermographic material of the present invention preferably contains a reducing agent for organic silver salts as a thermal developing agent. The reducing agent for organic silver salts can be any substance (preferably, organic substance) which reduces silver ions into metallic silver. Examples of the reducing agent are described in JP-A No. 11-65021 (column Nos. 0043 to 0045) and EP No. 803,764 (p. 7, line 34 to p. 18, line 12).

The reducing agent according to the invention is preferably a so-called hindered phenolic reducing agent or a bisphenol agent having a substituent at the ortho-position with respect to the phenolic hydroxy group. It is more preferably a compound represented by the following formula (R).

Formula (R)

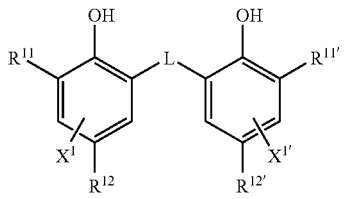

In formula (R), $R^{11}$ and $R^{11'}$ each independently represent an alkyl group having 1 to 20 carbon atoms. $R^{12}$ and $R^{12'}$ each independently represent a hydrogen atom or a substituent which substitutes for a hydrogen atom on a benzene ring. L represents an —S— group or a —$CHR^{13}$— group. $R^{13}$ represents a hydrogen atom or an alkyl group having 1 to 20 carbon atoms. $X^1$ and $X^{1'}$ each independently represent a hydrogen atom or a group substituting for a hydrogen atom on a benzene ring.

Formula (R) is to be described in detail.

In the following description, when referred an alkyl group, it means that the alkyl group contains a cycloalkyl group, as far as it is not mentioned specifically.

1) $R^{11}$ and $R^{11'}$ $R^{11}$ and $R^{11'}$ each independently represent a substituted or unsubstituted alkyl group having 1 to 20 carbon atoms. The substituent for the alkyl group has no particular restriction and include, preferably, an aryl group, a hydroxy group, an alkoxy group, an aryloxy group, an alkylthio group, an arylthio group, an acylamino group, a sulfonamide group, a sulfonyl group, a phosphoryl group, an acyl group, a carbamoyl group, an ester group, a ureido group, a urethane group, a halogen atom, and the like.

2) $R^{12}$ and $R^{12'}$, $X^1$ and $X^{1'}$ $R^{12}$ and $R^{12'}$ each independently represent a hydrogen atom or a substituent which substitutes for a hydrogen atom on a benzene ring. $X^1$ and $X^{1'}$ each independently represent a hydrogen atom or a group substituting for a hydrogen atom on a benzene ring. As each of the groups substituting for a hydrogen atom on the benzene ring, an alkyl group, an aryl group, a halogen atom, an alkoxy group, and an acylamino group are described preferably.

3) L

L represents an —S— group or a —$CHR^{13}$— group. $R^{13}$ represents a hydrogen atom or an alkyl group having 1 to 20 carbon atoms in which the alkyl group may have a substituent. Specific examples of the unsubstituted alkyl group for $R^{13}$ include a methyl group, an ethyl group, a propyl group, a butyl group, a heptyl group, an undecyl group, an isopropyl group, a 1-ethylpentyl group, a 2,4,4-trimethylpentyl group, cyclohexyl group, 2,4-dimethyl-3-cyclohexenyl group, 3,5-dimethyl-3-cyclohexenyl group, and the like. Examples of the substituent for the alkyl group include, similar to the substituent of $R^{11}$, a halogen atom, an alkoxy group, an alkylthio group, an aryloxy group, an arylthio group, an acylamino group, a sulfonamide group, a sulfonyl group, a phosphoryl group, an oxycarbonyl group, a carbamoyl group, a sulfamoyl group, and the like.

4) Preferred Substituents $R^{11}$ and $R^{11'}$ are preferably a primary, secondary, or tertiary alkyl group having 1 to 15 carbon atoms and examples thereof include, specifically, a methyl group, an isopropyl group, a t-butyl group, a t-amyl group, a t-octyl group, a cyclohexyl group, a cyclopentyl group, a 1-methylcyclohexyl group, a 1-methylcyclopropyl group, and the like. $R^{11}$ and $R^{11'}$ each represent, more preferably, an alkyl group having 1 to 8 carbon atoms and, among them, a methyl group, a t-butyl group, a t-amyl group, and a 1-methylcyclohexyl group are even more preferred and, a methyl group and a t-butyl group being most preferred.

$R^{12}$ and $R^{12'}$ are preferably an alkyl group having 1 to 20 carbon atoms and examples thereof include, specifically, a methyl group, an ethyl group, a propyl group, a butyl group, an isopropyl group, a t-butyl group, a t-amyl group, a cyclohexyl group, a 1-methylcyclohexyl group, a benzyl group, a methoxymethyl group, a methoxyethyl group, and the like. More preferred are a methyl group, an ethyl group, a propyl group, an isopropyl group, and a t-butyl group, and particularly preferred are a methyl group and an ethyl group.

$X^1$ and $X^{1'}$ are preferably a hydrogen atom, a halogen atom, or an alkyl group, and more preferably a hydrogen atom.

L is preferably a —$CHR^{13}$— group.

$R^{13}$ is preferably a hydrogen atom or an alkyl group having 1 to 15 carbon atoms. The alkyl group is preferably a chain or a cyclic alkyl group. And, a group which has a C═C bond in these alkyl group is also preferably used. Preferable examples of the alkyl group include a methyl group, an ethyl group, a propyl group, an isopropyl group, a 2,4,4-trimethylpentyl group, a cyclohexyl group, a 2,4-dimethyl-3-cyclohexenyl group, a 3,5-dimetyl-3-cyclohexenyl group, and the like. Particularly preferable $R^{13}$ is a hydrogen atom, a methyl group, an ethyl group, a propyl group, an isopropyl group, or a 2,4-dimethyl-3-cyclohexenyl group.

In the case where $R^{11}$ and $R^{11'}$ are a tertiary alkyl group and $R^{12}$ and $R^{12'}$ are a methyl group, $R^{13}$ is preferably a primary or secondary alkyl group having 1 to 8 carbon atoms (a methyl group, an ethyl group, a propyl group, an isopropyl group, a 2,4-dimethyl-3-cyclohexenyl group, or the like).

In the case where $R^{11}$ and $R^{11'}$ are a tertiary alkyl group and $R^{12}$ and $R^{12'}$ are an alkyl group other than a methyl group, $R^{13}$ is preferably a hydrogen atom.

In the case where $R^{11}$ and $R^{11'}$ are not a tertiary alkyl group, $R^{13}$ is preferably a hydrogen atom or a secondary alkyl group, and particularly preferably a secondary alkyl group. As the secondary alkyl group for $R^{13}$, an isopropyl group and a 2,4-dimethyl-3-cyclohexenyl group are preferred.

The reducing agent described above shows different thermal developing performance, color tone of developed silver images, or the like depending on the combination of $R^{11}$, $R^{11'}$, $R^{12}$, $R^{12'}$, and $R^{13}$. Since the performance can be controlled by using two or more reducing agents in combination, it is preferred to use two or more reducing agents in combination depending on the purpose.

Specific examples of the reducing agent of the invention including the compounds represented by formula (R) according to the invention are shown below, but the invention is not restricted to these.

R-1

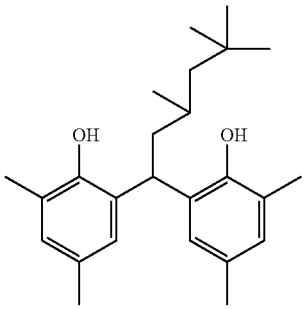

-continued

R-2

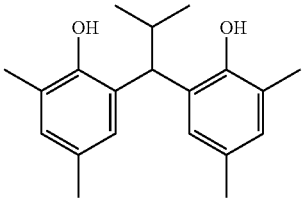

R-3

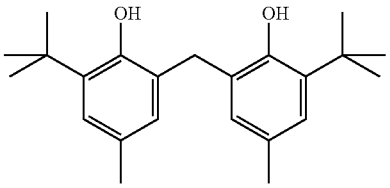

R-4

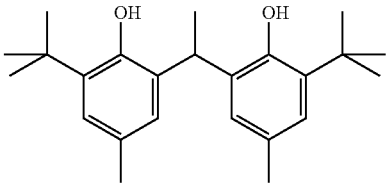

R-5

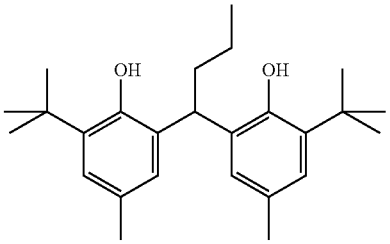

R-6

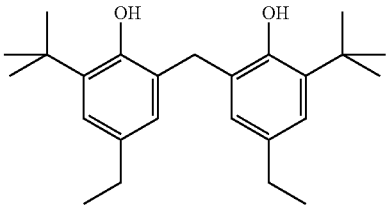

R-7

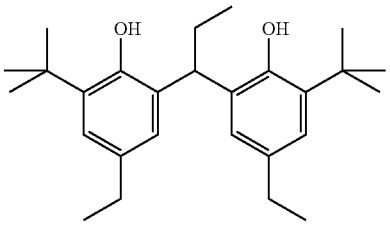

R-8

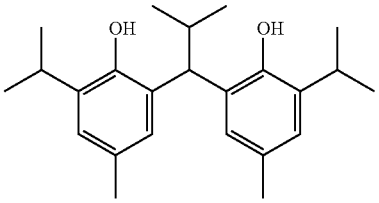

-continued

R-9

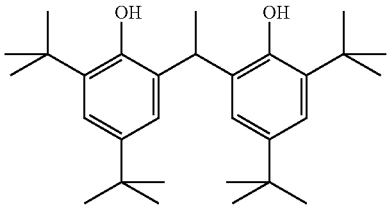

R-10

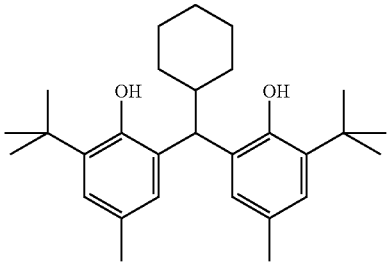

R-11

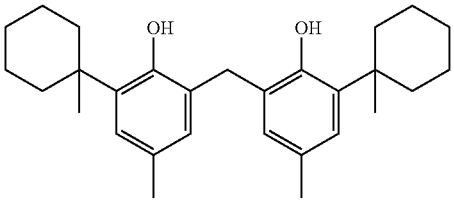

R-12

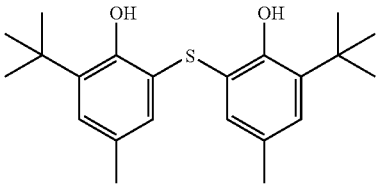

R-13

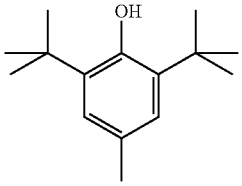

R-14

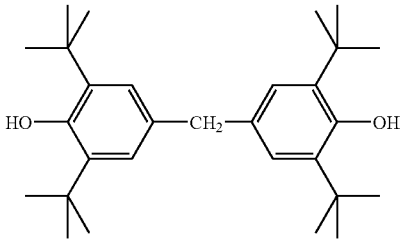

R-15

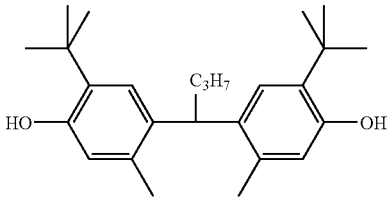

-continued

R-16

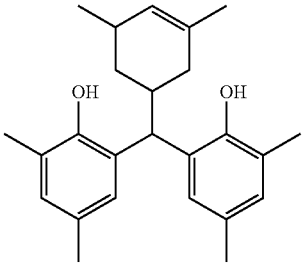

R-17

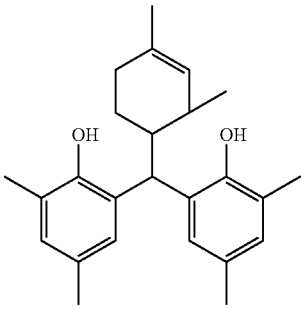

R-18

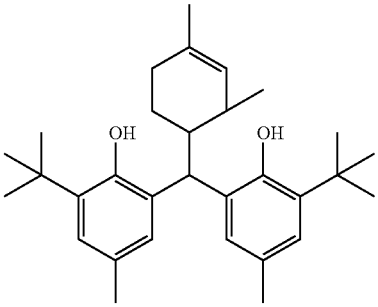

As preferred examples of the reducing agent of the invention other than those above, there are mentioned compounds disclosed in JP-A Nos. 2001-188314, 2001-209145, 2001-350235, and 2002-156727, and EP No. 1,278,101A2.

The addition amount of the reducing agent is preferably from 0.1 g/m$^2$ to 3.0 g/m$^2$, more preferably from 0.2 g/m$^2$ to 2.0 g/m$^2$ and, even more preferably from 0.3 g/m$^2$ to 1.0 g/m$^2$. It is preferably contained in a range of from 5 mol % to 50 mol %, more preferably from 8 mol % to 30 mol % and, even more preferably from 10 mol % to 20 mol %, per 1 mol of silver in the image forming layer. The reducing agent is preferably contained in the image forming layer.

In the invention, the reducing agent may be incorporated into the photothermographic material by being added into the coating solution, such as in the form of a solution, an emulsified dispersion, a solid fine particle dispersion, or the like.

As well known emulsion dispersing method, there is mentioned a method comprising dissolving the reducing agent in an oil such as dibutylphthalate, tricresylphosphate, dioctylsebacate, tri(2-ethylhexyl)phosphate, or the like, and an auxiliary solvent such as ethyl acetate, cyclohexanone, or the like, and then adding a surfactant such as sodium dodecylbenzenesulfonate, sodium oleoil-N-methyltaurinate, sodium di(2-ethylhexyl)sulfosuccinate or the like; from which an emulsion dispersion is mechanically produced. During the process, for the purpose of controlling viscosity of oil droplet and refractive index, the addition of polymer such as α-methylstyrene oligomer, poly(t-butylacrylamide), or the like is preferable.

As solid particle dispersing method, there is mentioned a method comprising dispersing the powder of the reducing agent in a proper solvent such as water or the like, by means of ball mill, colloid mill, vibrating ball mill, sand mill, jet mill, roller mill, or ultrasonics, thereby obtaining a solid dispersion. In this case, there may be used a protective colloid (such as poly(vinyl alcohol)), or a surfactant (for instance, an anionic surfactant such as sodium triisopropylnaphthalenesulfonate (a mixture of compounds having the three isopropyl groups in different substitution sites)). In the mills enumerated above, generally used as the dispersion media are beads made of zirconia or the like, and Zr or the like eluting from the beads may be incorporated in the dispersion. Although depending on the dispersing conditions, the amount of Zr or the like incorporated in the dispersion is generally in a range of from 1 ppm to 1000 ppm. It is practically acceptable so long as Zr is incorporated in an amount of 0.5 mg or less per 1 g of silver.

Preferably, an antiseptic (for instance, benzisothiazolinone sodium salt) is added in an aqueous dispersion.

The reducing agent is particularly preferably used as a solid particle dispersion, and is added in the form of fine particles having a mean particle size of from 0.01 μm to 10 μm, preferably from 0.05 μm to 5 μm and, more preferably from 0.1 μm to 2 μm. In the invention, other solid dispersions are preferably used with this particle size range.

(Development Accelerator)

In the photothermographic material of the invention, as a development accelerator, sulfonamide phenolic compounds described in the specification of JP-A No. 2000-267222, and represented by formula (A) described in the specification of JP-A No. 2000-330234; hindered phenolic compounds represented by formula (II) described in JP-A No. 2001-92075; hydrazine compounds described in the specification of JP-A No. 10-62895, represented by formula (I) described in the specification of JP-A No. 11-15116, represented by formula (D) described in the specification of JP-A No. 2002-156727, and represented by formula (1) described in the specification of JP-A No. 2002-278017; and phenolic or naphtholic compounds represented by formula (2) described in the specification of JP-A No. 2001-264929 are used preferably. Further, phenolic compounds described in JP-A Nos. 2002-311533 and 2002-341484 are also preferable. Naphtholic compounds described in JP-A No. 2003-66558 are particularly preferable.

In the photothermographic material of the present invention, the development accelerator is used in a range of from 0.1 mol % to 20 mol %, preferably in a range of from 0.5 mol % to 10 mol % and, more preferably in a range of from 1 mol % to 5 mol %, with respect to the reducing agent. The introducing methods to the photothermographic material include similar methods as those for the reducing agent and, it is particularly preferred to add as a solid dispersion or an emulsified dispersion. In the case of adding as an emulsified dispersion, it is preferred to add as an emulsified dispersion dispersed by using a solvent having a high boiling point which is solid at a normal temperature and an auxiliary solvent having a low boiling point, or to add as a so-called oilless emulsified dispersion not using a solvent having a high boiling point.

In the present invention, among the development accelerators described above, it is more preferred to use hydrazine compounds described in the specification of JP-A Nos. 2002-156727 and 2002-278017, and naphtholic compounds described in the specification of JP-A No. 2003-66558.

Particularly preferred development accelerators of the invention are compounds represented by the following formulae (A-1) or (A-2).

$Q_1$-NHNH-$Q_2$ Formula (A-1)

In the formula, $Q_1$ represents an aromatic group or a heterocyclic group which bonds to —NHNH-$Q_2$ at a carbon atom, and $Q_2$ represents one selected from a carbamoyl group, an acyl group, an alkoxycarbonyl group, an aryloxycarbonyl group, a sulfonyl group, or a sulfamoyl group.

In formula (A-1), the aromatic group or the heterocyclic group represented by $Q_1$ is preferably a 5- to 7-membered unsaturated ring. Preferred examples include a benzene ring, a pyridine ring, a pyrazine ring, a pyrimidine ring, a pyridazine ring, a 1,2,4-triazine ring, a 1,3,5-triazine ring, a pyrrole ring, an imidazole ring, a pyrazole ring, a 1,2,3-triazole ring, a 1,2,4-triazole ring, a tetrazole ring, a 1,3,4-thiadiazole ring, a 1,2,4-thiadiazole ring, a 1,2,5-thiadiazole ring, a 1,3,4-oxadiazole ring, a 1,2,4-oxadiazole ring, a 1,2,5-oxadiazole ring, a thiazole ring, an oxazole ring, an isothiazole ring, an isooxazole ring, a thiophene ring, and the like. Condensed rings in which the rings described above are condensed to each other are also preferred.

The rings described above may have substituents and in the case where they have two or more substituents, the substituents may be identical or different from each other. Examples of the substituent include a halogen atom, an alkyl group, an aryl group, a carbonamide group, an alkylsulfonamide group, an arylsulfonamide group, an alkoxy group, an aryloxy group, an alkylthio group, an arylthio group, a carbamoyl group, a sulfamoyl group, a cyano group, an alkylsulfonyl group, an arylsulfonyl group, an alkoxycarbonyl group, an aryloxycarbonyl group, and an acyl group. In the case where the substituents are groups capable of substitution, they may have further substituents and examples of preferred substituents include a halogen atom, an alkyl group, an aryl group, a carbonamide group, an alkylsulfonamide group, an arylsulfonamide group, an alkoxy group, an aryloxy group, an alkylthio group, an arylthio group, an acyl group, an alkoxycarbonyl group, an aryloxycarbonyl group, a carbamoyl group, a cyano group, a sulfamoyl group, an alkylsulfonyl group, an arylsulfonyl group, and an acyloxy group.

The carbamoyl group represented by Q2 is a carbamoyl group preferably having 1 to 50 carbon atoms, and more preferably having 6 to 40 carbon atoms, and examples thereof include unsubstituted carbamoyl, methyl carbamoyl, N-ethylcarbamoyl, N-propylcarbamoyl, N-sec-butylcarbamoyl, N-octylcarbamoyl, N-cyclohexylcarbamoyl, N-tert-butylcarbamoyl, N-dodecylcarbamoyl, N-(3-dodecyloxypropyl)carbamoyl, N-octadecylcarbamoyl, N-{3-(2,4-tert-pentylphenoxy)propyl}carbamoyl, N-(2-hexyldecyl)carbamoyl, N-phenylcarbamoyl, N-(4-dodecyloxyphenyl)carbamoyl, N-(2-chloro-5-dodecyloxycarbonylphenyl)carbamoyl, N-naphthylcarbamoyl, N-3-pyridylcarbamoyl, and N-benzylcarbamoyl.

The acyl group represented by $Q_2$ is an acyl group preferably having 1 to 50 carbon atoms, and more preferably having 6 to 40 carbon atoms, and examples thereof include formyl, acetyl, 2-methylpropanoyl, cyclohexylcarbonyl, octanoyl, 2-hexyldecanoyl, dodecanoyl, chloroacetyl, trifluoroacetyl, benzoyl, 4-dodecyloxybenzoyl, and 2-hydroxymethylbenzoyl. The alkoxycarbonyl group represented by $Q_2$ is an alkoxycarbonyl group preferably having 2 to 50 carbon atoms, and more preferably having 6 to 40 carbon atoms, and example thereof include methoxycarbonyl, ethoxycarbonyl, isobutyloxycarbonyl, cyclohexyloxycarbonyl, dodecyloxycarbonyl, and benzyloxycarbonyl.

The aryloxy carbonyl group represented by $Q_2$ is an aryloxycarbonyl group preferably having 7 to 50 carbon atoms, and more preferably having 7 to 40 carbon atoms, and examples thereof include phenoxycarbonyl, 4-octyloxyphenoxycarbonyl, 2-hydroxymethylphenoxycarbonyl, and 4-dodecyloxyphenoxycarbonyl. The sulfonyl group represented by $Q_2$ is a sulfonyl group preferably having 1 to 50 carbon atoms, and more preferably having 6 to 40 carbon atoms, and examples thereof include methylsulfonyl, butylsulfonyl, octylsulfonyl, 2-hexadecylsulfonyl, 3-dodecyloxypropylsulfonyl, 2-octyloxy-5-tert-octylphenyl sulfonyl, and 4-dodecyloxyphenyl sulfonyl.

The sulfamoyl group represented by $Q_2$ is a sulfamoyl group preferably having 0 to 50 carbon atoms, and more preferably having 6 to 40 carbon atoms, and examples thereof include unsubstituted sulfamoyl, N-ethylsulfamoyl group, N-(2-ethylhexyl)sulfamoyl, N-decylsulfamoyl, N-hexadecylsulfamoyl, N-{3-(2-ethylhexyloxy)propyl}sulfamoyl, N-(2-chloro-5-dodecyloxycarbonylphenyl)sulfamoyl, and N-(2-tetradecyloxyphenyl)sulfamoyl. The group represented by $Q_2$ may further have a group mentioned as the example of the substituent of 5- to 7-membered unsaturated ring represented by $Q_1$ at the position capable of substitution. In a case where the group has two or more substituents, such substituents may be identical or different from one another.

Next, preferred range for the compound represented by formula (A-1) is to be described. A 5- or 6-membered unsaturated ring is preferred for $Q_1$, and a benzene ring, a pyrimidine ring, a 1,2,3-triazole ring, a 1,2,4-triazole ring, a tetrazole ring, a 1,3,4-thiadiazole ring, a 1,2,4-thiadiazole ring, a 1,3,4-oxadiazole ring, a 1,2,4-oxadiazole ring, a thioazole ring, an oxazole ring, an isothiazole ring, an isooxazole ring, and a ring in which the ring described above is condensed with a benzene ring or unsaturated heterocycle are more preferred. Further, $Q_2$ is preferably a carbamoyl group and, particularly, a carbamoyl group having a hydrogen atom on the nitrogen atom is particularly preferred.

Formula (A - 2)

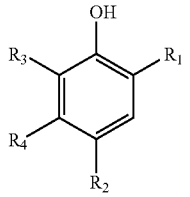

In formula (A-2), $R_1$ represents one selected from an alkyl group, an acyl group, an acylamino group, a sulfonamide group, an alkoxycarbonyl group, or a carbamoyl group. $R_2$ represents one selected from a hydrogen atom, a halogen atom, an alkyl group, an alkoxy group, an aryloxy group, an alkylthio group, an arylthio group, an acyloxy group, or a carbonate ester group. $R_3$ and $R_4$ each independently represent a group substituting for a hydrogen atom on a benzene ring which is mentioned as the example of the substituent for formula (A-1). $R_3$ and $R_4$ may link together to form a condensed ring.

$R_1$ is preferably an alkyl group having 1 to 20 carbon atoms (for example, a methyl group, an ethyl group, an isopropyl group, a butyl group, a tert-octyl group, a cyclohexyl group, or the like), an acylamino group (for example, an acetylamino group, a benzoylamino group, a methylureido group, a 4-cyanophenylureido group, or the like), or a carbamoyl group (for example, a n-butylcarbamoyl group, an N,N-diethylcarbamoyl group, a phenylcarbamoyl group, a 2-chlorophenylcarbamoyl group, a 2,4-dichlorophenylcarbamoyl group, or the like). An acylamino group (including a ureido group and a urethane group) is more preferred. $R_2$ is preferably a halogen atom (more preferably, a chlorine atom or a bromine atom), an alkoxy group (for example, a methoxy group, a butoxy group, an n-hexyloxy group, an n-decyloxy group, a cyclohexyloxy group, a benzyloxy group, or the like), or an aryloxy group (for example, a phenoxy group, a naphthoxy group, or the like).

$R_3$ is preferably a hydrogen atom, a halogen atom, or an alkyl group having 1 to 20 carbon atoms, and most preferably a halogen atom. $R_4$ is preferably a hydrogen atom, an alkyl group, or an acylamino group, and more preferably an alkyl group or an acylamino group. Examples of the preferred substituent thereof are similar to those for $R_1$. In the case where $R_4$ is an acylamino group, $R_4$ may preferably link with $R_3$ to form a carbostyryl ring.

In the case where $R_3$ and $R_4$ in formula (A-2) link together to form a condensed ring, a naphthalene ring is particularly preferred as the condensed ring. The same substituent as the example of the substituent referred to for formula (A-1) may bond to the naphthalene ring. In the case where formula (A-2) is a naphtholic compound, $R_1$ is preferably a carbamoyl group. Among them, a benzoyl group is particularly preferred. $R_2$ is preferably an alkoxy group or an aryloxy group and, particularly preferably an alkoxy group.

Preferred specific examples for the development accelerator of the invention are to be described below. The invention is not restricted to them.

A - 1

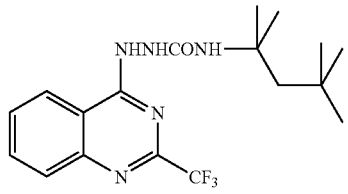

A - 2

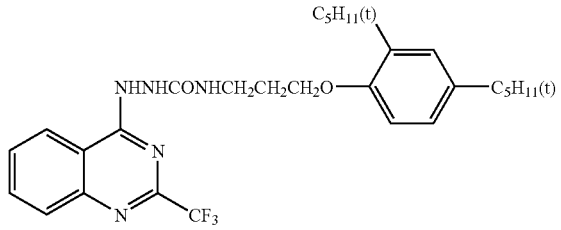

A - 3

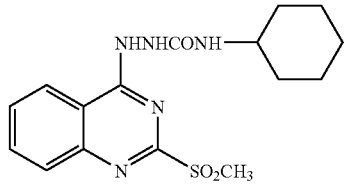

A - 4

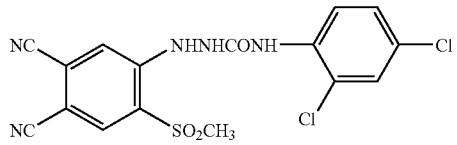

-continued

A - 5

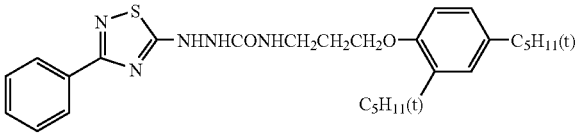

A - 6

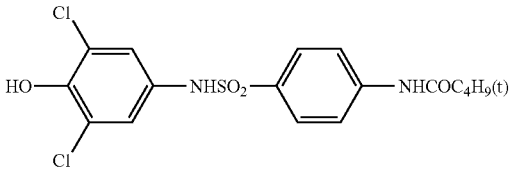

A - 7

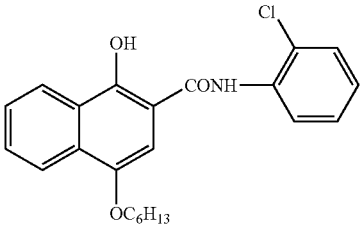

A - 8

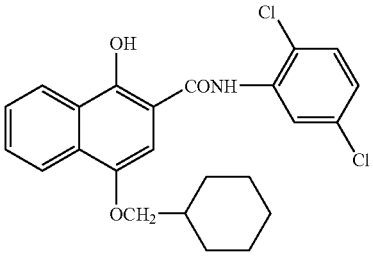

A - 9

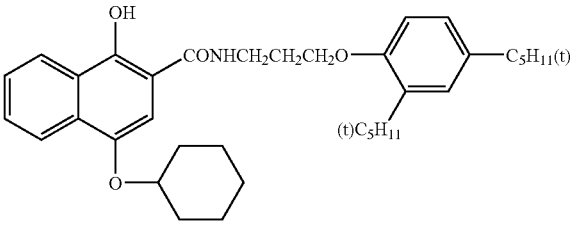

A - 10

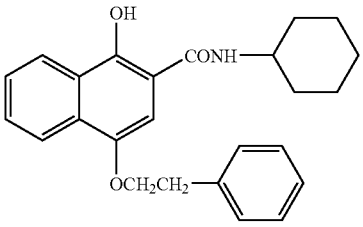

A - 11

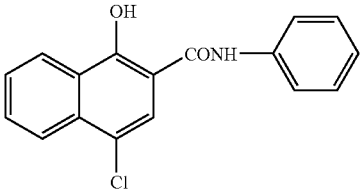

-continued

A - 12

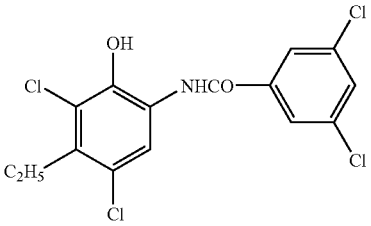

(Hydrogen Bonding Compound)

In the invention, in the case where the reducing agent has an aromatic hydroxy group (—OH) or an amino group (—NHR, R represents a hydrogen atom or an alkyl group), particularly in the case where the reducing agent is a bisphenol described above, it is preferred to use in combination, a non-reducing compound having a group which reacts with these groups of the reducing agent and forms a hydrogen bond therewith.

As the group forming a hydrogen bond with a hydroxy group or an amino group, there are mentioned a phosphoryl group, a sulfoxide group, a sulfonyl group, a carbonyl group, an amide group, an ester group, a urethane group, a ureido group, a tertiary amino group, a nitrogen-containing aromatic group, and the like. Particularly preferred among them is a phosphoryl group, a sulfoxide group, an amide group (not having —N(H)— moiety but being blocked in the form of —N(Ra)— (where, Ra represents a substituent other than H)), a urethane group (not having —N(H)— moiety but being blocked in the form of —N(Ra)— (where, Ra represents a substituent other than H)), and a ureido group (not having —N(H)— moiety but being blocked in the form of —N(Ra)— (where, Ra represents a substituent other than H)).

In the invention, particularly preferable as the hydrogen bonding compound is the compound represented by formula (D) shown below.

Formula (D)

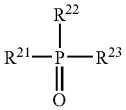

In formula (D), $R^{21}$ to $R^{23}$ each independently represent one selected from an alkyl group, an aryl group, an alkoxy group, an aryloxy group, an amino group, or a heterocyclic group, which may be substituted or unsubstituted.

In the case where $R^{21}$ to $R^{23}$ contain a substituent, examples of the substituent include a halogen atom, an alkyl group, an aryl group, an alkoxy group, an amino group, an acyl group, an acylamino group, an alkylthio group, an arylthio group, a sulfonamide group, an acyloxy group, an oxycarbonyl group, a carbamoyl group, a sulfamoyl group, a sulfonyl group, a phosphoryl group, and the like, in which preferred as the substituents are an alkyl group or an aryl group, e.g., a methyl group, an ethyl group, an isopropyl group, a t-butyl group, a t-octyl group, a phenyl group, a 4-alkoxyphenyl group, a 4-acyloxyphenyl group, and the like.

Specific examples of the alkyl group represented by $R^{21}$ to $R^{23}$ include a methyl group, an ethyl group, a butyl group, an octyl group, a dodecyl group, an isopropyl group, a t-butyl group, a t-amyl group, a t-octyl group, a cyclohexyl group, a 1-methylcyclohexyl group, a benzyl group, a phenetyl group, a 2-phenoxypropyl group, and the like.

As the aryl group, there are mentioned a phenyl group, a cresyl group, a xylyl group, a naphthyl group, a 4-t-butylphenyl group, a 4-t-octylphenyl group, a 4-anisidyl group, a 3,5-dichlorophenyl group, and the like.

As the alkoxy group, there are mentioned a methoxy group, an ethoxy group, a butoxy group, an octyloxy group, a 2-ethylhexyloxy group, a 3,5,5-trimethylhexyloxy group, a dodecyloxy group, a cyclohexyloxy group, a 4-methylcyclohexyloxy group, a benzyloxy group, and the like.

As the aryloxy group, there are mentioned a phenoxy group, a cresyloxy group, an isopropylphenoxy group, a 4-t-butylphenoxy group, a naphthoxy group, a biphenyloxy group, and the like.

As the amino group, there are mentioned a dimethylamino group, a diethylamino group, a dibutylamino group, a dioctylamino group, an N-methyl-N-hexylamino group, a dicyclohexylamino group, a diphenylamino group, an N-methyl-N-phenylamino group, and the like.

Preferred as $R^{21}$ to $R^{23}$ are an alkyl group, an aryl group, an alkoxy group, and an aryloxy group. Concerning the effect of the invention, it is preferred that at least one of $R^{21}$ to $R^{23}$ is an alkyl group or an aryl group, and more preferably, two or more of them are an alkyl group or an aryl group. From the viewpoint of low cost availability, it is preferred that $R^{21}$ to $R^{23}$ are of the same group.

Specific examples of the hydrogen bonding compound represented by formula (D) of the invention and others according to the invention are shown below, but the invention is not limited thereto.

D-1

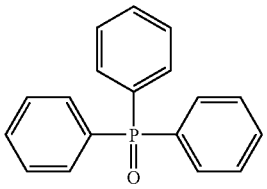

D-2

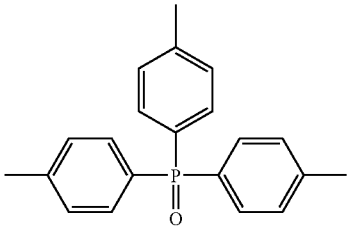

D-3

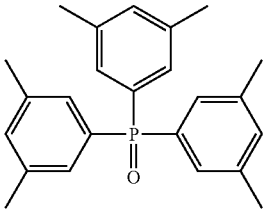

D-4

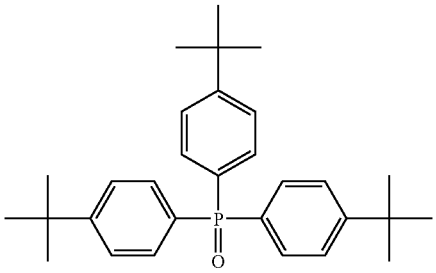

-continued

D-5

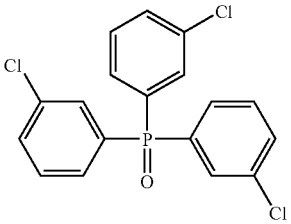

D-6

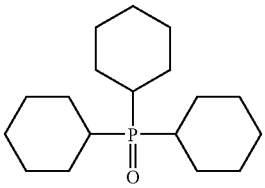

D-7

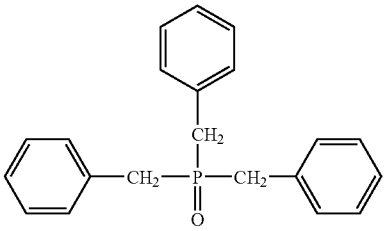

D-8

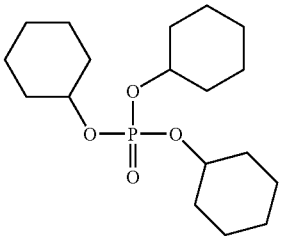

D-9

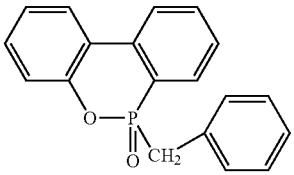

D-10

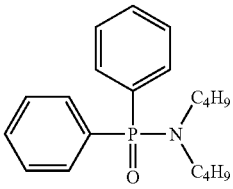

D-11

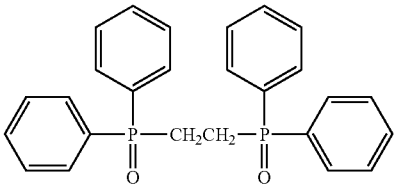

-continued

D-12

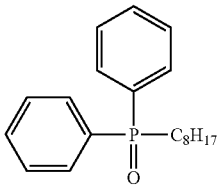

D-13

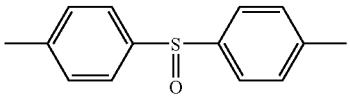

D-14

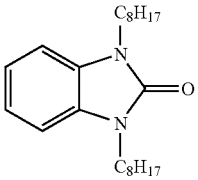

D-15

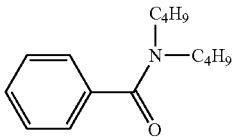

Specific examples of hydrogen bonding compounds other than those enumerated above can be found in those described in EP No. 1,096,310 and in JP-A Nos. 2002-156727 and 2002-318431.

The compound represented by formula (D) of the invention can be used in the photothermographic material by being incorporated into the coating solution in the form of a solution, an emulsified dispersion, or a solid fine particle dispersion, similar to the case of reducing agent. However, it is preferably used in the form of a solid dispersion. In the solution, the compound represented by formula (D) forms a hydrogen-bonded complex with a compound having a phenolic hydroxy group or an amino group, and can be isolated as a complex in crystalline state depending on the combination of the reducing agent and the compound represented by formula (D).

It is particularly preferred to use the crystal powder thus isolated in the form of a solid fine particle dispersion, because it provides stable performance. Further, it is also preferred to use a method of leading to form complex during dispersion by mixing the reducing agent and the compound represented by formula (D) in the form of powder and dispersing them with a proper dispersing agent using sand grinder mill or the like.

The compound represented by formula (D) is preferably used in a range from 1 mol % to 200 mol %, more preferably from 10 mol % to 150 mol %, and even more preferably, from 20 mol % to 100 mol %, with respect to the reducing agent.

(Photosensitive Silver Halide)

1) Halogen Composition

For the photosensitive silver halide used in the invention, there is no particular restriction on the halogen composition, and silver chloride, silver bromochloride, silver bromide, silver iodobromide, silver iodochlorobromide, or silver iodide can be used. Among them, silver bromide, silver iodobromide, and silver iodide are preferred. The distribution of the halogen composition in a grain may be uniform or the halogen composition may be changed stepwise, or it may be changed continuously. Further, a silver halide grain having a core/shell structure can be used preferably. Preferred structure is a twofold to fivefold structure and, more preferably, a core/shell grain having a twofold to fourfold structure can be used. Further, a technique of localizing silver bromide or silver iodide to the surface of a silver chloride, silver bromide or silver chlorobromide grains can also be used preferably.

2) Method of Grain Formation

The method of forming photosensitive silver halide is well-known in the relevant art and, for example, methods described in Research Disclosure No. 10729, June 1978 and U.S. Pat. No. 3,700,458 can be used. Specifically, a method of preparing a photosensitive silver halide by adding a silver-supplying compound and a halogen-supplying compound in a gelatin or other polymer solution and then mixing them with an organic silver salt is used. Further, a method described in JP-A No. 11-119374 (paragraph Nos. 0217 to 0224) and methods described in JP-A Nos. 11-352627 and 2000-347335 are also preferred.

3) Grain Size

The grain size of the photosensitive silver halide is preferably small with an aim of suppressing clouding after image formation and, specifically, it is 0.20 μm or less, more preferably in a range of from 0.01 μm to 0.15 μm and, even more preferably from 0.02 μm to 0.12 μm. The grain size as used herein means a diameter of a circle converted such that it has a same area as a projected area of the silver halide grain (projected area of a major plane in a case of a tabular grain).

4) Grain Shape

The shape of the silver halide grain includes, for example, cubic, octahedral, tabular, spherical, rod-like, or potato-like shape. The cubic grain is particularly preferred in the invention. A silver halide grain rounded at corners can also be used preferably. The surface indices (Miller indices) of the outer surface of a photosensitive silver halide grain is not particularly restricted, and it is preferable that the ratio occupied by the {100} face is large, because of showing high spectral sensitization efficiency when a spectral sensitizing dye is adsorbed. The ratio is preferably 50% or higher, more preferably 65% or higher and, even more preferably 80% or higher. The ratio of the {100} face, Miller indices, can be determined by a method described in T. Tani; J. Imaging Sci., vol. 29, page 165, (1985) utilizing adsorption dependency of the {111} face and {100} face in adsorption of a sensitizing dye.

5) Heavy Metal

The photosensitive silver halide grain of the invention can contain metals or complexes of metals belonging to groups 6 to 13 of the periodic table (showing groups 1 to 18). Preferred are metals or complexes of metals belonging to groups 6 to 10. The metal or the center metal of the metal complex from groups 6 to 10 of the periodic table is preferably ferrum, rhodium, ruthenium, or iridium. The metal complex may be used alone, or two or more complexes comprising identical or different species of metals may be used in combination. A preferred content is in a range of from $1\times10^{-9}$ mol to $1\times10^{-3}$ mol per 1 mol of silver.

The heavy metals, metal complexes and the adding method thereof are described in JP-A No. 7-225449, in paragraph Nos. 0018 to 0024 of JP-A No. 11-65021 and in paragraph Nos. 0227 to 0240 of JP-A No. 11-119374.

In the present invention, a silver halide grain having a hexacyano metal complex present on the outermost surface of the grain is preferred. The hexacyano metal complex includes, for example, $[Fe(CN)_6]^{4-}$, $[Fe(CN)_6]^{3-}$, $[Ru(CN)_6]^{4-}$, $[Os(CN)_6]^{4-}$, $[Co(CN)_6]^{3-}$, $[Rh(CN)_6]^{3-}$, [Ir $(CN)_6]^{3-}$, $[Cr(CN)_6]^{3-}$, and $[Re(CN)_6]^{3-}$. In the invention, hexacyano Fe complex is preferred.

Since the hexacyano complex exists in ionic form in an aqueous solution, paired cation is not important and alkali metal ion such as sodium ion, potassium ion, rubidium ion, cesium ion and lithium ion, ammonium ion, alkyl ammonium ion (for example, tetramethyl ammonium ion, tetraethyl ammonium ion, tetrapropyl ammonium ion, and tetra(n-butyl)ammonium ion), which are easily miscible with water and suitable to precipitation operation of a silver halide emulsion are preferably used.

The hexacyano metal complex can be added while being mixed with water, as well as a mixed solvent of water and an appropriate organic solvent miscible with water (for example, alcohols, ethers, glycols, ketones, esters, amides, or the like) or gelatin.

The addition amount of the hexacyano metal complex is preferably from $1\times10^{-5}$ mol to $1\times10^{-2}$ mol and, more preferably, from $1\times10^{-4}$ mol to $1\times10^{-3}$ mol, per 1 mol of silver in each case.

In order to allow the hexacyano metal complex to be present on the outermost surface of a silver halide grain, the hexacyano metal complex is directly added in any stage of: after completion of addition of an aqueous solution of silver nitrate used for grain formation, before completion of an emulsion formation step prior to a chemical sensitization step, of conducting chalcogen sensitization such as sulfur sensitization, selenium sensitization and tellurium sensitization or noble metal sensitization such as gold sensitization, during a washing step, during a dispersion step and before a chemical sensitization step. In order not to grow fine silver halide grains, the hexacyano metal complex is rapidly added preferably after the grain is formed, and it is preferably added before completion of the emulsion formation step.

Addition of the hexacyano complex may be started after addition of 96% by weight of an entire amount of silver nitrate to be added for grain formation, more preferably started after addition of 98% by weight and, particularly preferably, started after addition of 99% by weight.

When any of the hexacyano metal complex is added after addition of an aqueous silver nitrate just prior to completion of grain formation, it can be adsorbed to the outermost surface of the silver halide grain and most of them form an insoluble salt with silver ions on the surface of the grain. Since the hexacyano iron(II) silver salt is a less soluble salt than AgI, re-dissolution with fine grains can be prevented and fine silver halide grains with smaller grain size can be prepared.

Metal atoms that can be contained in the silver halide grain used in the invention (for example, $[Fe(CN)_6]^{4-}$), desalting method of a silver halide emulsion and chemical sensitizing method are described in paragraph Nos. 0046 to 0050 of JP-A No. 11-84574, in paragraph Nos. 0025 to 0031 of JP-A No. 11-65021, and paragraph Nos. 0242 to 0250 of JP-A No. 11-119374.

6) Gelatin

As the gelatin contained the photosensitive silver halide emulsion used in the invention, various types of gelatins can be used. It is necessary to maintain an excellent dispersion state of a photosensitive silver halide emulsion in the coating solution containing an organic silver salt, and gelatin having a molecular weight of 10,000 to 1,000,000 is preferably used. Phthalated gelatin is also preferably used. These gelatins may be used at grain formation step or at the time of dispersion after desalting treatment and it is preferably used at grain formation step.

7) Sensitizing Dye

As the sensitizing dye applicable in the invention, those which spectrally sensitizes the silver halide grains in a desired wavelength region upon adsorption to the silver halide grains having spectral sensitivity suitable to the spectral characteristic of an exposure light source can be advantageously selected. The sensitizing dyes and the adding method are disclosed, for example, in JP-A No. 11-65021 (paragraph Nos. 0103 to 0109), as a compound represented by the formula (II) in JP-A No. 10-186572, dyes represented by the formula (I) in JP-A No. 11-119374 (paragraph No. 0106), dyes described in U.S. Pat. Nos. 5,510,236 and 3,871,887 (Example 5), dyes disclosed in JP-A Nos. 2-96131 and 59-48753, as well as in page 19, line 38 to page 20, line 35 of EP No. 803,764A1, and in JP-A Nos. 2001-272747, 2001-290238 and 2002-23306, and the like. The sensitizing dye may be used alone or two or more of them may be used in combination. In the invention, sensitizing dye can be added preferably after a desalting step and before coating, and more preferably after a desalting step and before completion of chemical ripening.

In the invention, the sensitizing dye may be added at any amount according to the property of sensitivity and fogging, but it is preferably added in an amount of from $10^{-6}$ mol to 1 mol, and more preferably from $10^{-4}$ mol to $10^{-1}$ mol, per 1 mol of silver halide in the image forming layer.

The photothermographic material of the invention can contain super sensitizers in order to improve the spectral sensitizing effect. The super sensitizers usable in the invention can include those compounds described in EP-A No. 587338, U.S. Pat. Nos. 3,877,943 and 4,873,184, JP-A Nos. 5-341432, 11-109547, and 10-111543, and the like.

8) Chemical Sensitization

The photosensitive silver halide grain according to the invention is preferably chemically sensitized by sulfur sensitizing method, selenium sensitizing method or tellurium sensitizing method. As the compound used preferably for sulfur sensitizing method, selenium sensitizing method and tellurium sensitizing method, known compounds, for example, compounds described in JP-A No. 7-128768 can be used. Particularly, tellurium sensitization is preferred in the invention and compounds described in the literature cited in paragraph No. 0030 in JP-A No. 11-65021 and compounds shown by formula (II), (III), or (IV) in JP-A No. 5-313284 are preferred.

The photosensitive silver halide grain in the invention is preferably chemically sensitized by gold sensitizing method alone or in combination with the chalcogen sensitization described above. As the gold sensitizer, those having an oxidation number of gold of either +1 or +3 are preferred and those gold compounds used usually as the gold sensitizer are preferred. As typical examples, chloroauric acid, bromoauric acid, potassium chloroaurate, potassium bromoaurate, auric trichloride, potassium auric thiocyanate, potassium iodoaurate, tetracyanoauric acid, ammonium aurothiocyanate and pyridyl trichloro gold are preferred. Further, gold sensitizers described in U.S. Pat. No. 5,858,637 and JP-A No. 2002-278016 are also used preferably.

In the invention, chemical sensitization can be applied at any time so long as it is after grain formation and before coating and it can be applied, after desalting, (1) before spectral sensitization, (2) simultaneously with spectral sensitization, (3) after spectral sensitization, (4) just prior to coating, or the like.

The amount of sulfur, selenium, or tellurium sensitizer used in the invention may vary depending on the silver halide grain used, the chemical ripening condition, and the like, and it is used in an amount of from $10^{-8}$ mol to $10^{-2}$ mol, and preferably from $10^{-7}$ mol to $10^{-3}$ mol, per 1 mol of silver halide.

The addition amount of the gold sensitizer may vary depending on various conditions and it is generally from $10^{-7}$ mol to $10^{-3}$ mol and, preferably from $10^{-6}$ mol to $5\times10^{-4}$ mol, per 1 mol of silver halide.

There is no particular restriction on the condition for the chemical sensitization in the invention and, appropriately, the pH is from 5 to 8, the pAg is from 6 to 11, and the temperature is from 40° C. to 95° C.

In the silver halide emulsion used in the invention, a thiosulfonic acid compound may be added by the method shown in EP-A No. 293,917.

A reductive compound is preferably used for the photosensitive silver halide grain in the invention. As the specific compound for the reduction sensitization, ascorbic acid or thiourea dioxide is preferred, as well as use of stannous chloride, aminoimino methane sulfonic acid, hydrazine derivatives, borane compounds, silane compounds and polyamine compounds are preferred. The reduction sensitizer may be added at any stage in the photosensitive emulsion producing process from crystal growth to the preparation step just prior to coating. Further, it is preferred to apply reduction sensitization by ripening while keeping the pH to 7 or higher or the pAg to 8.3 or lower for the emulsion, and it is also preferred to apply reduction sensitization by introducing a single addition portion of silver ions during grain formation.

9) Compound that is One-electron-oxidized to Provide a One-electron Oxidation Product which Releases One or More Electrons The photothermographic material of the present invention preferably contains a compound that is one-electron-oxidized to provide a one-electron oxidation product which releases one or more electrons. The said compound can be used alone or in combination with various chemical sensitizers described above to increase the sensitivity of silver halide.

As the compound that is one-electron-oxidized to provide a one-electron oxidation product which releases one or more electrons, which is contained in the photothermographic material of the invention, is preferably a compound selected from the following Groups 1 or 2.

(Group 1) a compound that is one-electron-oxidized to provide a one-electron oxidation product which further releases one or more electrons, due to being subjected to a subsequent bond cleavage reaction;

(Group 2) a compound that is one-electron-oxidized to provide a one-electron oxidation product, which further releases one or more electrons after being subjected to a subsequent bond formation reaction.

The compound of Group 1 will be explained below.

In the compound of Group 1, as a compound that is one-electron-oxidized to provide a one-electron oxidation product which further releases one electron, due to being subjected to a subsequent bond cleavage reaction, specific examples include examples of compound referred to as "one photon two electrons sensitizer" or "deprotonating electron-donating sensitizer" described in JP-A No. 9-211769 (Compound PMT-1 to S-37 in Tables E and F, pages 28 to 32); JP-A No. 9-211774; JP-A No. 11-95355 (Compound INV 1 to 36); JP-W No. 2001-500996 (Compound 1 to 74, 80 to 87, and 92 to 122); U.S. Pat. Nos. 5,747,235 and 5,747,236; EP No. 786,692A1 (Compound INV 1 to 35); EP No. 893,732A1; U.S. Pat. Nos. 6,054,260 and 5,994,051; etc. Preferred ranges of these compounds are the same as the preferred ranges described in the quoted specifications.

In the compound of Group 1, as a compound that is one-electron-oxidized to provide a one-electron oxidation product which further releases one or more electrons, due to being subjected to a subsequent bond cleavage reaction, specific examples include the compounds represented by formula (1) (same as formula (1) described in JP-A No. 2003-114487), formula (2) (same as formula (2) described in JP-A No. 2003-114487), formula (3) (same as formula (1) described in JP-A No. 2003-114488), formula (4) (same as formula (2) described in JP-A No. 2003-114488), formula (5) (same as formula (3) described in JP-A No. 2003-114488), formula (6) (same as formula (1) described in JP-A No. 2003-75950), formula (7) (same as formula (2) described in JP-A No. 2003-75950), and formula (8) (same as formula (1) described in JP-A No. 2004-239943), and the compound represented by formula (9) (same as formula (3) described in JP-A No. 2004-245929) among the compounds which can undergo the chemical reaction represented by chemical reaction formula (1) (same as chemical reaction formula (1) described in JP-A No. 2004-245929). Preferable ranges of these compounds are the same as the preferable ranges described in the quoted specifications.

Formula (1)

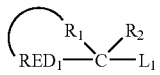

Formula (2)

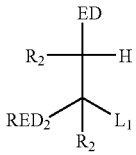

Formula (3)

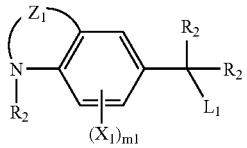

Formula (4)

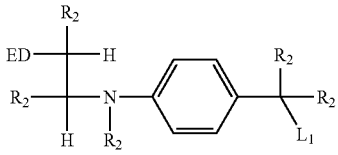

Formula (5)

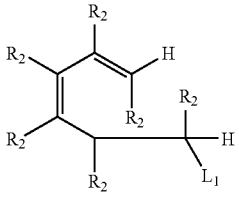

Formula (6)

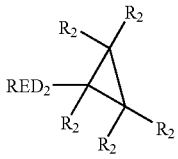

Formula (7)

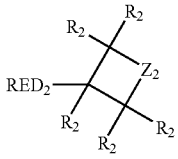

-continued

Formula (8)

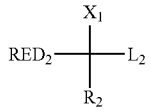

Reaction formula (1)

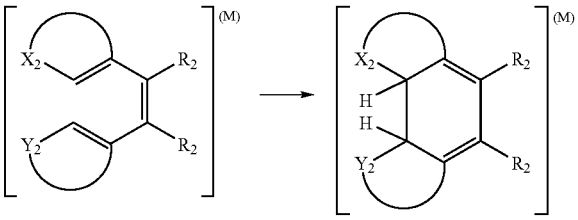

Formula (9)

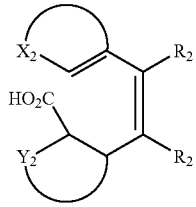

In the formulae, $RED_1$ and $RED_2$ represent a reducing group. $R_1$ represents a nonmetallic atomic group which forms a cyclic structure equivalent to a tetrahydro derivative or an octahydro derivative of a 5- or 6-membered aromatic ring (including a hetero aromatic ring) with a carbon atom (C) and $RED_1$. $R_2$ represents a hydrogen atom or a substituent. In the case where plural $R_2$s exist in a same molecule, these may be identical or different from each other. $L_1$ represents a leaving group. ED represents an electron-donating group. $Z_1$ represents an atomic group which forms a 6-membered ring with a nitrogen atom and two carbon atoms of a benzene ring. $X_1$ represents a substituent, and ml represents an integer of from 0 to 3. $Z_2$ represents one selected from $—CR_{11}R_{12}—$, $—NR_{13}—$, or —O—. $R_{11}$ and $R_{12}$ each independently represent a hydrogen atom or a substituent. $R_{13}$ represents one selected from a hydrogen atom, an alkyl group, an aryl group, or a heterocyclic group. $X_1$ represents one selected from an alkoxy group, an aryloxy group, a heterocyclic oxy group, an alkylthio group, an arylthio group, a heterocyclic thio group, an alkylamino group, an arylamino group, or a heterocyclic amino group. $L_2$ represents a carboxy group or a salt thereof, or a hydrogen atom. $X_2$ represents a group which forms a 5-membered heterocycle with C═C. $Y_2$ represents a group which forms a 5-membered aryl group or heterocyclic group with C═C. M represents one selected from a radical, a radical cation, or a cation.

Next, the compound of Group 2 is explained.

In the compound of Group 2, as a compound that is one-electron-oxidized to provide a one-electron oxidation product which further releases one or more electrons, after being subjected to a subsequent bond cleavage reaction, specific examples include the compound represented by formula (10) (same as formula (1) described in JP-A No. 2003-140287), and the compound represented by formula (11) (same as formula (2) described in JP-A No. 2004-245929) which can undergo the chemical reaction represented by reaction formula (1) (same as chemical reaction formula (1) described in JP-A No. 2004-245929). Preferable ranges of these compounds are the same as the preferable ranges described in the quoted specifications.

$RED_6$-Q-Y

Formula (10)

Reaction formula (1)

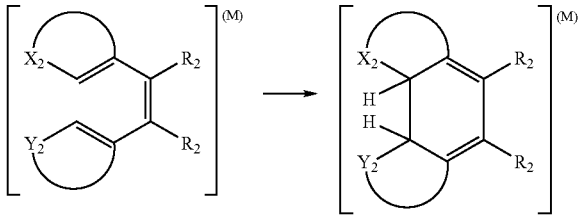

Formula (11)

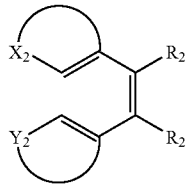

In the formulae described above, X represents a reducing group which is one-electron-oxidized. Y represents a reactive group containing a carbon-carbon double bond part, a carbon-carbon triple bond part, an aromatic group part or benzo-condensed non-aromatic heterocyclic group which reacts with one-electron-oxidized product formed by one-electron-oxidation of X to form a new bond. $L_2$ represents a linking group to link X and Y. $R_2$ represents a hydrogen atom or a substituent.

In the case where plural $R_2$s exist in a same molecule, these may be identical or different from one another.

$X_2$ represents a group which forms a 5-membered heterocycle with C═C. $Y_2$ represents a group which forms a 5- or 6-membered aryl group or heterocyclic group with C═C. M represents one selected from a radical, a radical cation, or a cation.

The compounds of Groups 1 or 2 preferably are "the compound having an adsorptive group to silver halide in a molecule" or "the compound having a partial structure of a spectral sensitizing dye in a molecule". The representative adsorptive group to silver halide is the group described in JP-A No. 2003-156823, page 16 right, line 1 to page 17 right, line 12. A partial structure of a spectral sensitizing dye is the structure described in JP-A No. 2003-156823, page 17 right, line 34 to page 18 right, line 6.

As the compound of Groups 1 or 2, "the compound having at least one adsorptive group to silver halide in a molecule" is more preferred, and "the compound having two or more adsorptive groups to silver halide in a molecule" is further preferred. In the case where two or more adsorptive groups exist in a single molecule, those adsorptive groups may be identical or different from one another.

As preferable adsorptive group, a mercapto-substituted nitrogen-containing heterocyclic group (e.g., a 2-mercaptothiazole group, a 3-mercapto-1,2,4-triazole group, a 5-mercaptotetrazole group, a 2-mercapto-1,3,4-oxadiazole group, a 2-mercaptobenzoxazole group, a 2-mercaptobenzothiazole group, a 1,5-dimethyl-1,2,4-triazolium-3-thiolate group, or the like) or a nitrogen-containing heterocyclic group having an —NH— group which forms silver iminate (—N(Ag)—), as a partial structure of heterocycle (e.g., a benzotriazole group, a benzimidazole group, an indazole group, or the like)

are described. A 5-mercaptotetrazole group, a 3-mercapto-1,2,4-triazole group and a benzotriazole group are particularly preferable, and a 3-mercapto-1,2,4-triazole group and a 5-mercaptotetrazole group are most preferable.

As the adsorptive group, the group which has two or more mercapto groups as a partial structure in a molecule is also particularly preferable. Herein, the mercapto group (—SH) may become a thione group in the case where it can tautomerize. Preferred examples of an adsorptive group having two or more mercapto groups as a partial structure (dimercapto-substituted nitrogen-containing heterocyclic group and the like) are a 2,4-dimercaptopyrimidine group, a 2,4-dimercaptotriazine group and a 3,5-dimercapto-1,2,4-triazole group.

Further, a quaternary salt structure of nitrogen or phosphorus is also preferably used as the adsorptive group. As typical quaternary salt structure of nitrogen, an ammonio group (a trialkylammonio group, a dialkylarylammonio group, a dialkylheteroarylammonio group, an alkyldiarylammonio group, an alkyldiheteroarylammonio group, or the like) and a nitrogen-containing heterocyclic group containing quaternary nitrogen atom are described.

As typical quaternary salt structure of phosphorus, a phosphonio group (a trialkylphosphonio group, a dialkylarylphosphonio group, a dialkylheteroarylphosphonio group, an alkyldiarylphosphonio group, an alkyldiheteroarylphosphonio group, a triarylphosphonio group, a triheteroarylphosphonio group, or the like) is described. A quaternary salt structure of nitrogen is more preferably used and a 5- or 6-membered aromatic heterocyclic group containing a quaternary nitrogen atom is further preferably used. Particularly preferably, a pyrydinio group, a quinolinio group and an isoquinolinio group are used.

These nitrogen-containing heterocyclic groups containing a quaternary nitrogen atom may have any substituent.

Examples of counter anions of quaternary salt include a halogen ion, carboxylate ion, sulfonate ion, sulfate ion, perchlorate ion, carbonate ion, nitrate ion, $BF_4^-$, $PF_6^-$, $Ph_4B^-$, and the like. In the case where the group having negative charge at carboxylate group and the like exists in a molecule, an inner salt may be formed with it. As a counter ion outside of a molecule, chloro ion, bromo ion, and methanesulfonate ion are particularly preferable.

The preferred structure of the compound represented by Groups 1 or 2 having a quaternary salt of nitrogen or phosphorus as the adsorptive group is represented by formula (X).

$$(P\text{-}Q_1)_i\text{—}R(\text{-}Q_2\text{-}S)_j \qquad \text{Formula (X)}$$

In formula (X), P and R each independently represent a quaternary salt structure of nitrogen or phosphorus, which is not a partial structure of a spectral sensitizing dye. $Q_1$ and $Q_2$ each independently represent a linking group and typically represent a single bond, an alkylene group, an arylene group, a heterocyclic group, —O—, —S—, —$NR_N$—, —C(═O)—, —$SO_2$—, —SO—, —P(═O)— or combinations of these groups. Herein, $R_N$ represents one selected from a hydrogen atom, an alkyl group, an aryl group, or a heterocyclic group. S represents a residue which is obtained by removing one atom from the compound represented by Group 1 or 2. i and j are an integer of one or more and are selected in a range of i+j=2 to 6. The case where i is 1 to 3 and j is 1 to 2 is preferable, the case where i is 1 or 2 and j is 1 is more preferable, and the case where i is 1 and j is 1 is particularly preferable. The compound represented by formula (X) preferably has 10 to 100 carbon atoms in total, more preferably 10 to 70 carbon atoms, further preferably 11 to 60 carbon atoms, and particularly preferably 12 to 50 carbon atoms in total.

The compounds of Groups 1 or 2 may be used at any time during preparation of the photosensitive silver halide emulsion and production of the photothermographic material. For example, the compound may be used in a photosensitive silver halide grain formation step, in a desalting step, in a chemical sensitization step, before coating, or the like. The compound may be added in several times during these steps. The compound is preferably added after the photosensitive silver halide grain formation step and before the desalting step; at the chemical sensitization step (just before the chemical sensitization to immediately after the chemical sensitization); or before coating. The compound is more preferably added from at the chemical sensitization step to before being mixed with the non-photosensitive organic silver salt.

It is preferred that the compound of Groups 1 or 2 according to the invention is dissolved in water, a water-soluble solvent such as methanol or ethanol, or a mixed solvent thereof. In the case where the compound is dissolved in water and solubility of the compound is increased by increasing or decreasing a pH value of the solvent, the pH value may be increased or decreased to dissolve and add the compound.

The compound of Groups 1 or 2 according to the invention is preferably used in the image forming layer which contains the photosensitive silver halide and the non-photosensitive organic silver salt. The compound may be added to a surface protective layer, or an intermediate layer, as well as the image forming layer containing the photosensitive silver halide and the non-photosensitive organic silver salt, to be diffused to the image forming layer at the coating step.

The compound may be added before or after addition of a sensitizing dye. Each compound is contained in the image forming layer preferably in an amount of from $1\times10^{-9}$ mol to $5\times10^{-1}$ mol, more preferably from $1\times10^{-8}$ mol to $5\times10^{-2}$ mol, per 1 mol of silver halide.

10) Compound Having Adsorptive Group and Reducing Group

The photothermographic material of the present invention preferably contains a compound having an adsorptive group to silver halide and a reducing group in a molecule. It is preferred that the compound is represented by the following formula (Rd).

$$A\text{-}(W)n\text{—}B \qquad \text{Formula (Rd)}$$

In formula (Rd), A represents a group which adsorbs to a silver halide (hereafter, it is called an adsorptive group); W represents a divalent linking group; n represents 0 or 1; and B represents a reducing group.

In formula (Rd), the adsorptive group represented by A is a group to adsorb directly to a silver halide or a group to promote adsorption to a silver halide. As typical examples, a mercapto group (or a salt thereof), a thione group (—C(═S)—), a nitrogen atom, a heterocyclic group containing at least one atom selected from a nitrogen atom, a sulfur atom, a selenium atom, or a tellurium atom, a sulfide group, a disulfide group, a cationic group, an ethynyl group, and the like are described.

The mercapto group (or the salt thereof) as the adsorptive group means a mercapto group (or a salt thereof) itself and simultaneously more preferably represents a heterocyclic group or an aryl group or an alkyl group substituted by at least one mercapto group (or a salt thereof). Herein, as the heterocyclic group, a monocyclic or a condensed aromatic or non-aromatic heterocyclic group having at least a 5- to 7-membered ring, for example, an imidazole ring group, a thiazole ring group, an oxazole ring group, a benzimidazole ring group, a benzothiazole ring group, a benzoxazole ring group, a triazole ring group, a thiadiazole ring group, an oxadiazole ring group, a tetrazole ring group, a purine ring group, a pyridine ring group, a quinoline ring group, an isoquinoline ring group, a pyrimidine ring group, a triazine ring group, and the like are described. A heterocyclic group having a quaternary nitrogen atom may also be adopted, wherein a mercapto group as a substituent may dissociate to form a mesoion. When the mercapto group forms a salt, a counter ion of the salt may be a cation of an alkaline metal, an alkaline earth metal, a heavy metal, or the like, such as $Li^+$, $Na^+$, $K^+$, $Mg^{2+}$, $Ag^+$ and $Zn^{2+}$; an ammonium ion; a heterocyclic group containing a quaternary nitrogen atom; a phosphonium ion; or the like.

Further, the mercapto group as the adsorptive group may become a thione group by a tautomerization.

The thione group used as the adsorptive group also includes a linear or cyclic thioamide group, thioureido group, thiourethane group, and dithiocarbamate ester group.

The heterocyclic group, as the adsorptive group, which contains at least one atom selected from a nitrogen atom, a sulfur atom, a selenium atom, or a tellurium atom represents a nitrogen-containing heterocyclic group having —NH— group, which forms silver iminate (—N(Ag)—), as a partial structure of a heterocycle, or a heterocyclic group having an —S— group, a —Se— group, a —Te— group, or a =N— group, which coordinates to a silver ion by a coordination bond, as a partial structure of a heterocycle. As the former examples, a benzotriazole group, a triazole group, an indazole group, a pyrazole group, a tetrazole group, a benzimidazole group, an imidazole group, a purine group, and the like are described. As the latter examples, a thiophene group, a thiazole group, an oxazole group, a benzothiophene group, a benzothiazole group, a benzoxazole group, a thiadiazole group, an oxadiazole group, a triazine group, a selenoazole group, a benzoselenoazole group, a tellurazole group, a benzotellurazole group, and the like are described.

The sulfide group or disulfide group as the adsorptive group contains all groups having "—S—" or "—S—S—" as a partial structure.

The cationic group as the adsorptive group means the group containing a quaternary nitrogen atom, such as an ammonio group or a nitrogen-containing heterocyclic group including a quaternary nitrogen atom. As examples of the heterocyclic group containing a quaternary nitrogen atom, a pyridinio group, a quinolinio group, an isoquinolinio group, an imidazolio group, and the like are described.

The ethynyl group as the adsorptive group means —C≡CH group and the said hydrogen atom may be substituted.

The adsorptive group described above may have any substituent.

Further, as typical examples of the adsorptive group, the compounds described in pages 4 to 7 in the specification of JP-A No. 11-95355 are described.

As the adsorptive group represented by A in formula (Rd), a heterocyclic group substituted by a mercapto group (for example, a 2-mercaptothiadiazole group, a 2-mercapto-5-aminothiadiazole group, a 3-mercapto-1,2,4-triazole group, a 5-mercaptotetrazole group, a 2-mercapto-1,3,4-oxadiazole group, a 2-mercaptobenzimidazole group, a 1,5-dimethyl-1,2,4-triazorium-3-thiolate group, a 2,4-dimercaptopyrimidine group, a 2,4-dimercaptotriazine group, a 3,5-dimercapto-1,2,4-triazole group, a 2,5-dimercapto-1,3-thiazole group, or the like) and a nitrogen atom containing heterocyclic group having an —NH— group which forms silver iminate (—N(Ag)—) as a partial structure of heterocycle (for example, a benzotriazole group, a benzimidazole group, an indazole group, or the like) are preferable, and more preferable as the adsorptive group are a 2-mercaptobenzimidazole group and a 3,5-dimercapto-1,2,4-triazole group.

In formula (Rd), W represents a divalent linking group. The said linking group may be any divalent linking group, as far as it does not give a bad effect toward photographic properties. For example, a divalent linking group which includes a carbon atom, a hydrogen atom, an oxygen atom, a nitrogen atom, or a sulfur atom, can be used. As typical examples, an alkylene group having 1 to 20 carbon atoms (for example, a methylene group, an ethylene group, a trimethylene group, a tetramethylene group, a hexamethylene group, or the like), an alkenylene group having 2 to 20 carbon atoms, an alkynylene group having 2 to 20 carbon atoms, an arylene group having 6 to 20 carbon atoms (for example, a phenylene group, a naphthylene group, or the like), —CO—, —$SO_2$—, —O—, —S—, —$NR_1$—, and the combinations of these linking groups are described. Herein, $R_1$ represents a hydrogen atom, an alkyl group, a heterocyclic group, or an aryl group.

The linking group represented by W may have any substituent.

In formula (Rd), the reducing group represented by B represents a group which reduces a silver ion. As examples thereof, a formyl group, an amino group, a triple bond group such as an acetylene group, a propargyl group and the like, a mercapto group, and residues which are obtained by removing one hydrogen atom from hydroxyamines, hydroxamic acids, hydroxyureas, hydroxyurethanes, hydroxysemicarbazides, reductones (reductone derivatives are contained), anilines, phenols (chroman-6-ols, 2,3-dihydrobenzofuran-5-ols, aminophenols, sulfonamidophenols, and polyphenols such as hydroquinones, catechols, resorcinols, benzenetriols, bisphenols are included), acylhydrazines, carbamoylhydrazines, 3-pyrazolidones, and the like are described. They may have any substituent.

The oxidation potential of the reducing group represented by B in formula (Rd) can be measured by using the measuring method described in Akira Fujishima, "DENKIKAGAKU SOKUTEIHO", pages 150 to 208, GIHODO SHUPPAN and The Chemical Society of Japan, "JIKKEN KAGAKUKOZA", 4th ed., vol. 9, pages 282 to 344, MARUZEN. For example, the method of rotating disc voltammetry can be used; namely the sample is dissolved in the solution (methanol:pH 6.5 Britton-Robinson buffer=10%:90% (% by volume)) and after bubbling with nitrogen gas during 10 minutes the voltamograph can be measured under the conditions of 1000 rotations/minute, the sweep rate 20 mV/second, at 25° C. by using a rotating disc electrode (RDE) made by glassy carbon as a working electrode, a platinum electrode as a counter electrode and a saturated calomel electrode as a reference electrode. The half wave potential (E½) can be calculated by that obtained voltamograph.

When the reducing group represented by B in the present invention is measured by the method described above, an oxidation potential is preferably in a range of from about −0.3 V to about 1.0 V, more preferably from about −0.1 V to about 0.8 V, and particularly preferably from about 0 V to about 0.7 V.

In formula (Rd), the reducing group represented by B is preferably a residue which is obtained by removing one hydrogen atom from hydroxyamines, hydroxamic acids, hydroxyureas, hydroxysemicarbazides, reductones, phenols, acylhydrazines, carbamoylhydrazines, or 3-pyrazolidones.

The compound of formula (Rd) according to the present invention may have a ballast group or polymer chain, which are generally used in the non-moving photographic additives of a coupler or the like, in it. And as a polymer, for example, the polymer described in JP-A No. 1-100530 is selected.

The compound of formula (Rd) according to the present invention may be bis or tris type of compound. The molecular weight of the compound represented by formula (Rd) according to the present invention is preferably from 100 to 10000, more preferably from 120 to 1000, and particularly preferably from 150 to 500.
The examples of the compound represented by formula (Rd) according to the present invention are shown below, but the present invention is not limited in these.
(1)
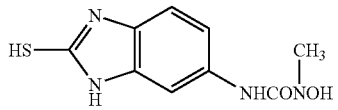
(2)
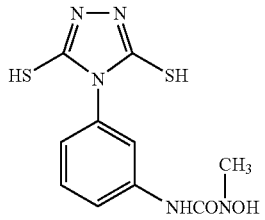
(3)
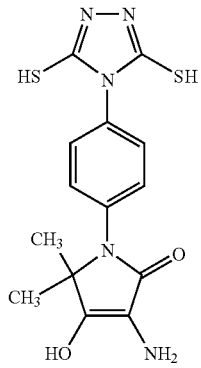
(4)
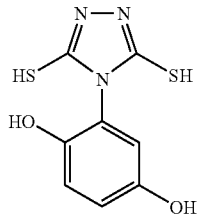
(5)
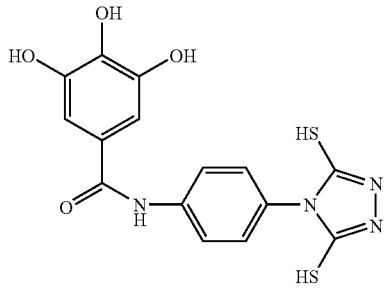
-continued
(6)
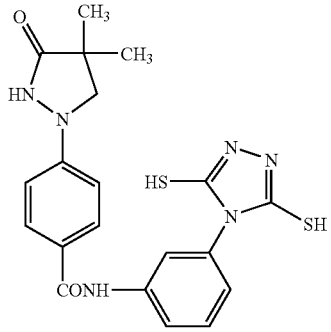
(7)
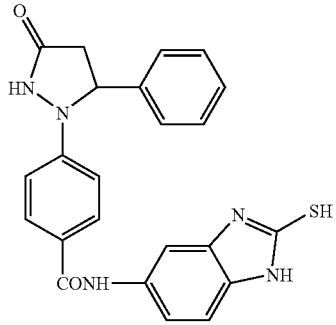
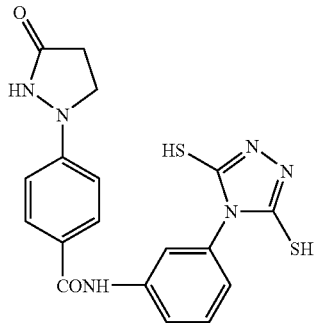
(9)
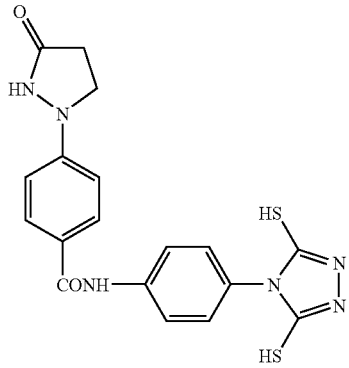

-continued (10)

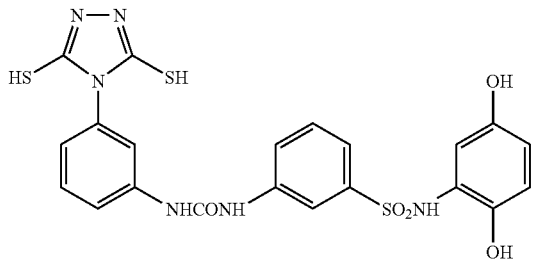

(11)

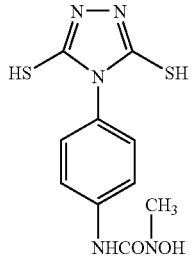

(12)

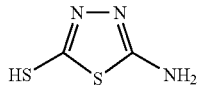

(13)

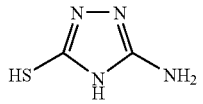

Further, example compounds 1 to 30 and 1"-1 to 1"-77 shown in EP No. 1,308,776A2, pages 73 to 87 are also described as preferable examples of the compound having an adsorptive group and a reducing group according to the invention.

These compounds can be easily synthesized by any known method. The compound of formula (Rd) according to the present invention can be used alone, but it is preferred to use two or more of the compounds in combination. When two or more of the compounds are used in combination, those may be added to the same layer or the different layers, whereby adding methods may be different from each other.

The compound represented by formula (Rd) according to the present invention is preferably added to an image forming layer and more preferably, is to be added at an emulsion preparing process. In the case, where these compounds are added at an emulsion preparing process, these compounds may be added at any step in the process. For example, the compounds may be added during the silver halide grain formation step, the step before starting of desalting step, the desalting step, the step before starting of chemical ripening, the chemical ripening step, the step before preparing a final emulsion, or the like. The compound can be added in several times during these steps. It is preferred to be added in the image forming layer. But the compound may be added to a surface protective layer or an intermediate layer, in combination with its addition to the image forming layer, to be diffused to the image forming layer at the coating step.

The preferred addition amount is largely dependent on the adding method described above or the type of the compound, but generally from $1\times10^{-6}$ mol to 1 mol, preferably from $1\times10^{-5}$ mol to $5\times10^{-1}$ mol, and more preferably from $1\times10^{-4}$ mol to $1\times10^{-1}$ mol, per 1 mol of photosensitive silver halide in each case.

The compound represented by formula (Rd) according to the present invention can be added by dissolving in water or water-soluble solvent such as methanol, ethanol and the like or a mixed solution thereof. At this time, the pH may be arranged suitably by an acid or an alkaline and a surfactant can coexist. Further, these compounds can be added as an emulsified dispersion by dissolving them in an organic solvent having a high boiling point and also can be added as a solid dispersion.

11) Combined Use of Silver Halides

The photosensitive silver halide emulsion in the photothermographic material used in the invention may be used alone, or two or more of them (for example, those having different average particle sizes, different halogen compositions, different crystal habits, or different conditions for chemical sensitization) may be used together. Gradation can be controlled by using plural photosensitive silver halides of different sensitivity. The relevant techniques can include those described, for example, in JP-A Nos. 57-119341, 53-106125, 47-3929, 48-55730, 46-5187, 50-73627, and 57-150841. It is preferred to provide a sensitivity difference of 0.2 or more in terms of log E between each of the emulsions.

12) Coating Amount

The addition amount of the photosensitive silver halide, when expressed by the amount of coated silver per 1 $m^2$ of the photothermographic material, is preferably from 0.03 $g/m^2$ to 0.6 $g/m^2$, more preferably from 0.05 $g/m^2$ to 0.4 $g/m^2$ and, most preferably from 0.07 $g/m^2$ to 0.3 $g/m^2$. The photosensitive silver halide is used in a range of from 0.01 mol to 0.5 mol, preferably from 0.02 mol to 0.3 mol, and even more preferably from 0.03 mol to 0.2 mol, per 1 mol of the organic silver salt.

13) Mixing Silver Halide and Organic Silver Salt

The method of mixing separately prepared the photosensitive silver halide and the organic silver salt include a method of mixing prepared photosensitive silver halide grains and organic silver salt by a high speed stirrer, ball mill, sand mill, colloid mill, vibration mill, or homogenizer, and a method of mixing a photosensitive silver halide completed for preparation at any timing in the preparation of an organic silver salt and preparing the organic silver salt. The effect of the invention can be obtained preferably by any of the methods described above. Further, a method of mixing two or more aqueous dispersions of organic silver salts and two or more aqueous dispersions of photosensitive silver salts upon mixing is used preferably for controlling photographic properties.

14) Mixing Silver Halide Into Coating Solution

In the invention, the time of adding silver halide to the coating solution for the image forming layer is preferably in a range of from 180 minutes before to just prior to the coating, more preferably, 60 minutes before to 10 seconds before coating. But there is no restriction for mixing method and mixing condition as long as the effect of the invention is sufficient. As an embodiment of a mixing method, there is a method of mixing in a tank and controlling an average residence time. The average residence time herein is calculated from addition flux and the amount of solution transferred to the coater. And another embodiment of mixing method is a method using a static mixer, which is described in 8th edition of "Ekitai Kongo Gijutu" by N. Harnby and M. F. Edwards, translated by Koji Takahashi (Nikkan Kogyo Shinbunsha, 1989).

(Binder)

Any polymer may be used as the binder for the image forming layer of the invention. Suitable as the binder are those that are transparent or translucent, and that are generally colorless, such as natural resin or polymer and their copolymers; synthetic resin or polymer and their copolymer; or media forming a film; for example, included are gelatins, rubbers, poly(vinyl alcohols), hydroxyethyl celluloses, cellulose acetates, cellulose acetate butyrates, poly(vinyl pyrrolidones), casein, starch, poly(acrylic acids), poly(methyl methacrylates), poly(vinyl chlorides), poly(methacrylic acids), styrene-maleic anhydride copolymers, styrene-acrylonitrile copolymers, styrene-butadiene copolymers, poly(vinyl acetals) (e.g., poly(vinyl formal) or poly(vinyl butyral)), polyesters, polyurethanes, phenoxy resin, poly(vinylidene chlorides), polyepoxides, polycarbonates, poly(vinyl acetates), polyolefins, cellulose esters, and polyamides. A binder may be used with water, an organic solvent, or emulsion to form a coating solution.

In the present invention, the glass transition temperature (Tg) of the binder which is used in the image forming layer is preferably in a range of from 0° C. to 80° C., more preferably from 10° C. to 70° C. and, even more preferably from 15° C. to 60° C.

In the specification, Tg is calculated according to the following equation:

$$1/Tg=\Sigma(Xi/Tgi)$$

where the polymer is obtained by copolymerization of n monomer compounds (from i=1 to i=n); Xi represents the mass fraction of the ith monomer ($\Sigma Xi=1$), and Tgi is the glass transition temperature (absolute temperature) of the homopolymer obtained with the ith monomer. The symbol $\Sigma$ stands for the summation from i=1 to i=n. Values for the glass transition temperature (Tgi) of the homopolymers derived from each of the monomers were obtained from J. Brandrup and E. H. Immergut, Polymer Handbook (3rd Edition) (Wiley-Interscience, 1989).

The binder may be of two or more polymers depending on needs. And, the polymer having Tg of 20 C. or more and the polymer having Tg of less than 20° C. can be used in combination. In the case where two or more polymers differing in Tg may be blended for use, it is preferred that the weight-average Tg is in the range mentioned above.

In the invention, the image forming layer is preferably formed by applying a coating solution containing 30% by weight or more of water in the solvent and by then drying.

In the invention, in the case where the image forming layer is formed by first applying a coating solution containing 30% by weight or more of water in the solvent and by then drying, furthermore, in the case where the binder of the image forming layer is soluble or dispersible in an aqueous solvent (water solvent), and particularly in the case where a polymer latex having an equilibrium water content of 2% by weight or lower at 25° C. and 60% RH is used, the performance can be enhanced. Most preferred embodiment is such prepared to yield an ion conductivity of 2.5 mS/cm or lower, and as such a preparing method, there can be mentioned a refining treatment using a separation function membrane after synthesizing the polymer.

The aqueous solvent in which the polymer is soluble or dispersible, as referred herein, signifies water or water containing mixed therein 70% by weight or less of a water-miscible organic solvent. As the water-miscible organic solvent, there can be described, for example, alcohols such as methyl alcohol, ethyl alcohol, propyl alcohol, or the like; cellosolves such as methyl cellosolve, ethyl cellosolve, butyl cellosolve, or the like; ethyl acetate; dimethylformamide; or the like.

The term "aqueous solvent" is also used in the case where the polymer is not thermodynamically dissolved, but is present in a so-called dispersed state.

The term "equilibrium water content at 25° C. and 60% RH" as referred herein can be expressed as follows:

$$\text{Equilibrium water content at 25° C. and 60\% RH}=[(W1-W0)/W0]\times 100\ (\%\ \text{by weight})$$

wherein W1 is the weight of the polymer in moisture-controlled equilibrium under an atmosphere of 25° C. and 60% RH, and W0 is the absolutely dried weight at 25° C. of the polymer. For the definition and the method of measurement for water content, reference can be made to Polymer Engineering Series 14, "Testing methods for polymeric materials" (The Society of Polymer Science, Japan, published by Chijin Shokan).

The equilibrium water content at 25° C. and 60% RH is preferably 2% by weight or lower, and is more preferably, in a range of from 0.01% by weight to 1.5% by weight, and is even more preferably, from 0.02% by weight to 1% by weight.

The binders used in the invention are particularly preferably polymers capable of being dispersed in an aqueous solvent. Examples of dispersed states may include a latex, in which water-insoluble fine particles of hydrophobic polymer are dispersed, or such in which polymer molecules are dispersed in molecular states or by forming micelles, but preferred are latex-dispersed particles. The mean particle diameter of the dispersed particles is in a range of from 1 nm to 50,000 nm, preferably from 5 nm to 1,000 nm, more preferably from 10 nm to 500 nm, and even more preferably from 50 nm to 200 nm. There is no particular limitation concerning particle diameter distribution of the dispersed particles, and they may be widely distributed or may exhibit a monodispersed particle diameter distribution.

From the viewpoint of controlling the physical properties of the coating solution, preferred mode of usage includes mixing two or more types of dispersed particles each having monodispersed particle diameter distribution.

In the invention, preferred embodiment of the polymers capable of being dispersed in aqueous solvent includes hydrophobic polymers such as acrylic polymers, polyesters, rubbers (e.g., SBR resin), polyurethanes, poly(vinyl chlorides), poly(vinyl acetates), poly(vinylidene chlorides), polyolefins, or the like. As the polymers above, usable are straight chain polymers, branched polymers, or crosslinked polymers; also usable are the so-called homopolymers in which one type of monomer is polymerized, or copolymers in which two or more types of monomers are polymerized. In the case of a copolymer, it may be a random copolymer or a block copolymer. The molecular weight of these polymers is, in number average molecular weight, in a range of from 5,000 to 1,000,000, preferably from 10,000 to 200,000. Those having too small a molecular weight exhibit insufficient mechanical strength on forming the image forming layer, and those having too large a molecular weight are also not preferred because the resulting film-forming properties are poor. Further, crosslinking polymer latexes are particularly preferred for use.

<Examples of latex>

Specific examples of preferred polymer latexes are given below, which are expressed by the starting monomers with % by weight given in parenthesis. The molecular weight is given in number average molecular weight.

In the case polyfunctional monomer is used, the concept of molecular weight is not applicable because they build a crosslinked structure. Hence, they are denoted as "crosslinking", and the molecular weight is omitted. Tg represents glass transition temperature.

P-1: Latex of -MMA(70)-EA(27)-MAA(3)—(molecular weight 37000, Tg 61° C.)

P-2: Latex of -MMA(70)-2EHA(20)-St(5)-AA(5)—(molecular weight 40000, Tg 59° C.)

P-3: Latex of -St(50)-Bu(47)-MAA(3)—(crosslinking, Tg −17° C.)

P-4: Latex of -St(68)-Bu(29)-AA(3)—(crosslinking, Tg 17° C.)

P-5: Latex of -St(71)-Bu(26)-AA(3)—(crosslinking, Tg 24° C.)

P-6: Latex of -St(70)-Bu(27)-IA(3)—(crosslinking)

P-7: Latex of -St(75)-Bu(24)-AA(1)—(crosslinking, Tg 29° C.)

P-8: Latex of -St(60)-Bu(35)-DVB(3)-MAA(2)—(crosslinking)

P-9: Latex of -St(70)-Bu(25)-DVB(2)-AA(3)—(crosslinking)

P-10: Latex of -VC(50)-MMA(20)-EA(20)-AN(5)-AA(5)—(molecular weight 80000)

P-11: Latex of -VDC(85)-MMA(5)-EA(5)-MAA(5)—(molecular weight 67000)

P-12: Latex of -Et(90)-MAA(10)—(molecular weight 12000)

P-13: Latex of -St(70)-2EHA(27)-AA(3)—(molecular weight 130000, Tg 43° C.)

P-14: Latex of -MMA(63)-EA(35)-AA(2)—(molecular weight 33000, Tg 47° C.)

P-15: Latex of -St(70.5)-Bu(26.5)-AA(3)—(crosslinking, Tg 23° C.)

P-16: Latex of -St(69.5)-Bu(27.5)-AA(3)—(crosslinking, Tg 20.5° C.)

P-17: Latex of -St(61.5)-Isoprene(35.5)-AA(3)—(crosslinking, Tg 17° C.)

P-18: Latex of -St(67)-Isoprene(28)-Bu(2)-AA(3)—(crosslinking, Tg 27° C.)

In the structures above, abbreviations represent monomers as follows. MMA: methyl methacrylate, EA: ethyl acrylate, MAA: methacrylic acid, 2EHA: 2-ethylhexyl acrylate, St: styrene, Bu: butadiene, AA: acrylic acid, DVB: divinylbenzene, VC: vinyl chloride, AN: acrylonitrile, VDC: vinylidene chloride, Et: ethylene, IA: itaconic acid.

The polymer latexes above are commercially available, and polymers below are usable. As examples of acrylic polymers, there can be mentioned Cevian A-4635, 4718, and 4601 (all manufactured by Daicel Chemical Industries, Ltd.), Nipol Lx811, 814, 821, 820, and 857 (all manufactured by Nippon Zeon Co., Ltd.), and the like; as examples of polyester, there can be mentioned FINETEX ES650, 611, 675, and 850 (all manufactured by Dainippon Ink and Chemicals, Inc.), WD-size and WMS (all manufactured by Eastman Chemical Co.), and the like; as examples of polyurethane, there can be mentioned HYDRAN AP10, 20, 30, and 40 (all manufactured by Dainippon Ink and Chemicals, Inc.), and the like; as examples of rubber, there can be mentioned LACSTAR 7310K, 3307B, 4700H, and 7132C (all manufactured by Dainippon Ink and Chemicals, Inc.), Nipol Lx416, 410, 438C, and 2507 (all manufactured by Nippon Zeon Co., Ltd.), and the like; as examples of poly(vinyl chloride), there can be mentioned G351 and G576 (all manufactured by Nippon Zeon Co., Ltd.), and the like; as examples of poly(vinylidene chloride), there can be mentioned L502 and L513 (all manufactured by Asahi Chemical Industry Co., Ltd.), and the like; as examples of polyolefin, there can be mentioned Chemipearl S120 and SA100 (all manufactured by Mitsui Petrochemical Industries, Ltd.), and the like.

The polymer latex above may be used alone, or may be used by blending two or more of them depending on needs.

<Preferable latex>

Particularly preferable as the polymer latex for use in the invention is that of styrene-butadiene copolymer or that of styrene-isoprene copolymer. The mass ratio of monomer unit for styrene to that of butadiene constituting the styrene-butadiene copolymer is preferably in a range of from 40:60 to 95:5. Further, the monomer unit of styrene and that of butadiene preferably account for 60% by weight to 99% by weight with respect to the copolymer. Further, the polymer latex of the invention preferably contains acrylic acid or methacrylic acid in a range from 1% by weight to 6% by weight with respect to the sum of styrene and butadiene, and more preferably from 2% by weight to 5% by weight. The polymer latex of the invention preferably contains acrylic acid. Preferable range of monomer content is similar to that described above. Further, the ratio of copolymerization and the like in the styrene-isoprene copolymer are similar to those in the styrene-butadiene copolymer.

As the latex of styrene-butadiene copolymer preferably used in the invention, there are mentioned P-3 to P-9 and P-15 described above, and commercially available LACSTAR-3307B, 7132C, Nipol Lx416, and the like. And as examples of the latex of styrene-isoprene copolymer, there are mentioned P-17 and P-18 described above.

In the image forming layer of the photothermographic material according to the invention, if necessary, there may be added hydrophilic polymers such as gelatin, poly(vinyl alcohol), methyl cellulose, hydroxypropyl cellulose, carboxymethyl cellulose, or the like. The hydrophilic polymer is added in an amount of 30% by weight or less, and preferably 20% by weight or less, with respect to the total weight of the binder incorporated in the image forming layer.

According to the invention, the layer containing organic silver salt (image forming layer) is preferably formed by using polymer latex for the binder. Concerning the amount of the binder for the image forming layer, the mass ratio of total binder to organic silver salt (total binder/organic silver salt) is preferably in a range of from 1/10 to 10/1, more preferably from 1/3 to 5/1, and even more preferably from 1/1 to 3/1.

The layer containing organic silver salt is, in general, a photosensitive layer (image forming layer) containing a photosensitive silver halide, i.e., the photosensitive silver salt; in such a case, the mass ratio of total binder to silver halide (total binder/silver halide) is in a range of from 5 to 400, and more preferably from 10 to 200.

The total amount of binder in the image forming layer of the invention is preferably in a range of from 0.2 $g/m^2$ to 30 $g/m^2$, more preferably from 1 $g/m^2$ to 15 $g/m^2$, and even more preferably from 2 $g/m^2$ to 10 $g/m^2$. As for the image forming layer of the invention, there may be added a crosslinking agent for crosslinking, a surfactant to improve coating ability, or the like.

(Preferred Solvent of Coating Solution)

In the invention, a solvent of a coating solution for the image forming layer in the photothermographic material of the invention (wherein a solvent and water are collectively described as a solvent for simplicity) is preferably an aqueous solvent containing water at 30% by weight or more. Examples of solvents other than water may include any of water-miscible organic solvents such as methyl alcohol, ethyl alcohol, isopropyl alcohol, methyl cellosolve, ethyl cellosolve, dimethylformamide and ethyl acetate. A water content in a solvent is more preferably 50% by weight or higher, and even more preferably 70% by weight or higher. Concrete examples of a preferable solvent composition, in addition to water=100, are compositions in which methyl alcohol is contained at ratios of water/methyl alcohol=90/10 and 70/30, in which dimethylformamide is further contained at a ratio of water/methyl alcohol/dimethylformamide=80/15/5, in which ethyl cellosolve is further contained at a ratio of water/methyl alcohol/ethyl cellosolve=85/10/5, and in which isopropyl alcohol is further contained at a ratio of water/methyl alcohol/isopropyl alcohol=85/10/5 (wherein the numerals presented above are values in % by weight).

(Antifoggant)

As an antifoggant, stabilizer and stabilizer precursor usable in the invention, there are mentioned those disclosed as patents in paragraph number 0070 of JP-A No. 10-62899 and in line 57 of page 20 to line 7 of page 21 of EP-A No. 803,764A1, the compounds described in JP-A Nos. 9-281637 and 9-329864, U.S. Pat. No. 6,083,681, and EP-A No. 1,048,975.

1) Organic Polyhalogen Compound

Preferable organic polyhalogen compound that can be used in the invention is explained specifically below. In the invention, preferred organic polyhalogen compound is the compound represented by the following formula (H).

$$Q\text{-}(Y)n\text{-}C(Z_1)(Z_2)X \qquad \text{Formula (H)}$$

In formula (H), Q represents one selected from an alkyl group, an aryl group, or a heterocyclic group; Y represents a divalent linking group; n represents 0 or 1; $Z_1$ and $Z_2$ each represent a halogen atom; and X represents a hydrogen atom or an electron-attracting group.

In formula (H), Q is preferably an alkyl group having 1 to 6 carbon atoms, an aryl group having 6 to 12 carbon atoms, or a heterocyclic group comprising at least one nitrogen atom (pyridine, quinoline, or the like).

In the case where Q is an aryl group in formula (H), Q is preferably a phenyl group substituted by an electron-attracting group whose Hammett substituent constant σp yields a positive value. For the details of Hammett substituent constant, reference can be made to Journal of Medicinal Chemistry, vol. 16, No. 11 (1973), pp. 1207 to 1216, and the like.

As such electron-attracting groups, examples include a halogen atom, an alkyl group substituted by an electron-attracting group, an aryl group substituted by an electron-attracting group, a heterocyclic group, an alkylsulfonyl group, an arylsulfonyl group, an acyl group, an alkoxycarbonyl group, a carbamoyl group, sulfamoyl group, and the like. Preferable as the electron-attracting group is a halogen atom, a carbamoyl group, or an arylsulfonyl group, and particularly preferred among them is a carbamoyl group.

X is preferably an electron-attracting group. As the electron-attracting group, preferable are a halogen atom, an aliphatic arylsulfonyl group, a heterocyclic sulfonyl group, an aliphatic arylacyl group, a heterocyclic acyl group, an aliphatic aryloxycarbonyl group, a heterocyclic oxycarbonyl group, a carbamoyl group, and a sulfamoyl group; more preferable are a halogen atom and a carbamoyl group; and particularly preferable is a bromine atom.

$Z_1$ and $Z_2$ each are preferably a bromine atom or an iodine atom, and more preferably, a bromine atom.

Y preferably represents —C(═O)—, —SO—, —$SO_2$—, —C(═O)N(R)—, or —$SO_2$N(R)—; more preferably, —C(═O)—, —$SO_2$—, or —C(═O)N(R)—; and particularly preferably, —$SO_2$— or —C(═O)N(R)—. Herein, R represents a hydrogen atom, an aryl group, or an alkyl group, preferably a hydrogen atom or an alkyl group, and particularly preferably a hydrogen atom.

n represents 0 or 1, and is preferably 1.

In formula (H), in the case where Q is an alkyl group, Y is preferably —C(═O)N(R)—. And, in the case where Q is an aryl group or a heterocyclic group, Y is preferably —$SO_2$—.

In formula (H), the embodiment where the residues, which are obtained by removing a hydrogen atom from the compound, bond to each other (generally called bis type, tris type, or tetrakis type) is also preferably used.

In formula (H), the embodiment having a substituent of a dissociative group (for example, a COOH group or a salt thereof, an $SO_3H$ group or a salt thereof, a $PO_3H$ group or a salt thereof, or the like), a group containing a quaternary nitrogen cation (for example, an ammonium group, a pyridinium group, or the like), a polyethyleneoxy group, a hydroxy group, or the like is also preferable.

Specific examples of the compound represented by formula (H) of the invention are shown below.

H-1

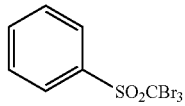

H-2

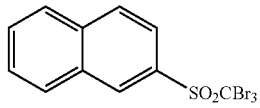

H-3

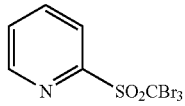

H-4

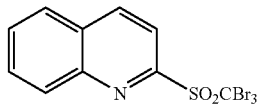

H-5

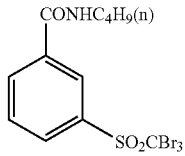

H-6

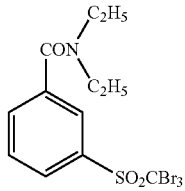

H-7

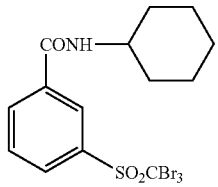

-continued

H-8

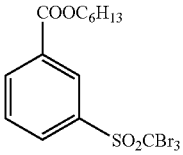

H-9

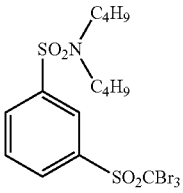

H-10

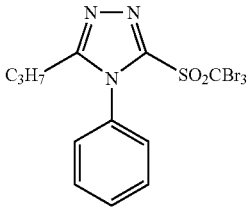

H-11

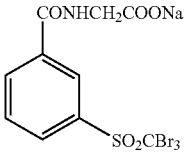

H-12

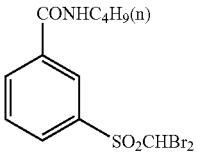

H-13

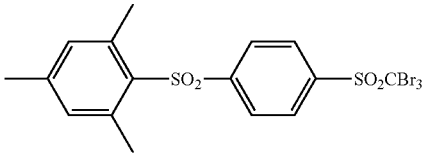

H-14

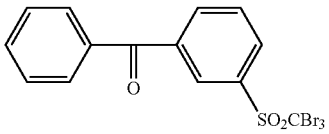

H-15

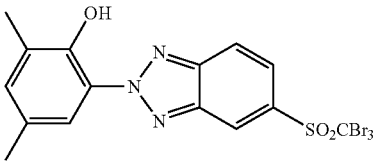

H-16

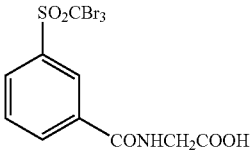

-continued

H-17

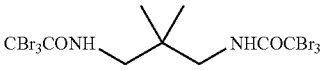

H-18

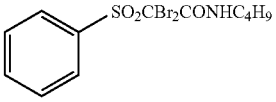

H-19

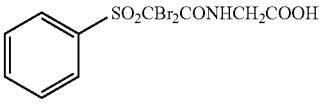

As preferred organic polyhalogen compounds which can be used in the present invention other than those above, there are mentioned compounds disclosed in U.S. Pat. Nos. 3,874,946, 4,756,999, 5,340,712, 5,369,000, 5,464,737, and 6,506,548, and JP-A Nos. 50-137126, 50-89020, 50-119624, 59-57234, 7-2781, 7-5621, 9-160164, 9-244177, 9-244178, 9-160167, 9-319022, 9-258367, 9-265150, 9-319022, 10-197988, 10-197989, 11-242304, 2000-2963, 2000-112070, 2000-284410, 2000-284412, 2001-33911, 2001-31644, 2001-312027, and 2003-50441. Particularly, the compounds specifically illustrated in JP-A Nos. 7-2781, 2001-33911, and 20001-312027 are preferable.

The compound represented by formula (H) of the invention is preferably used in an amount of from $10^{-4}$ mol to 1 mol, more preferably from $10^{-3}$ mol to 0.5 mol and, even more preferably from $1\times10^{-2}$ mol to 0.2 mol, per 1 mol of non-photosensitive silver salt incorporated in the image forming layer.

In the invention, usable methods for incorporating the antifoggant into the photothermographic material are those described above in the method for incorporating the reducing agent, and also for the organic polyhalogen compound, it is preferably added in the form of a solid fine particle dispersion.

2) Other Antifoggants

As other antifoggants, there are mentioned a mercury(II) salt described in paragraph number 0113 of JP-A No. 11-65021, benzoic acids described in paragraph number 0114 of the same literature, a salicylic acid derivative described in JP-A No. 2000-206642, a formalin scavenger compound represented by formula (S) in JP-A No. 2000-221634, a triazine compound related to claim 9 of JP-A No. 11-352624, a compound represented by formula (III), 4-hydroxy-6-methyl-1,3,3a,7-tetrazaindene and the like, described in JP-A No. 6-11791.

The photothermographic material according to the invention may further contain an azolium salt in order to prevent fogging. Azolium salts useful in the present invention include a compound represented by formula (XI) described in JP-A No. 59-193447, a compound described in Japanese Patent Application Publication (JP-B) No. 55-12581, and a compound represented by formula (II) in JP-A No. 60-153039. The azolium salt may be added to any part of the photothermographic material, but as the layer to be added, it is preferred to select a layer on the side having thereon the image forming layer, and more preferred is to select the image forming layer itself. The azolium salt may be added at any time of the process of preparing the coating solution; in the case where the azolium salt is added into the image forming layer, any time of the process may be selected, from the preparation of the organic silver salt to the preparation of the coating solution, but preferred is to add the azolium salt after preparing the organic silver salt and just before coating. As the method for adding the azolium salt, any method using powder, a solution, a fine particle dispersion, or the like may be used. Furthermore, it may be added as a solution having mixed therein other additives such as sensitizing agents, reducing agents, toners, and the like. In the invention, the azolium salt may be added in any amount, but preferably, it is added in a range of from $1\times10^{-6}$ mol to 2 mol, and more preferably from $1\times10^{-3}$ mol to 0.5 mol, per 1 mol of silver.

(Other Additives)

1) Mercapto Compounds, Disulfides, and Thiones

In the invention, mercapto compounds, disulfide compounds, and thione compounds can be added in order to control the development by suppressing or enhancing development, to improve spectral sensitization efficiency, and to improve storability before development and storability after development. Descriptions can be found in paragraph numbers 0067 to 0069 of JP-A No. 10-62899, a compound represented by formula (1) of JP-A No. 10-186572 and specific examples thereof shown in paragraph numbers 0033 to 0052, in lines 36 to 56 in page 20 of EP No. 803,764A1. Among them, mercapto-substituted heterocyclic aromatic compounds described in JP-A Nos. 9-297367, 9-304875, 2001-100358, 2002-303954, 2002-303951, and the like are preferred.

2) Toner

In the photothermographic material of the present invention, addition of a toner is preferred. Description on the toner can be found in JP-A No. 10-62899 (paragraph numbers 0054 to 0055), EP No. 803,764A1 (page 21, lines 23 to 48), JP-A Nos. 2000-356317 and 2000-187298. Preferred are phthalazinones (phthalazinone, phthalazinone derivatives and metal salts thereof, (e.g., 4-(1-naphthyl)phthalazinone, 6-chlorophthalazinone, 5,7-dimethoxyphthalazinone, and 2,3-dihydro-1,4-phthalazinedione); combinations of phthalazinones and phthalic acids (e.g., phthalic acid, 4-methylphthalic acid, 4-nitrophthalic acid, diammonium phthalate, sodium phthalate, potassium phthalate, and tetrachlorophthalic anhydride); phthalazines (phthalazine, phthalazine derivatives and metal salts thereof, (e.g., 4-(1-naphthyl)phthalazine, 6-isopropylphthalazine, 6-tert-butylphthalazine, 6-chlorophthalazine, 5,7-dimethoxyphthalazine, and 2,3-dihydrophthalazine); combinations of phthalazines and phthalic acids. Particularly preferred is a combination of phthalazines and phthalic acids. Among them, particularly preferable are the combination of 6-isopropylphthalazine and phthalic acid, and the combination of 6-isopropylphthalazine and 4-methylphthalic acid.

3) Plasticizer and Lubricant

In the invention, well-known plasticizer and lubricant can be used to improve physical properties of film. Particularly, to improve handling facility during manufacturing process or resistance to scratch during thermal development, it is preferred to use a lubricant such as a liquid paraffin, a long chain fatty acid, an amide of a fatty acid, an ester of a fatty acid, or the like.

Particularly preferred are a liquid paraffin obtained by removing components having a low boiling point and an ester of a fatty acid having a branch structure and a molecular weight of 1000 or more.

Concerning plasticizers and lubricants usable in the image forming layer and in the non-photosensitive layer, compounds described in paragraph No. 0117 of JP-A No. 11-65021 and in JP-A Nos. 2000-5137, 2004-219794, 2004-219802, and 2004-334077 are preferable.

4) Dyes and Pigments

From the viewpoints of improving color tone, preventing the generation of interference fringes and preventing irradiation on laser exposure, various dyes and pigments (for instance, C.I. Pigment Blue 60, C.I. Pigment Blue 64, and C.I. Pigment Blue 15:6) can be used in the image forming layer of the invention. Detailed description can be found in WO No. 98/36322, JP-A Nos. 10-268465 and 11-338098, and the like.

5) Nucleator

Concerning the photothermographic material of the invention, it is preferred to add a nucleator into the image forming layer. Details on the nucleators, method for their addition, and addition amount can be found in paragraph No. 0118 of JP-A No. 11-65021, paragraph Nos. 0136 to 0193 of JP-A No. 11-223898, as compounds represented by formulae (H), (1) to (3), (A), or (B) in JP-A No. 2000-284399; as for a nucleation accelerator, description can be found in paragraph No. 0102 of JP-A No. 11-65021, and in paragraph Nos. 0194 to 0195 of JP-A No. 11-223898.

In the case of using formic acid or formates as a strong fogging agent, it is preferably incorporated into the side having thereon the image forming layer containing photosensitive silver halide in an amount of 5 mmol or less, and more preferably 1 mmol or less, per 1 mol of silver.

In the case of using a nucleator in the photothermographic material of the invention, it is preferred to use an acid resulting from hydration of diphosphorus pentaoxide, or a salt thereof in combination. Acids resulting from the hydration of diphosphorus pentaoxide or salts thereof include metaphosphoric acid (salt), pyrophosphoric acid (salt), orthophosphoric acid (salt), triphosphoric acid (salt), tetraphosphoric acid (salt), hexametaphosphoric acid (salt), and the like. Particularly preferred acids obtainable by the hydration of diphosphorus pentaoxide or salts thereof include orthophosphoric acid (salt) and hexametaphosphoric acid (salt). Specifically mentioned as the salts are sodium orthophosphate, sodium dihydrogen orthophosphate, sodium hexametaphosphate, ammonium hexametaphosphate, and the like.

The addition amount of the acid obtained by hydration of diphoshorus pentaoxide or the salt thereof (i.e., the coating amount per 1 $m^2$ of the photothermographic material) may be set as desired depending on sensitivity and fogging, but preferred is an amount of from 0.1 $mg/m^2$, to 500 $mg/m^2$ , and more preferably, from 0.5 $mg/m^2$ to 100 $mg/m^2$.

In the present invention, the reducing agent, the hydrogen bonding compound, the development accelerator, and the organic polyhalogen compound are preferably used as solid dispersions. Preferable methods for manufacturing solid dispersion are described in JP-A No. 2002-55405.

(Preparation of Coating Solution and Coating)

The temperature for preparing the coating solution for the image forming layer of the invention is preferably from 30° C. to 65° C., more preferably, 35° C. or more and less than 60° C., and further preferably, from 35° C. to 55° C. Furthermore, the temperature of the coating solution for the image forming layer immediately after adding the polymer latex is preferably maintained in the temperature range from 30° C. to 65° C.

(Layer Constitution and Constituent Components)

The photothermographic material of the invention has one or more image forming layers constructed on a support. In the case of constituting the image forming layer from one layer, the image forming layer comprises an organic silver salt, a photosensitive silver halide, a reducing agent, and a binder, and may further comprise additional materials as desired and necessary, such as an antifoggant, a toner, a film-forming promoting agent, and other auxiliary agents. In the case of constituting the image forming layer from two or more layers, the first image forming layer (in general, a layer placed nearer to the support) contains an organic silver salt and a photosensitive silver halide. Some of the other components are incorporated in the second image forming layer or in both of the layers. The constitution of a multicolor photothermographic material may include combinations of two layers for those for each of the colors, or may contain all the components in a single layer as described in U.S. Pat. No. 4,708,928. In the case of multicolor photothermographic material, each of the image forming layers is maintained distinguished from each other by incorporating functional or non-functional barrier layer between each of the image forming layers as described in U.S. Pat. No. 4,460,681.

The photothermographic material according to the invention can have a non-photosensitive layer in addition to the image forming layer. Non-photosensitive layers can be classified depending on the layer arrangement into (a) a surface protective layer provided on the image forming layer (on the side farther from the support), (b) an intermediate layer provided among plural image forming layers or between the image forming layer and the protective layer, (c) an undercoat layer provided between the image forming layer and the support, and (d) a back layer which is provided on the side opposite to the image forming layer.

Furthermore, a layer that functions as an optical filter may be provided as (a) or (b) above. An antihalation layer may be provided as (c) or (d) to the photothermographic material.

1) Surface Protective Layer

The photothermographic material according to the invention can comprise a surface protective layer with an object to prevent adhesion of the image forming layer, and the like. The surface protective layer may be a single layer, or plural layers.

Description on the surface protective layer may be found in paragraph Nos. 0119 to 0120 of JP-A No. 11-65021 and in JP-A No. 2000-171936.

Preferred as the binder of the surface protective layer of the invention is gelatin, but poly(vinyl alcohol) (PVA) may be used preferably instead, or in combination. As gelatin, there are used an inert gelatin (e.g., Nitta gelatin 750), a phthalated gelatin (e.g., Nitta gelatin 801), and the like. Usable as PVA are those described in paragraph Nos. 0009 to 0020 of JP-A No. 2000-171936, and preferred are the completely saponified product PVA-105, the partially saponified PVA-205, and PVA-335, as well as modified poly(vinyl alcohol) MP-203 (all trade name of products from Kuraray Ltd.). The amount of coated poly(vinyl alcohol) (per 1 $m^2$ of support) in the surface protective layer (per one layer) is preferably in a range from 0.3 $g/m^2$ to 4.0 $g/m^2$, and more preferably, from 0.3 $g/m^2$ to 2.0 $g/m^2$.

The total amount of the coated binder (including water-soluble polymer and latex polymer) (per 1 $m^2$ of support) in the surface protective layer (per one layer) is preferably in a range from 0.3 $g/m^2$ to 5.0 $g/m^2$, and more preferably, from 0.3 $g/m^2$ to 2.0 $g/m^2$.

Further, it is preferred to use a lubricant such as a liquid paraffin, an aliphatic ester, or the like in the surface protective layer. The addition amount of the lubricant is in a range of from 1 $mg/m^2$ to 200 $mg/m^2$, preferably from 10 $mg/m^2$ to 150 $mg/m^2$, and more preferably from 20 $mg/m^2$ to 100 $mg/m^2$.

2) Antihalation Layer

The photothermographic material of the present invention can comprise an antihalation layer provided to the side farther from the light source than the image forming layer.

Descriptions on the antihalation layer can be found in paragraph Nos. 0123 to 0124 of JP-A No. 11-65021, in JP-A Nos. 11-223898, 9-230531, 10-36695, 10-104779, 11-231457, 11-352625, 11-352626, and the like.

The antihalation layer contains an antihalation dye having its absorption at the wavelength of the exposure light. In the case where the exposure wavelength is in the infrared region, an infrared-absorbing dye is used, and in such a case, preferred are dyes having no absorption in the visible light region.

In the case of preventing halation from occurring by using a dye having absorption in the visible light region, it is preferred that the color of the dye would not substantially reside after image formation, and is preferred to employ a means for bleaching color by the heat of thermal development; in particular, it is preferred to add a thermal bleaching dye and a base precursor to the non-photosensitive layer to impart function as an antihalation layer. Those techniques are described in JP-A No. 11-231457 and the like.

The addition amount of the thermal bleaching dye is determined depending on the usage of the dye. In general, it is used at an amount as such that the optical density (absorbance) exceeds 0.1 when measured at the desired wavelength. The optical density is preferably in a range of from 0.15 to 2, and more preferably from 0.2 to 1. The addition amount of the dye to obtain optical density in the above range is generally from 0.001 $g/m^2$ to 1 $g/m^2$.

By decoloring the dye in such a manner, the optical density after thermal development can be lowered to 0.1 or lower. Two or more types of thermal bleaching dyes may be used in combination in a photothermographic material. Similarly, two or more types of base precursors may be used in combination.

In the case of thermal decolorization by the combined use of a decoloring dye and a base precursor, it is advantageous from the viewpoint of thermal decoloring efficiency to further use a substance lowering the melting point by at least 3° C. when mixed with the base precursor (e.g., diphenylsulfone, 4-chlorophenyl(phenyl)sulfone, 2-naphthylbenzoate, or the like) as disclosed in JP-A No. 11-352626.

3) Back layer

Back layers usable in the invention are described in paragraph Nos. 0128 to 0130 of JP-A No. 11-65021.

In the invention, coloring matters having maximum absorption in the wavelength range from 300 nm to 450 nm can be added in order to improve color tone of developed silver images and deterioration of the images during aging. Such coloring matters are described in, for example, JP-A Nos. 62-210458, 63-104046, 63-103235, 63-208846, 63-306436, 63-314535, 01-61745, 2001-100363, and the like.

Such coloring matters are generally added in a range of from 0.1 $mg/m^2$ to 1 $g/m^2$, preferably to the back layer which is provided on the opposite side of the support from the image forming layer.

Further, in order to control the basic color tone, it is preferred to use a dye having an absorption peak in a wavelength range from 580 nm to 680 nm. As a dye satisfying this purpose, preferred are oil-soluble azomethine dyes described in JP-A Nos. 4-359967 and 4-359968, or water-soluble phthalocyanine dyes described in JP-A No. 2003-295388, which have low absorption intensity on the short wavelength side. The dyes for this purpose may be added to any of the layers, but more preferred is to add them in the non-photosensitive layer on the image forming layer side, or on the back layer side.

The photothermographic material of the invention is preferably a so-called one-side photosensitive material, which comprises at least one image forming layer containing silver halide emulsion on one side of the support, and a back layer on the other side.

4) Matting Agent

A matting agent can be added to the photothermographic material of the invention. Preferably, the outer most layer on the image forming layer side does not contain any matting agents at all, or contains matting agents within a range of extremely small amount so that the matting agents substantially cause no roughness on the surface.

On the other hand, a matting agent is preferably included in at least one of the outermost layer on the back layer side and the layer adjacent to the outermost layer on the back layer side. The case, where a matting agent is included in the outermost layer on the back layer side, is more preferred. The layer including a matting agent may be one layer or plural layers.

Particularly, the matting agent is preferably used as a dispersion of matting agent, which is dispersed beforehand by a polymer, a surfactant, or a combination thereof. More preferred are dispersions of matting agent, which is dispersed beforehand by a water-soluble polymer, a surfactant, or a combination thereof.

The matting agent used in the present invention is generally water-insoluble organic or inorganic fine particles. Any matting agents can be used and for example, organic matting agents described in U.S. Pat. Nos. 1,939,213, 2,701,245, 2,322,037, 3,262,782, 3,539,344, 3,767,448, and the like, inorganic matting agents described in U.S. Pat. Nos. 1,260, 772, 2,192,241, 3,257,206, 3,370,951, 3,523,022, 3,769,020, and the like, which are well-known in the said industry, can be used.

As the organic compound used as a matting agent, aqueous dispersed vinyl polymers such as poly(methyl acrylate), poly (methyl methacrylate), polyacrylonitrile, acrylonitrile/α-methylstyrene copolymer, polystyrene, styrene/divinylbenzene copolymer, poly(vinyl acetate), poly(ethylene carbonate), polytetrafluoroethylene, or the like, cellulose derivatives such as methylcellulose, cellulose acetate, cellulose acetate propionate, or the like, starch derivatives such as carboxy starch, carboxynitrophenyl starch, reactants of urea-formaldehyde-starch, or the like, hardened gelatin by known hardener, hardened gelatin being a fine hollow capsule particle by a coacervated hardening, and the like are preferably used.

As examples of the inorganic compound, silicon dioxide, titanium dioxide, magnesium dioxide, aluminium oxide, barium sulfate, calcium carbonate, silver chloride, and silver bromide desensitized by a known method, glass, diatomaceous earth, and the like are preferably used. Different compounds can be used by mixing with the above matting agent, depending on needs. Concerning a size of the matting agent, any particle diameter can be used without the limitation of particle size and shape of the matting agent. In the practice of the present invention, the matting agent having a particle diameter of from 0.1 μm to 30 μm is preferably used. The particle diameter is more preferably from 0.3 μm to 20 μm, and even more preferably from 0.5 μm to 10 μm. And a particle diameter distribution may be narrow or wide. The variation coefficient of a particle size distribution is preferably 50% or less, more preferably 40% or less, and even more preferably 30% or less. Herein, the variation coefficient means the value represented by (standard deviation of particle size)/(average value of particle size)×100. Further, the combined use of two types of matting agent, which has a low variation coefficient and the ratio of the mean particle diameters is larger than 3, is preferable.

On the other hand, because a matting agent effects greatly to haze and surface gloss of the coated film, it is preferred that the particle diameter, the shape, and the particle diameter distribution are arranged in a suitable condition in proportion to the need at a preparing step of the matting agent or at the mixing step of plural matting agents.

Preferable examples of the matting agent used in the present invention are described below, however this invention is not limited in these.

M-1: Polyethylene particle, specific gravity of 0.90, (FLOW BEADS LE-1080 produced by Sumitomo Seika Co., Ltd.)

M-2: Polyethylene particle, specific gravity of 0.93, (FLOW BEADS EA-209 produced by Sumitomo Seika Co., Ltd.)

M-3: Polyethylene particle, specific gravity of 0.96, (FLOW BEADS HE-3040 produced by Sumitomo Seika Co., Ltd.)

M-4: Silicon particle, specific gravity of 0.97

M-5: Silicon particle, specific gravity of 1.00, (E-701 produced by Dow Corning Toray Silicone Co., Ltd.)

M-6: Silicon particle, specific gravity of 1.03

M-7: Polystyrene particle, specific gravity of 1.05, (SB-6 produced Sekisui Plastics Co., Ltd.)

M-8: Poly(St/MAA=97/3) copolymer particle, specific gravity of 1.05

M-9: Poly(St/MAA=90/10) copolymer particle, specific gravity of 1.06

M-10: Poly(St/MMA/MAA=50/40/10) copolymer particle, specific gravity of 1.09

M-11: Crosslinking polyethylene particle, specific gravity of 0.92

M-12: Crosslinking polyethylene particle, specific gravity of 0.95

M-13: Crosslinking polyethylene particle, specific gravity of 0.98

M-14: Crosslinking silicon particle, specific gravity of 0.99

M-15: Crosslinking silicon particle, specific gravity of 1.02

M-16: Crosslinking silicon particle, specific gravity of 1.04

M-17: Poly(St/DVB=90/10) particle, specific gravity of 1.06 (SX-713 produced by SOKENKAGAKU Co.)

M-18: Poly(St/DVB=80/20) particle, specific gravity of 1.06 (SX-713 produced by SOKENKAGAKU Co.)

M-19: Poly(St/DVB=70/30) particle, specific gravity of 1.07 (SX-713 produced by SOKENKAGAKU Co.)

M-20: Copoly(St/MAA/DVB=87/3/10) particle, specific gravity of 1.06, (SX-713 α produced by SOKENKAGAKU Co.)

M-21: Copoly(St/MAA/DVB=80/10/10) particle, specific gravity of 1.07, (SX-713 α produced by SOKENKAGAKU Co.)

M-22: Copoly(St/MMA/MAA/DVB=40/40/10/10) particle, specific gravity of 1.10

The matting agent in the back layer of the present invention is preferably added in an amount to make a maximum surface roughness (Rt) of the surface of the back layer of from 3 μm to 10 μm, and more preferably from 4 μm to 8 μm. The addition amount described above varies depending on the type of the matting agent used, the mean particle size, the particle size distributions the arrangement of the layer where the matting agent is added (the outermost layer, the layer adjacent to the outermost layer, or the like), or physical properties of the coating solution (for example, viscosity, specific gravity, and mass ratio of the matting agent to the binder), and also on the drying condition. The addition amount of the matting agent is preferably in a range of from 1 mg/m$^2$ to 400 mg/m$^2$, and more preferably from 5 mg/m$^2$ to 300 mg/m$^2$, when expressed in terms of a coating amount per 1 m$^2$ of the photothermographic material.

The matting agent is used in the form of a dispersion of matting agent which is dispersed beforehand by a polymer, a surfactant, or a combination thereof. There are two dispersing methods:

(a) the preparing method of a matting agent dispersion to make a polymer droplet by emulsified dispersion in an aqueous medium of a polymer solution prepared in advance (e.g., dissolved in an organic solvent having a low boiling point) as a matting agent and then to remove the organic solvent having a low boiling point from the emulsified dispersion;

(b) the method of arranging a dispersion of fine particles of polymer or the like prepared in advance as a matting agent in an aqueous medium not to get lumpy.

In the present invention, the method (b) that takes into consideration for environment not to exhaust organic solvent having a low boiling point in air is preferable.

The dispersing method of the matting agent described above can comprise mechanically dispersion using the known high speed starring method (e.g., Disbar emulsifier, a homomixer, a turbine mixer, or a homogenizer) or an ultrasonic emulsifier in the beforehand presence of aqueous medium containing a polymer or a surfactant as an auxiliary dispersing agent in an aqueous solvent. At the dispersion, to prevent the occurrence of vesicles, the dispersing method which comprises dispersing the matting agent in the depressed condition less than atmospheric pressure can be used in combination. The auxiliary dispersing agent is generally dissolved in an aqueous solvent beforehand the addition of a matting agent, however can be added as an aqueous dispersion made by polymerized matting agent (without drying process). The auxiliary dispersing agent can be added in the dispersion during dispersion. The auxiliary dispersing agent can be added to the dispersion for stabilization of physical properties after dispersion. In each case, it is general that the solvent (e.g., water, alcohol, or the like) is coexisted. At before and after the dispersion or during dispersion, pH may be controlled by a suitable pH controlling agent.

Besides the mechanical dispersing method, stability of the matting agent dispersion after dispersion may be increased by the pH control. And at dispersion, a very small quantity of organic solvent having a low boiling point can be used and in general, the organic solvent is removed after completion of the fine granulating process.

The prepared dispersion can be stored with starring to prevent sedimentation of a matting agent at storage or can be stored in a high viscosity condition using hydrophilic colloids (e.g., the case of jelly condition by using gelatin). And to prevent the propagation of bacterium at the storage, the addition of an antiseptic is preferred.

As the water-soluble polymer, which can be used in the matting agent dispersion according to the present invention, either of an animal water-soluble polymer and a non-animal water-soluble polymer, which are described below, can be used. The water-soluble polymer is preferably added in an amount of from 5% by weight to 300% by weight, and more preferably from 10% by weight to 200% by weight, with respect to the matting agent, and dispersed.

When the matting agent dispersion in the present invention contains a surfactant, the dispersion state becomes stable. Therefore, the addition of a surfactant is preferable. The surfactant used herein is not especially limited, however, well-known compounds can be used. As an auxiliary dispersing agent disclosed conventionally, an anionic auxiliary dispersing agent such as alkylphenoxyethoxyethanesulfonate, polyoxyethylene alkylphenyl ether sulfonate, alkylbenzenesulfonate, alkylnaphthalenesulfonate, alkylsulfonate, alkylsulfosuccinate, sodium oleilmethyltaurate, condensed polymer of formaldehyde and naphthalenesulfonic acid, poly (acrylic acid), poly(methacrylic acid), copolymer of maleic acid and acrylic acid, carboxymethyl cellulose, cellulose sulfate, or the like, a non-ionic auxiliary dispersing agent such as polyoxyethylene alkyl ether, sorbitan ester of fatty acid, polyoxyethylene sorbitan ester of fatty acid, blocked polymer of polyalkyleneoxide, or the like, a cationic auxiliary dispersing agent, and a betaine type auxiliary dispersing agent are described. Particularly, an anionic surfactant such as sodium triisopropylnaphthalenesulfonate (a mixture of different substitution positions of three isopropyl groups) or the like is preferred.

As an antiseptic possible to be add to the dispersion, for example, sodium salt of benzoisothiazolinone, p-hydroxybenzoic acid ester (methyl ester, butyl ester, or the like) can be contained. The addition amount is preferably in a range of from 0.005% by weight to 0.1% by weight with respect to the dispersion.

5) Polymer Latex

In the present invention, polymer latex is preferably used in the surface protective layer or the back layer of the photothermographic material. As such polymer latex, descriptions can be found in "Gosei Jushi Emulsion (Synthetic resin emulsion)" (Taira Okuda and Hiroshi Inagaki, Eds., published by Kobunshi Kankokai (1978)), "Gosei Latex no Oyo (Application of synthetic latex)" (Takaaki Sugimura, Yasuo Kataoka, Soichi Suzuki, and Keiji Kasahara, Eds., published by Kobunshi Kankokai (1993)), and "Gosei Latex no Kagaku (Chemistry of synthetic latex)" (Soichi Muroi, published by Kobunshi Kankokai (1970)). More specifically, there are mentioned a latex of methyl methacrylate (33.5% by weight)/ethyl acrylate (50% by weight)/methacrylic acid (16.5% by weight) copolymer, a latex of methyl methacrylate (47.5% by weight)/butadiene (47.5% by weight)/itaconic acid (5% by weight) copolymer, a latex of ethyl acrylate/methacrylic acid copolymer, a latex of methyl methacrylate (58.9% by weight)/2-ethylhexyl acrylate (25.4% by weight)/styrene (8.6% by weight)/2-hydroethyl methacrylate (5.1% by weight)/acrylic acid (2.0% by weight) copolymer, a latex of methyl methacrylate (64.0% by weight)/styrene (9.0% by weight)/butyl acrylate (20.0% by weight)/2-hydroxyethyl methacrylate (5.0% by weight)/acrylic acid (2.0% by weight) copolymer, and the like. Furthermore, as the binder for the surface protective layer, there may be applied the technology described in paragraph Nos. 0021 to 0025 of the specification of JP-A No. 2000-267226, and the technology described in paragraph Nos. 0023 to 0041 of the specification of JP-A No. 2000-19678. The polymer latex in the surface protective layer is preferably contained in an amount of from 10% by weight to 90% by weight, particularly preferably from 20% by weight to 80% by weight, based on a total weight of binder.

6) Surface pH

The surface pH of the photothermographic material according to the invention preferably yields a pH of 7.0 or lower, and more preferably 6.6 or lower, before thermal developing process. Although there is no particular restriction concerning the lower limit, the lower limit of pH value is about 3. The most preferred surface pH range is from 4 to 6.2. From the viewpoint of reducing the surface pH, it is preferred to use an organic acid such as phthalic acid derivative or a non-volatile acid such as sulfuric acid, or a volatile base such as ammonia for the adjustment of the surface pH. In particular, ammonia can be used favorably for the achievement of low surface pH, because it can easily vaporize to remove it before the coating step or before applying thermal development.

It is also preferred to use a non-volatile base such as sodium hydroxide, potassium hydroxide, lithium hydroxide, and the like, in combination with ammonia. The method of measuring surface pH value is described in paragraph No. 0123 of the specification of JP-A No. 2000-284399.

7) Hardener

A hardener may be used in each of image forming layer, protective layer, back layer, and the like of the invention. As examples of the hardener, descriptions of various methods can be found in pages 77 to 87 of T. H. James, "THE THEORY OF THE PHOTOGRAPHIC PROCESS, FOURTH EDITION" (Macmillan Publishing Co., Inc., 1977). Preferably used are, in addition to chromium alum, sodium salt of 2,4-dichloro-6-hydroxy-s-triazine, N,N-ethylene bis(vinylsulfonacetamide), and N,N-propylene bis(vinylsulfonacetamide), polyvalent metal ions described in page 78 of the above literature and the like, polyisocyanates described in U.S. Pat. No. 4,281,060, JP-A No. 6-208193, and the like, epoxy compounds of U.S. Pat. No. 4,791,042 and the like, and vinylsulfone compounds of JP-A No. 62-89048.

The hardener is added as a solution, and the solution is added to a coating solution 180 minutes before coating to just before coating, preferably 60 minutes before to 10 seconds before coating. However, so long as the effect of the invention is sufficiently exhibited, there is no particular restriction concerning the mixing method and the conditions of mixing. As specific mixing methods, there can be mentioned a method of mixing in the tank, in which the average stay time calculated from the flow rate of addition and the feed rate to the coater is controlled to yield a desired time, or a method using static mixer as described in Chapter 8 of N. Harnby, M. F. Edwards, A. W. Nienow (translated by Koji Takahashi) "Ekitai Kongo Gijutu (Liquid Mixing Technology)" (Nikkan Kogyo Shinbunsha, 1989), and the like.

8) Surfactant

Concerning the surfactant, the solvent, the support, the antistatic agent, and the electrically conductive layer, and the method for obtaining color images applicable in the invention, there can be used those disclosed in paragraph numbers 0132, 0133, 0134, 0135, and 0136, respectively, of JP-A No. 11-65021. Concerning lubricants, there can be used those disclosed in paragraph numbers 0061 to 0064 of JP-A No. 11-84573.

9) Antistatic Agent

The photothermographic material of the invention preferably contains an electrically conductive layer including metal oxides or electrically conductive polymers. The antistatic layer may serve as an undercoat layer, a back surface protective layer, or the like, but can also be placed specially. As an electrically conductive material of the antistatic layer, metal oxides having enhanced electric conductivity by the method of introducing oxygen defects or different types of metallic atoms into the metal oxides are preferable for use. Examples of metal oxides are preferably selected from ZnO, $TiO_2$, or $SnO_2$. As the combination of different types of atoms, preferred are ZnO combined with Al, or In; $SnO_2$ with Sb, Nb, P, halogen atoms, or the like; $TiO_2$ with Nb, Ta, or the like.

Particularly preferred for use is $SnO_2$ combined with Sb. The addition amount of different types of atoms is preferably in a range of from 0.01 mol % to 30 mol %, and more preferably, in a range of from 0.1 mol % to 10 mol %. The shape of the metal oxides includes, for example, spherical, needle-like, or tabular. The needle-like particles, with a rate of (the major axis)/(the minor axis) is 2.0 or higher, and more preferably in a range of from 3.0 to 50, is preferred viewed from the standpoint of the electric conductivity effect. The metal oxides is preferably used in a range of from 1 $mg/m^2$ to 1000 $mg/m^2$, more preferably from 10 $mg/m^2$ to 500 $mg/m^2$, and even more preferably from 20 $mg/m^2$ to 200 $mg/m^2$.

The antistatic layer may be laid on either side of the image forming layer side or the back layer side, but it is preferred to set between the support and the back layer. Specific examples of the antistatic layer in the invention include described in paragraph Nos. 0135 of JP-A No. 11-65021, in JP-A Nos. 56-143430, 56-143431, 58-62646, and 56-120519, and in paragraph Nos. 0040 to 0051 of JP-A No. 11-84573, in U.S. Pat. No. 5,575,957, and in paragraph Nos. 0078 to 0084 of JP-A No. 11-223898.

10) Support

As the transparent support, preferably used is polyester, particularly, polyethylene terephthalate, which is subjected to heat treatment in the temperature range of from 130° C. to 185° C. in order to relax the internal strain caused by biaxial stretching and remaining inside the film, and to remove strain ascribed to heat shrinkage generated during thermal development. In the case of a photothermographic material for medical use, the transparent support may be colored with a blue dye (for instance, dye-1 described in the Example of JP-A No. 8-240877), or may be uncolored. As to the support, it is preferred to apply undercoating technology, such as water-soluble polyester described in JP-A No. 11-84574, a styrene-butadiene copolymer described in JP-A No. 10-186565, a vinylidene chloride copolymer described in JP-A No. 2000-39684, and the like. The moisture content of the support is preferably 0.5% by weight or lower, when coating for image forming layer or back layer is conducted on the support.

11) Other Additives

Furthermore, an anti-oxidizing agent, a stabilizing agent, a plasticizer, a UV absorbent, or a film-forming promoting agent may be added to the photothermographic material. Each of the additives is added to the image forming layer or either of the non-photosensitive layers. Reference can be made to WO No. 98/36322, EP No. 803,764A1, JP-A Nos. 10-186567 and 10-18568, and the like.

12) Coating Method

The photothermographic material of the invention may be coated by any method. Specifically, various types of coating operations including extrusion coating, slide coating, curtain coating, immersion coating, knife coating, flow coating, or an extrusion coating using the type of hopper described in U.S. Pat. No. 2,681,294 are used. Preferably used is extrusion coating or slide coating described in pages 399 to 536 of Stephen F. Kistler and Petert M. Shweizer, "LIQUID FILM COATING" (Chapman & Hall, 1997), and particularly preferably used is slide coating. Example of the shape of the slide coater for use in slide coating is shown in FIG. 11 b.1, page 427, of the same literature. If desired, two or more layers can be coated simultaneously by the method described in pages 399 to 536 of the same literature or by the method described in U.S. Pat. No. 2,761,791 and British Patent No. 837,095. Particularly preferred in the invention is the method described in JP-A Nos. 2001-194748, 2002-153808, 2002-153803, and 2002-182333.

The coating solution for the image forming layer in the invention is preferably a so-called thixotropic fluid. For the details of this technology, reference can be made to JP-A No. 11-52509. Viscosity of the coating solution for the image forming layer in the invention at a shear velocity of $0.1S^{-1}$ is preferably from 400 mPa·s to 100,000 mPa·s, and more preferably, from 500 mPa·s to 20,000 mPa·s. At a shear velocity of $1000S^{-1}$, the viscosity is preferably from 1 mPa·s to 200 mPa·s, and more preferably, from 5 mPa·s to 80 mPa·s.

In the case of mixing two types of liquids on preparing the coating solution of the invention, known in-line mixer and in-plant mixer can be used favorably. Preferred in-line mixer of the invention is described in JP-A No. 2002-85948, and the in-plant mixer is described in JP-A No. 2002-90940.

The coating solution of the invention is preferably subjected to antifoaming treatment to maintain the coated surface in a fine state. Preferred method for antifoaming treatment in the invention is described in JP-A No.2002-66431.

In the case of applying the coating solution of the invention to the support, it is preferred to perform diselectrification in order to prevent the adhesion of dust, particulates, and the like due to charge up. Preferred example of the method of diselectrification for use in the invention is described in JP-A No. 2002-143747.

Since a non-setting coating solution is used for the image forming layer in the invention, it is important to precisely control the drying air and the drying temperature. Preferred drying method for use in the invention is described in detail in JP-A Nos. 2001-194749 and 2002-139814.

In order to improve the film-forming properties in the photothermographic material of the invention, it is preferred to apply a heat treatment immediately after coating and drying. The temperature of the heat treatment is preferably in a range of from 60° C. to 100° C. at the film surface, and time period for heating is preferably in a range of from 1 second to 60 seconds. More preferably, heating is performed in a temperature range of from 70° C. to 90° C. at the film surface, and the time period for heating is from 2 seconds to 10 seconds. A preferred method of heat treatment for the invention is described in JP-A No. 2002-107872.

Furthermore, the producing methods described in JP-A Nos. 2002-156728 and 2002-182333 are favorably used in the invention in order to stably and successively produce the photothermographic material of the invention.

The photothermographic material is preferably of monosheet type (i.e., a type which forms an image on the photothermographic material without using other sheets such as an image-receiving material).

13) Wrapping Material

In order to suppress fluctuation from occurring on photographic property during a preservation of the photothermographic material of the invention before thermal development, or in order to improve curling or winding tendencies when the photothermographic material is manufactured in a roll state, it is preferred that a wrapping material having low oxygen transmittance and/or vapor transmittance is used. Preferably, oxygen transmittance is 50 $mL \cdot atm^{-1}m^{-2}day^{-1}$ or lower at 25° C., more preferably, 10 $mL \cdot atm^{-1}m^{-2}day^{-1}$ or lower, and even more preferably, 1.0 $mL \cdot atm^{-1}m^{-2}day^{-1}$ or lower. Preferably, vapor transmittance is 10 $g \cdot atm^{-1}m^{-2}day^{-1}$ or lower, more preferably, 5 $g \cdot atm^{-1}m^{-2}day^{-1}$ or lower, and even more preferably, 1 $g \cdot atm^{-1}m^{-2}day^{-1}$ or lower.

As specific examples of a wrapping material having low oxygen transmittance and/or vapor transmittance, reference can be made to, for instance, the wrapping material described in JP-A Nos. 8-254793 and 2000-206653.

14) Other Applicable Techniques

Techniques which can be used for the photothermographic material of the invention also include those in EP No. 803,764A1, EP No. 883,022A1, WO No. 98/36322, JP-A Nos. 56-62648, 58-62644, JP-A Nos. 9-43766, 9-281637, 9-297367, 9-304869, 9-311405, 9-329865, 10-10669, 10-62899, 10-69023, 10-186568, 10-90823, 10-171063, 10-186565, 10-186567, 10-186569 to 10-186572, 10-197974, 10-197982, 10-197983, 10-197985 to 10-197987, 10-207001, 10-207004, 10-221807, 10-282601, 10-288823, 10-288824, 10-307365, 10-312038, 10-339934, 11-7100, 11-15105, 11-24200, 11-24201, 11-30832, 11-84574, 11-65021, 11-109547, 11-125880, 11-129629, 11-133536 to 11-133539, 11-133542, 11-133543, 11-223898, 11-352627, 11-305377, 11-305378, 11-305384, 11-305380, 11-316435, 11-327076, 11-338096, 11-338098, 11-338099, 11-343420, JP-A Nos. 2000-187298, 2000-10229, 2000-47345, 2000-206642, 2000-98530, 2000-98531, 2000-112059, 2000-112060, 2000-112104, 2000-112064, and 2000-171936.

In the case of multicolor photothermographic material, each of the image forming layers is maintained distinguished from each other by incorporating functional or non-functional barrier layer between each of the image forming layers as described in U.S. Pat. No. 4,460,681.

The constitution of a multicolor photothermographic material may include combinations of two layers for those for each of the colors, or may contain all the components in a single layer as described in U.S. Pat. No. 4,708,928.

(Image Forming Method)

1) Imagewise Exposure

The photothermographic material of the invention may be subjected to imagewise exposure by any known methods. Preferably, the photothermographic material of the present invention is subjected to scanning exposure using a laser beam. As the laser beam which can be used in the invention, He—Ne laser of red through infrared emission, red laser diode, or $Ar^+$, He—Ne, He—Cd laser of blue through green emission, or blue laser diode are described. Preferred is red to infrared laser diode and the peak wavelength of laser beam is 600 nm to 900 nm, and preferably 620 nm to 850 nm. In recent years, development has been made particularly on a light source module with an SHG (a second harmonic generator) and a laser diode integrated into a single piece whereby a laser output apparatus in a short wavelength region has become popular. A blue laser diode enables high definition image recording and makes it possible to obtain an increase in recording density and a stable output over a long lifetime, which results in expectation of an expanded demand in the future. The peak wavelength of blue laser beam is preferably from 300 nm to 500 nm, and particularly preferably from 400 nm to 500 nm.

At the scanning exposure by a laser beam, in order to prevent interference fringe by light interference, an irradiation angle of the laser beam is preferably set to be from 3 degrees to 45 degrees with respect to a normal line on the exposure surface of the phohothermographic material.

Laser beam which oscillates in a longitudinal multiple modulation by a method such as high frequency superposition is also preferably employed.

2) Thermal Development

Although any method may be used for developing the photothermographic material of the present invention, development is usually performed by elevating the temperature of the photothermographic material exposed imagewise. The temperature of development is preferably from 80° C. to 250° C., more preferably from 100° C. to 140° C., and even more preferably from 110° C. to 130° C. Time period for development is preferably from 1 second to 60 seconds, more preferably from 3 seconds to 30 seconds, even more preferably from 5 seconds to 25 seconds and, particularly preferably from 7 seconds to 15 seconds.

In the process of thermal development, either a drum type heater or a plate type heater may be used, although a plate type heater is preferred. A preferable process of thermal development by a plate type heater is a process described in JP-A No. 11-133572, which discloses a thermal developing apparatus in which a visible image is obtained by bringing a photothermographic material with a formed latent image into contact with a heating means at a thermal developing section, wherein the heating means comprises a plate heater, and a plurality of pressing rollers are oppositely provided along one surface of the plate heater, the thermal developing apparatus is characterized in that thermal development is performed by passing the photothermographic material between the pressing rollers and the plate heater. It is preferred that the plate heater is divided into 2 to 6 steps, with the leading end having a lower temperature by 1° C. to 10° C. For example, 4 sets of plate heaters which can be independently subjected to the temperature control are used, and are controlled so that they respectively become 112° C., 119° C., 121° C., and 120° C. Such a process is also described in JP-A No. 54-30032, which allows for passage of moisture and organic solvents included in the photothermographic material out of the system, and also allows for suppressing the change of shapes of the support of the photothermographic material upon rapid heating of the photothermographic material.

For downsizing the thermal developing apparatus and for reducing the time period for thermal development, it is preferred that the heater is more stably controlled, and a top part of one sheet of the photothermographic material is exposed and thermal development of the exposed part is started before exposure of the end part of the sheet has completed. Preferable imagers which enable a rapid process according to the invention are described in, for example, JP-A Nos. 2002-289804 and 2002-287668. Using such imagers, thermal development within 14 seconds is possible with a plate type heater having three heating plates which are controlled, for example, at 107° C., 121° C. and 121° C., respectively. Thus, the output time period for the first sheet can be reduced to about 60 seconds. For such a rapid developing process, it is preferred to use the photothermographic materials of the present invention, which exhibit high sensitivity and are hardly influenced by environmental temperature, in combination with the process.

3) System

The photothermographic material of the present invention is preferably subjected to scanning exposure by laser beam and successively thermal development while conveying the material in an image forming apparatus equipped with a scanning exposing portion using a laser beam, and thermal developing portion. The image forming apparatus is preferred for downsizing the apparatus and easy handling, and capability of connecting with various medical diagnostic instruments. Moreover, rapid image formation can be attained by subjecting the material to imagewise exposure and thermal development while conveying the material at a line speed of 16 mm/second or higher. More preferably, the material is conveyed at a line speed of 23 mm/second or higher.

Examples of a medical laser imager equipped with an exposing portion and a thermal developing portion include Fuji Medical Dry Laser Imager FM-DPL. In connection with FM-DPL, description is found in Fuji Medical Review No. 8, pages 39 to 55. The described techniques may be applied as the laser imager for the photothermographic material of the invention. In addition, the present photothermographic material can be also applied as a photothermographic material for the laser imager used in "AD network" which was proposed by Fuji Film Medical Co., Ltd. as a network system accommodated to DICOM standard.

(Application of the Invention)

The photothermographic material and the image forming method of the invention are preferably employed as photothermographic materials and image forming methods for photothermographic materials for use in medical imaging, photothermographic materials for use in industrial photographs, photothermographic materials for use in graphic arts, as well as for COM, through forming black and white images by silver imaging.

All publications, patent applications, and technical standards mentioned in this specification are herein incorporated by reference to the same extent as if each individual publication, patent application, or technical standard was specifically and individually indicated to be incorporated by reference.

EXAMPLES

The present invention is specifically explained by way of Examples below, which should not be construed as limiting the invention thereto.

Example 1

(Preparation of PET Support)

1) Film Manufacturing

PET having IV (intrinsic viscosity) of 0.66 (measured in phenol/tetrachloroethane=6/4 (mass ratio) at 25° C.) was obtained according to a conventional manner using terephthalic acid and ethylene glycol. The product was pelletized, dried at 130° C. for 4 hours, and melted at 300° C. Thereafter, the mixture was extruded from a T-die and rapidly cooled to form a non-tentered film.

The film was stretched along the longitudinal direction by 3.3 times using rollers of different peripheral speeds, and then stretched along the transverse direction by 4.5 times using a tenter machine. The temperatures used for these operations were 110° C. and 130° C., respectively. Then, the film was subjected to thermal fixation at 240° C. for 20 seconds, and relaxed by 4% along the transverse direction at the same temperature. Thereafter, the chucking part was slit off, and both edges of the film were knurled. Then the film was rolled up at the tension of 4 kg/cm$^2$ to obtain a roll having the thickness of 175 μm.

2) Surface Corona Discharge Treatment

Both surfaces of the support were treated at room temperature at 20 m/minute using Solid State Corona Discharge Treatment Machine Model 6KVA manufactured by Piller GmbH. It was proven that treatment of 0.375 kV A·minute/m$^2$ was executed, judging from the readings of current and voltage on that occasion. The frequency upon this treatment was 9.6 kHz, and the gap clearance between the electrode and dielectric roll was 1.6 mm.

3) Undercoating

<Preparations of Coating Solution for Undercoat Layer>

Formula (1) (for undercoat layer of the image forming layer side)

| Formula (1) (for undercoat layer on the image forming layer side) | |
|---|---|
| Pesresin A-520 manufactured by Takamatsu Oil & Fat Co., Ltd. (30% by weight solution) | 46.8 g |
| BAIRONAARU MD-1200 manufactured by Toyo Boseki Co., Ltd. | 10.4 g |
| Polyethyleneglycol monononylphenylether (average ethylene oxide number = 8.5) 1% by weight solution | 11.0 g |

-continued

| | |
|---|---|
| MP-1000 manufactured by Soken Chemical & Engineering Co., Ltd. (PMMA polymer fine particle, mean particle diameter of 0.4 μm) | 0.91 g |
| Distilled water | 931 mL |
| Formula (2) (for first layer on the backside) | |
| Styrene-butadiene copolymer latex (solid content of 40% by weight, styrene/butadiene mass ratio = 68/32) | 130.8 g |
| Sodium salt of 2,4-dichloro-6-hydroxy-S-triazine (8% by weight aqueous solution) | 5.2 g |
| 1% by weight aqueous solution of sodium laurylbenzenesulfonate | 10 mL |
| Polystyrene particle dispersion (mean particle diameter of 2 μm, 20% by weight) | 0.5 g |
| Distilled water | 854 mL |
| Formula (3) (for second layer on the backside) | |
| $SnO_2$/SbO (9/1 by mass ratio, mean particle diameter of 0.5 μm, 17% by weight dispersion) | 84 g |
| Gelatin | 7.9 g |
| METOLOSE TC-5 manufactured by Shin-Etsu Chemical Co., Ltd. (2% by weight aqueous solution) | 10 g |
| 1% by weight aqueous solution of sodium dodecylbenzenesulfonate | 10 mL |
| NaOH (1% by weight) | 7 g |
| Proxel (manufactured by Imperial Chemical Industries PLC) | 0.5 g |
| Distilled water | 881 mL |

<Undercoating>

Both surfaces of the biaxially tentered polyethylene terephthalate support having the thickness of 175 μm were subjected to the corona discharge treatment as described above, respectively. Thereafter, the aforementioned formula (1) of the coating solution for the undercoat was coated on one side (image forming layer side) with a wire bar so that the amount of wet coating became 6.6 mL/$m^2$ (per one side), and dried at 180° C. for 5 minutes. Then, the aforementioned formula (2) of the coating solution for the undercoat was coated on the reverse side (backside) with a wire bar so that the amount of wet coating became 5.7 mL/$m^2$, and dried at 180° C. for 5 minutes. Furthermore, the aforementioned formula (3) of the coating solution for the undercoat was coated on the reverse side (backside) with a wire bar so that the amount of wet coating became 8.4 mL/$m^2$, and dried at 180° C. for 6 minutes. Thus, an undercoated support was produced.

(Back Layer)

1) Preparation of Dispersion of Solid Fine Particles (a) of Base Precursor 2.5 kg of base precursor-1, 300 g of a surfactant (trade name: DEMOL N, manufactured by Kao Corporation), 800 g of diphenylsulfone, and 1.0 g of benzoisothiazolinone sodium salt were mixed with distilled water to give the total amount of 8.0 kg. This mixed liquid was subjected to beads dispersion using a horizontal sand mill (UVM-2: manufactured by AIMEX Co., Ltd.). Process of dispersion includes feeding the mixed liquid to UVM-2 packed with zirconia beads having a mean particle diameter of 0.5 mm with a diaphragm pump, followed by the dispersion at the inner pressure of 50 hPa or higher until desired mean particle diameter could be achieved.

Dispersion was continued until the ratio of the optical density at 450 nm to the optical density at 650 nm for the spectral absorption of the dispersion ($D_{450}/D_{650}$) became 3.0 upon spectral absorption measurement. The resulting dispersion was diluted with distilled water so that the concentration of the base precursor became 25% by weight, and filtrated (with a polypropylene filter having a mean fine pore diameter of 3 μm) for eliminating dust to put into practical use.

2) Preparation of Solid Fine Particle Dispersion of Dye

Cyanine dye-1 in an amount of 6.0 kg, 3.0 kg of sodium p-dodecylbenzenesulfonate, 0.6 kg of DEMOL SNB (a surfactant manufactured by Kao Corporation), and 0.15 kg of an antifoaming agent (trade name: SURFYNOL 104E, manufactured by Nissin Chemical Industry Co., Ltd.) were mixed with distilled water to give the total amount of 60 kg. The mixed liquid was subjected to dispersion with 0.5 mm zirconia beads using a horizontal sand mill (UVM-2: manufactured by AIMEX Co., Ltd.).

Dispersion was continued until the ratio of the optical density at 650 nm to the optical density at 750 nm for the spectral absorption of the dispersion ($D_{650}/D_{750}$) became 5.0 or higher upon spectral absorption measurement. The resulting dispersion was diluted with distilled water so that the concentration of the cyanine dye became 6% by weight, and filtrated with a filter (mean fine pore diameter: 1 μm) for eliminating dust to put into practical use.

3) Preparation of Coating Solution for Antihalation Layer

A vessel was kept at 40° C., and thereto were added 40 g of gelatin, 20 g of monodispersed poly(methyl methacrylate) fine particles (mean particle size of 8 μm, standard deviation of particle diameter of 0.4), 0.1 g of benzoisothiazolinone, and 490 mL of water to allow gelatin to be dissolved. Additionally, 2.3 mL of a 1 mol/L sodium hydroxide aqueous solution, 40 g of the above-mentioned dispersion of the solid fine particles of the dye, 90 g of the above-mentioned dispersion of the solid fine particles (a) of the base precursor, 12 mL of a 3% by weight aqueous solution of sodium polystyrenesulfonate, and 180 g of a 10% by weight liquid of SBR latex were admixed. Just prior to the coating, 80 mL of a 4% by weight aqueous solution of N,N-ethylenebis(vinylsulfone acetamide) was admixed to give a coating solution for the antihalation layer.

4) Preparation of Coating Solution for Back Surface Protective Layer

<<Preparation of Coating Solution-1 for Back Surface Protective Layer>>

A vessel was kept at 40° C., and thereto were added 43 g of gelatin having an isoelectric point of 4.8 (PZ gelatin, manufactured by Miyagi Chemical Industry Co., Ltd.), 0.21 g of benzoisothiazolinone, and water to allow gelatin to be dissolved. Additionally, 8.1 mL of a 1 mol/L sodium acetate aqueous solution, 0.93 g of fine particles of poly(ethylene glycol dimethacrylate-co-methylmethacrylate) (mean particle diameter of 7.7 μm, standard deviation of particle diameter of 0.3) as a matting agent, 5 g of a 10% by weight emulsion of liquid paraffin, 10 g of a 10% by weight emulsion of dipentaerythritol hexaisostearate, 10 mL of a 5% by weight aqueous solution of sodium di(2-ethylhexyl)sulfosuccinate, 17 mL of a 3% by weight aqueous solution of sodium polystyrenesulfonate, 2.4 mL of a 2% by weight solution of a fluorocarbon surfactant (F-1), 2.4 mL of a 2% by weight solution of another fluorocarbon surfactant (F-2), and 30 mL of a 20% by weight liquid of ethyl acrylate acrylic acid copolymer (mass ratio of the copolymerization of 96.4/3.6) latex were admixed. Just prior to the coating, 50 mL of a 4% by weight aqueous solution of N,N-ethylenebis(vinylsulfone acetamide) was admixed to give coating solution-I for the back surface protective layer in an amount of 855 mL. The pH of the resulting coating solution was 6.2.

5) Coating of Back Layer

The backside of the undercoated support described above was subjected to simultaneous double coating so that the coating solution for the antihalation layer gave the coating amount of gelatin of 0.54 g/m$^2$, and so that the coating solution for the back surface protective layer gave the coating amount of gelatin of 1.85 g/m$^2$, followed by drying to produce a back layer.

(Image Forming Layer, Intermediate Layer, and Surface Protective Layer)

1. Preparations of Coating Material

1) Preparation of Silver Halide Emulsion

<<Preparation of Silver Halide Emulsion 1>>

A liquid was prepared by adding 3.1 mL of a 1% by weight potassium bromide solution, and then 3.5 mL of 0.5 mol/L sulfuric acid and 31.7 g of phthalated gelatin to 1421 mL of distilled water. The liquid was kept at 30° C. while stirring in a stainless steel reaction vessel, and thereto were added a total amount of: solution A prepared through diluting 22.22 g of silver nitrate by adding distilled water to give the volume of 95.4 mL; and solution B prepared through diluting 15.3 g of potassium bromide and 0.8 g of potassium iodide with distilled water to give the volume of 97.4 mL, over 45 seconds at a constant flow rate. Thereafter, 10 mL of a 3.5% by weight aqueous solution of hydrogen peroxide was added thereto, and 10.8 mL of a 10% by weight aqueous solution of benzimidazole was further added. Moreover, a solution C prepared through diluting 51.86 g of silver nitrate by adding distilled water to give the volume of 317.5 mL and a solution D prepared through diluting 44.2 g of potassium bromide and 2.2 g of potassium iodide with distilled water to give the volume of 400 mL were added. A controlled double jet method was executed through adding the total amount of the solution C at a constant flow rate over 20 minutes, accompanied by adding the solution D while maintaining the pAg at 8.1. Potassium hexachloroiridate(III) was added in its entirely to give $1\times10^{-4}$ mol per 1 mol of silver, at 10 minutes post initiation of the addition of the solution C and the solution D. Moreover, at 5 seconds after completing the addition of the solution C, a potassium hexacyanoferrate(II) in an aqueous solution was added in its entirety to give $3\times10^{-4}$ mol per 1 mol of silver. The mixture was adjusted to the pH of 3.8 with 0.5 mol/L sulfuric acid. After stopping stirring, the mixture was subjected to precipitation/desalting/water washing steps. The mixture was adjusted to the pH of 5.9 with 1 mol/L sodium hydroxide to produce a silver halide dispersion having the pAg of 8.0.

The above-described silver halide dispersion was kept at 38° C. with stirring, and thereto was added 5 mL of a 0.34% by weight methanol solution of 1,2-benzisothiazoline-3-one, followed by elevating the temperature to 47° C. at 40 minutes thereafter. At 20 minutes after elevating the temperature, sodium benzene thiosulfonate in a methanol solution was added at $7.6\times10^{-5}$ mol per 1 mol of silver. At additional 5 minutes later, a tellurium sensitizer C in a methanol solution was added at $2.9\times10^{-4}$ mol per 1 mol of silver and subjected to ripening for 91 minutes. Thereafter, a methanol solution of a spectral sensitizing dye A and a spectral sensitizing dye B with a molar ratio of 3:1 was added thereto at $1.2\times10^{-3}$ mol in total of the spectral sensitizing dye A and B per 1 mol of silver. At 1 minute later, 1.3 mL of a 0.8% by weight methanol solution of N,N'-dihydroxy-N",N"-diethylmelamine was added thereto, and at additional 4 minutes thereafter, 5-methyl-2-mercaptobenzimidazole in a methanol solution at $4.8\times10^{-3}$ mol per 1 mol of silver, 1-phenyl-2-heptyl-5-mercapto-1,3,4-triazole in a methanol solution at $5.4\times10^{-3}$ mol per 1 mol of silver, and 1-(3-methylureidophenyl)-5-mercaptotetrazole in an aqueous solution at $8.5\times10^{-3}$ mol per 1 mol of silver were added to produce a silver halide emulsion 1.

Grains in thus prepared silver halide emulsion were silver iodobromide grains having a mean equivalent spherical diameter of 0.042 μm, a variation coefficient of an equivalent spherical diameter distribution of 20%, which uniformly include iodine at 3.5 mol %. Grain size and the like were determined from the average of 1000 grains using an electron microscope. The {100} face ratio of these grains was found to be 80% using a Kubelka-Munk method.

<<Preparation of Silver Halide Emulsion 2>>

Preparation of silver halide emulsion 2 was conducted in a similar manner to the process in the preparation of the silver halide emulsion 1 except that: the temperature of the liquid upon the grain forming process was altered from 30° C. to 47° C.; the solution B was changed to that prepared through diluting 15.9 g of potassium bromide with distilled water to give the volume of 97.4 mL; the solution D was changed to that prepared through diluting 45.8 g of potassium bromide with distilled water to give the volume of 400 mL; time period for adding the solution C was changed to 30 minutes; and potassium hexacyanoferrate(II) was deleted; further the precipitation/desalting/water washing/dispersion were carried out similar to the silver halide emulsion 1. Furthermore, spectral sensitization, chemical sensitization, and addition of 5-methyl-2-mercaptobenzimidazole and 1-phenyl-2-heptyl-5-mercapto-1,3,4-triazole were executed similar to those in the preparation of the silver halide emulsion 1 except that: the amount of the tellurium sensitizer C to be added was changed to $1.1\times10^{-4}$ mol per 1 mol of silver; the amount of the methanol solution of the spectral sensitizing dye A and a spectral sensitizing dye B with a molar ratio of 3:1 to be added was changed to $7.0\times10^{-4}$ mol in total of the spectral sensitizing dye A and the spectral sensitizing dye B per 1 mol of silver; the addition of 1-phenyl-2-heptyl-5-mercapto-1,3,4-triazole was changed to give $3.3\times10^{-3}$ mol per 1 mol of silver; and the addition of 1-(3-methylureidophenyl)-5-mercaptotetrazole was changed to give $4.7\times10^{-3}$ mol per 1 mol of silver, to produce silver halide emulsion 2. Grains in the silver halide emulsion 2 were cubic pure silver bromide grains having a mean equivalent spherical diameter of 0.080 μm and a variation coefficient of an equivalent spherical diameter distribution of 20%.

<<Preparation of Silver Halide Emulsion 3>>

Preparation of silver halide emulsion 3 was conducted in a similar manner to the process in the preparation of the silver halide emulsion 1 except that the temperature of the liquid upon the grain forming process was altered from 30° C. to 27° C., and in addition, the precipitation/desalting/water washing/dispersion were carried out similarly to the silver halide emulsion 1. Silver halide emulsion 3 was obtained similarly to the silver halide emulsion 1 except that: the addition of the methanol solution of the spectral sensitizing dye A and the spectral sensitizing dye B was changed to a solid dispersion (aqueous gelatin solution) at a molar ratio of 1:1 with the amount to be added being $6\times10^{-3}$ mol in total of the spectral sensitizing dye A and spectral sensitizing dye B per 1 mol of silver; the addition amount of tellurium sensitizer C was changed to $5.2\times10^{-4}$ mol per 1 mol of silver; and bromoauric acid at $5\times10^{-4}$ mol per 1 mol of silver and potassium thiocyanate at $2\times10^{-3}$ mol per 1 mol of silver were added at 3 minutes following the addition of the tellurium sensitizer. Grains in the silver halide emulsion 3 were silver iodobromide grains having a mean equivalent spherical diameter of 0.034 μm and a variation coefficient of an equivalent spherical diameter distribution of 20%, which uniformly include iodine at 3.5 mol %.

<<Preparation of Mixed Emulsion A for Coating Solution>>

The silver halide emulsion 1 at 70% by weight, the silver halide emulsion 2 at 15% by weight, and the silver halide emulsion 3 at 15% by weight were dissolved, and thereto was added benzothiazolium iodide in a 1% by weight aqueous solution to give $7\times10^{-3}$ mol per 1 mol of silver.

Further, as "a compound that is one-electron-oxidized to provide a one-electron oxidation product, which releases one or more electrons", the compounds Nos. 1, 20, and 26 were added respectively in an amount of $2\times10^{-3}$ mol per 1 mol of silver in silver halide.

Further, water was added thereto to give the content of silver of 38.2 g per 1 kg of the mixed emulsion for a coating solution, and 1-(3-methylureidophenyl)-5-mercaptotetrazole was added to give 0.34 g per 1 kg of the mixed emulsion for a coating solution.

2) Preparation of Dispersion of Silver Salt of Fatty Acid

<Preparation of Recrystallized Behenic Acid>

Behenic acid manufactured by Henkel Co. (trade name: Edenor C22-85R) in an amount of 100 kg was admixed with 1200 kg of isopropyl alcohol, and dissolved at 50° C. The mixture was filtrated through a 10 μm filter, and cooled to 30° C. to allow recrystallization. Cooling speed for the recrystallization was controlled to be 3° C./hour. The resulting crystal was subjected to centrifugal filtration, and washing was performed with 100 kg of isopropyl alcohol. Thereafter, the crystal was dried. The resulting crystal was esterified, and subjected to GC-FID analysis to give the results of the content of behenic acid being 96 mol %, lignoceric acid 2 mol %, and arachidic acid 2 mol %. In addition, erucic acid was included at 0.001 mol %.

<Preparation of Dispersion of Silver Salt of Fatty Acid>

88 kg of the recrystallized behenic acid, 422 L of distilled water, 49.2 L of 5 mol/L sodium hydroxide aqueous solution, and 120 L of t-butyl alcohol were admixed, and subjected to reaction with stirring at 75° C. for one hour to give a solution of sodium behenate. Separately, 206.2 L of an aqueous solution of 40.4 kg of silver nitrate (pH 4.0) was provided, and kept at a temperature of 10° C. A reaction vessel charged with 635 L of distilled water and 30 L of t-butyl alcohol was kept at 30° C., and thereto were added the total amount of the solution of sodium behenate and the total amount of the aqueous silver nitrate solution with sufficient stirring at a constant flow rate over 93 minutes and 15 seconds, and 90 minutes, respectively.

Upon this operation, during first 11 minutes following the initiation of adding the aqueous silver nitrate solution, the added material was restricted to the aqueous silver nitrate solution alone. The addition of the solution of sodium behenate was thereafter started, and during 14 minutes and 15 seconds following the completion of adding the aqueous silver nitrate solution, the added material was restricted to the solution of sodium behenate alone. The temperature inside of the reaction vessel was then set to be 30° C., and the temperature outside was controlled so that the liquid temperature could be kept constant. In addition, the temperature of a pipeline for the addition system of the solution of sodium behenate was kept constant by circulation of warm water outside of a double wall pipe, so that the temperature of the liquid at an outlet in the leading edge of the nozzle for addition was adjusted to be 75° C. Further, the temperature of a pipeline for the addition system of the aqueous silver nitrate solution was kept constant by circulation of cool water outside of a double wall pipe. Position at which the solution of sodium behenate was added and the position, at which the aqueous silver nitrate solution was added, was arranged symmetrically with a shaft for stirring located at a center. Moreover, both of the positions were adjusted to avoid contact with the reaction liquid.

After completing the addition of the solution of sodium behenate, the mixture was left to stand at the temperature as it was for 20 minutes. The temperature of the mixture was then elevated to 35° C. over 30 minutes followed by ripening for 210 minutes. Immediately after completing the ripening, solid matters were filtered out with centrifugal filtration. The solid matters were washed with water until the electric conductivity of the filtrated water became 30 μS/cm. A silver salt of a fatty acid was thus obtained. The resulting solid matters were stored as a wet cake without drying.

When the shape of the resulting particles of the silver behenate was evaluated by an electron micrography, a crystal was revealed having a=0.21 μm, b=0.4 μm and c=0.4 μm on the average value, with a mean aspect ratio of 2.1, and a variation coefficient of an equivalent spherical diameter distribution of 11% (a, b and c are as defined aforementioned.).

To the wet cake corresponding to 260 kg of a dry solid matter content, were added 19.3 kg of poly(vinyl alcohol) (trade name: PVA-217) and water to give the total amount of 1000 kg. Then, slurry was obtained from the mixture using a dissolver blade. Additionally, the slurry was subjected to preliminary dispersion with a pipeline mixer (manufactured by MIZUHO Industrial Co., Ltd.: PM-10 type).

Next, a stock liquid after the preliminary dispersion was treated three times using a dispersing machine (trade name: Microfluidizer M-610, manufactured by Microfluidex International Corporation, using Z type Interaction Chamber) with the pressure controlled to be 1150 kg/cm$^2$ to give a dispersion of silver behenate. For the cooling manipulation, coiled heat exchangers were equipped in front of and behind the interaction chamber respectively, and accordingly, the temperature for the dispersion was set to be 18° C. by regulating the temperature of the cooling medium.

3) Preparations of Reducing Agent Dispersion

<<Preparation of Reducing Agent-1 Dispersion>>

To 10 kg of reducing agent-1 (2,2'-methylenebis-(4-ethyl-6-tert-butylphenol)) and 16 kg of a 10% by weight aqueous solution of modified poly(vinyl alcohol) (manufactured by Kuraray Co., Ltd., Poval MP203) was added 10 kg of water, and thoroughly mixed to give slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 3 hours. Thereafter, 0.2 g of a benzisothiazolinone sodium salt and water were added thereto, thereby adjusting the concentration of the reducing agent to be 25% by weight. This dispersion was subjected to heat treatment at 60° C. for 5 hours to obtain reducing agent-1 dispersion.

Particles of the reducing agent included in the resulting reducing agent dispersion had a median diameter of 0.40 μm, and a maximum particle diameter of 1.4 μm or less. The resulting reducing agent dispersion was subjected to filtration with a polypropylene filter having a pore size of 3.0 μm to remove foreign substances such as dust, and stored.

<<Preparation of Reducing Agent-2 Dispersion>>

To 10 kg of reducing agent-2 (6,6'-di-t-butyl-4,4'-dimethyl-2,2'-butylidenediphenol)) and 16 kg of a 10% by weight aqueous solution of modified poly(vinyl alcohol) (manufactured by Kuraray Co., Ltd., Poval MP-203) was added 10 kg of water, and thoroughly mixed to give slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 3 hours and 30 minutes. Thereafter, 0.2 g of a benzoisothiazolinone sodium salt and water were added thereto, thereby adjusting the concentration of the reducing agent to be 25% by weight. This dispersion was warmed at 40° C. for one hour, followed by a subsequent heat treatment at 80° C. for one hour to obtain reducing agent-2 dispersion. Particles of the reducing agent included in the resulting reducing agent dispersion had a median diameter of 0.50 μm, and a maximum particle diameter of 1.6 μm or less.

The resulting reducing agent dispersion was subjected to filtration with a polypropylene filter having a pore size of 3.0 μm to remove foreign substances such as dust, and stored.

4) Preparation of Hydrogen Bonding Compound-1 Dispersion

To 10 kg of hydrogen bonding compound-1 (tri(4-t-butylphenyl)phosphineoxide) and 16 kg of a 10% by weight aqueous solution of modified poly(vinyl alcohol) (manufactured by Kuraray Co., Ltd., Poval MP203) was added 10 kg of water, and thoroughly mixed to give slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 4 hours. Thereafter, 0.2 g of a benzisothiazolinone sodium salt and water were added thereto, thereby adjusting the concentration of the hydrogen bonding compound to be 25% by weight. This dispersion was warmed at 40° C. for one hour, followed by a subsequent heat treatment at 80° C. for one hour to obtain hydrogen bonding compound-1 dispersion. Particles of the hydrogen bonding compound included in the resulting hydrogen bonding compound dispersion had a median diameter of 0.45 μm, and a maximum particle diameter of 1.3 μm or less. The resulting hydrogen bonding compound dispersion was subjected to filtration with a polypropylene filter having a pore size of 3.0 μm to remove foreign substances such as dust, and stored.

5) Preparation of Development Accelerator-1 Dispersion

To 10 kg of development accelerator-1 and 20 kg of a 10% by weight aqueous solution of modified poly(vinyl alcohol) (manufactured by Kuraray Co., Ltd., Poval MP203) was added 10 kg of water, and thoroughly mixed to give slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 3 hours and 30 minutes. Thereafter, 0.2 g of a benzisothiazolinone sodium salt and water were added thereto, thereby adjusting the concentration of the development accelerator to be 20% by weight. Accordingly, development accelerator-1 dispersion was obtained. Particles of the development accelerator included in the resulting development accelerator dispersion had a median diameter of 0.48 μm, and a maximum particle diameter of 1.4 μm or less. The resulting development accelerator dispersion was subjected to filtration with a polypropylene filter having a pore size of 3.0 μm to remove foreign substances such as dust, and stored.

6) Preparations of Development Accelerator-2 Dispersion and Color-tone-adjusting Agent-1 Dispersion Also concerning solid dispersions of development accelerator-2 and color-tone-adjusting agent-1, dispersion was executed similar to the development accelerator-1, and thus dispersions of 20% by weight and 15% by weight were respectively obtained.

7) Preparations of Organic Polyhalogen Compound Dispersion

<<Preparation of Organic Polyhalogen Compound-1 Dispersion>>

10 kg of organic polyhalogen compound-1 (tribromomethane sulfonylbenzene), 10 kg of a 20% by weight aqueous solution of modified poly(vinyl alcohol) (manufactured by Kuraray Co., Ltd., Poval MP203), 0.4 kg of a 20% by weight aqueous solution of sodium triisopropylnaphthalenesulfonate and 14 kg of water were thoroughly admixed to give slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 5 hours. Thereafter, 0.2 g of a benzisothiazolinone sodium salt and water were added thereto, thereby adjusting the concentration of the organic polyhalogen compound to be 26% by weight. Accordingly, organic polyhalogen compound-1 dispersion was obtained. Particles of the organic polyhalogen compound included in the resulting organic polyhalogen compound dispersion had a median diameter of 0.41 μm, and a maximum particle diameter of 2.0 μm or less. The resulting organic polyhalogen compound dispersion was subjected to filtration with a polypropylene filter having a pore size of 10.0 μm to remove foreign substances such as dust, and stored.

<<Preparation of Organic Polyhalogen Compound-2 Dispersion>>

10 kg of organic polyhalogen compound-2 (N-butyl-3-tribromomethane sulfonylbenzamide), 20 kg of a 10% by weight aqueous solution of modified poly(vinyl alcohol) (manufactured by Kuraray Co., Ltd., Poval MP203) and 0.4 kg of a 20% by weight aqueous solution of sodium triisopropylnaphthalenesulfonate were thoroughly admixed to give slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 5 hours. Thereafter, 0.2 g of a benzisothiazolinone sodium salt and water were added thereto, thereby adjusting the concentration of the organic polyhalogen compound to be 30% by weight. This dispersion was heated at 40° C. for 5 hours to obtain organic polyhalogen compound-2 dispersion. Particles of the organic polyhalogen compound included in the resulting organic polyhalogen compound dispersion had a median diameter of 0.40 μm, and a maximum particle diameter of 1.3 μm or less. The resulting organic polyhalogen compound dispersion was subjected to filtration with a polypropylene filter having a pore size of 3.0 μm to remove foreign substances such as dust, and stored.

8) Preparation of Phthalazine Compound-1 Solution

Modified poly(vinyl alcohol) MP-203 in an amount of 8 kg was dissolved in 174.57 kg of water, and then thereto were added 3.15 kg of a 20% by weight aqueous solution of sodium triisopropylnaphthalenesulfonate and 14.28 kg of a 70% by weight aqueous solution of phthalazine compound-1 (6-isopropyl phthalazine) to prepare a 5% by weight solution of phthalazine compound-1.

9) Preparations of Aqueous Solution of Mercapto Compound

<<Preparation of Aqueous Solution of Mercapto Compound-1>>

Mercapto compound-1 (1-(3-sulfophenyl)-5-mercaptotetrazole sodium salt) in an amount of 7 g was dissolved in 993 g of water to give a 0.7% by weight aqueous solution.

<<Preparation of Aqueous Solution of Mercapto Compound-2>>

Mercapto compound-2 (1-(3-methylureidophenyl)-5-mercaptotetrazole) in an amount of 20 g was dissolved in 980 g of water to give a 2.0% by weight aqueous solution.

10) Preparation of Pigment-1 Dispersion

C.I. Pigment Blue 60 in an amount of 64 g and 6.4 g of DEMOL N manufactured by Kao Corporation were added to 250 g of water and thoroughly mixed to give slurry. Zirconia beads having the mean particle diameter of 0.5 mm were provided in an amount of 800 g, and charged in a vessel with the slurry. Dispersion was performed with a dispersing machine (1/4G sand grinder mill: manufactured by AIMEX Co., Ltd.) for 25 hours. Thereto was added water to adjust so that the concentration of the pigment became 5% by weight to obtain pigment-i dispersion. Particles of the pigment included in the resulting pigment dispersion had a mean particle diameter of 0.21 μm.

11) Preparation of SBR Latex Liquid

SBR latex (TP-1) was prepared as follows.

To a polymerization vessel of a gas monomer reaction apparatus (manufactured by Taiatsu Techno Corporation, TAS-2J type) were charged 287 g of distilled water, 7.73 g of a surfactant (Pionin A-43-S (manufactured by TAKEMOTO OIL & FAT CO., LTD.): solid matter content of 48.5% by weight), 14.06 mL of 1 mol/L sodium hydroxide, 0.15 g of ethylenediamine tetraacetate tetrasodium salt, 255 g of styrene, 11.25 g of acrylic acid, and 3.0 g of tert-dodecyl mercaptan, followed by sealing of the reaction vessel and stirring at a stirring rate of 200 rpm. Degassing was conducted with a vacuum pump, followed by repeating nitrogen gas replacement several times. Thereto was injected 108.75 g of 1,3-butadiene, and the inner temperature was elevated to 60° C. Thereto was added a solution of 1.875 g of ammonium persulfate dissolved in 50 mL of water, and the mixture was stirred for 5 hours as it stands. The temperature was further elevated to 90° C., followed by stirring for 3 hours. After completing the reaction, the inner temperature was lowered to reach to the room temperature, and thereafter the mixture was treated by adding 1 mol/L sodium hydroxide and ammonium hydroxide to give the molar ratio of $Na^+$ion:$NH_4^+$ion=1:5.3, and thus, the pH of the mixture was adjusted to 8.4. Thereafter, filtration with a polypropylene filter having the pore size of 1.0 μm was conducted to remove foreign substances such as dust followed by storage. Accordingly, SBR latex TP-1 was obtained in an amount of 774.7 g. Upon the measurement of halogen ion by ion chromatography, concentration of chloride ion was revealed to be 3 ppm. As a result of the measurement of the concentration of the chelating agent by high performance liquid chromatography, it was revealed to be 145 ppm.

The aforementioned latex had a mean particle diameter of 90 nm, Tg of 17° C., a solid content of 44% by weight, an equilibrium moisture content at 25° C. and 60% RH of 0.6% by weight, an ionic conductivity of 4.80 mS/cm (measurement of the ionic conductivity was performed using a conductometer CM-30S manufactured by Toa Electronics Ltd. for the latex stock solution (44% by weight) at 25° C.).

12) Preparation of Isoprene Latex Liquid

Isoprene latex (TP-2) was prepared as follows.

1500 g of distilled water were poured into the polymerization vessel of a gas monomer reaction apparatus (type TAS-2J manufactured by Tiatsu Garasu Kogyo Ltd.), and the vessel was heated for 3 hours at 90° C. to make passive film over the stainless vessel surface and stainless stirring device. Thereafter, 582.28 g of distilled water deaerated by nitrogen gas for one hour, 9.49 g of surfactant "PIONIN A-43-S" (trade name, available from Takemoto Oil & Fat Co., Ltd.), 19.56 g of 1 mol/L sodium hydroxide, 0.20 g of ethylenediamine tetraacetic acid tetrasodium salt, 314.99 g of styrene, 190.87 g of isoprene, 10.43 g of acrylic acid, and 2.09 g of tert-dodecyl mercapatn were added into the pretreated reaction vessel. And then, the reaction vessel was sealed and the mixture was stirred at the stirring rate of 225 rpm, followed by elevating the inner temperature to 65° C. A solution obtained by dissolving 2.61 g of ammonium persulfate in 40 mL of water was added to the aforesaid mixture and kept for 6 hours with stirring. At the point the polymerization ratio was 90% according to the solid content measurement. Thereto a solution obtained by dissolving 5.22 g of acrylic acid in 46.98 g of water was added, and then 10 g of water and a solution obtained by dissolving 1.30 g of ammonium persulfate in 50.7 mL of water were added. After the addition, the mixture was heated to 90° C. and stirred for 3 hours. After the reaction was finished, the inner temperature of the vessel was cooled to room temperature. And then, the mixture was treated by adding 1 mol/L sodium hydroxide and ammonium hydroxide to give the molar ratio of $Na^+$ion:$NH_4^+$ion=1:5.3, and thus, the pH of the mixture was adjusted to 8.4. Thereafter, the resulting mixture was filtered with a polypropylene filter having a pore size of 1.0 μm to remove foreign substances such as dust, and stored. 1248 g of isoprene latex TP-2 was obtained. Upon the measurement of halogen ion by ion chromatography, concentration of chloride ion was revealed to be 3 ppm. As a result of the measurement of the concentration of the chelating agent by high performance liquid chromatography, it was revealed to be 142 ppm.

The obtained latex had a mean particle diameter of 113 nm, Tg of 15° C., a solid content of 41.3% by weight, an equilibrium moisture content at 25° C. and 60 RH % of 0.4% by weight, and an ionic conductivity of 5.23 mS/cm (measurement of the ionic conductivity was performed using a conductometer CM-30S manufactured by Toa Electronics Ltd. at 25° C.).

2. Preparations of Coating Solution

1) Preparation of Coating Solution for Image Forming Layer

To the dispersion of the silver salt of a fatty acid obtained as described above in an amount of 1000 g were serially added water, the pigment-1 dispersion, the organic polyhalogen compound-1 dispersion, the organic polyhalogen compound-2 dispersion, the phthalazine compound-1 solution, the SBR latex (TP-1) liquid, the isoprene latex (TP-2) liquid, the reducing agent-1 dispersion, the reducing agent-2 dispersion, the hydrogen bonding compound-1 dispersion, the development accelerator-1 dispersion, the development accelerator-2 dispersion, the color-tone-adjusting agent-1 dispersion, the mercapto compound-1 aqueous solution, and the mercapto compound-2 aqueous solution. The mixed emulsion A for coating solution in an amount of 140 g was added thereto, followed by thorough mixing just prior to the coating, which was fed directly to a coating die.

Viscosity of the above-described coating solution for the image forming layer was 35 [mPa·s] which was measured with a B type viscometer at 40° C. (No. 1 rotor, 60 rpm).

Viscosity of the coating solution at 38° C. when it was measured using Rheo Stress RS150 manufactured by Haake Co. Ltd. was 38, 49, 48, 34, and 25 [mPa·s], respectively, at the shearing rate of 0.1, 1, 10, 100, 1000 [1/second].

The amount of zirconium in the coating solution was 0.30 mg per 1 g of silver.

2) Preparation of Coating Solution for Intermediate Layer

To 1000 g of poly(vinyl alcohol) PVA-205 (manufactured by Kuraray Co., Ltd.), 163 g of the pigment-1 dispersion, 33 g of an aqueous solution of a blue dye-1 (manufactured by Nippon Kayaku Co., Ltd.: Kayafect turquoise RN liquid 150), 27 mL of a 5% by weight aqueous solution of sodium di(2-ethylhexyl)sulfosuccinate, and 4200 mL of a 19% by weight liquid of methyl methacrylate/styrene/butyl acrylate/hydroxyethyl methacrylate/acrylic acid copolymer (mass ratio of the copolymerization of 57/8/28/5/2) latex, 27 mL of a 5% by weight aqueous solution of aerosol OT (manufactured by American Cyanamid Co.), 135 mL of a 20% by weight aqueous solution of diammonium phthalate was added water to give total amount of 10000 g. The mixture was adjusted with sodium hydroxide to give the pH of 7.5. Accordingly, the coating solution for the intermediate layer was prepared, and was fed to a coating die to provide 8.9 mL/m$^2$.

Viscosity of the coating solution was 58 [mPa·s] which was measured with a B type viscometer at 40° C. (No. 1 rotor, 60 rpm).

3) Preparation of Coating Solution for First Layer of Surface Protective Layers

In 840 mL of water were dissolved 100 g of inert gelatin and 10 mg of benzoisothiazolinone, and thereto were added 180 g of a 19% by weight liquid of methyl methacrylate/styrene/butyl acrylate/hydroxyethyl methacrylate/acrylic acid copolymer (mass ratio of the copolymerization of 57/8/28/5/2) latex, 46 mL of a 15% by weight methanol solution of phthalic acid, and 5.4 mL of a 5% by weight aqueous solution of sodium di(2-ethylhexyl)sulfosuccinate, and were mixed. Immediately before coating, 40 mL of a 4% by weight chrome alum which had been mixed with a static mixer was fed to a coating die so that the amount of the coating solution became 26.1 mL/m$^2$.

Viscosity of the coating solution was 20 [mPa·s] which was measured with a B type viscometer at 40° C. (No. 1 rotor, 60 rpm).

4) Preparations of Coating Solution for Second Layer of Surface Protective Layers <<Preparation of Coating Solution-1 for Second Layer of Surface Protective Layers>>

In 800 mL of water were dissolved 100 g of inert gelatin and 10 mg of benzoisothiazolinone, and thereto were added 10 g of a 10% by weight emulsion of liquid paraffin, 30 g of a 10% by weight emulsion of dipentaerythritol hexa-isostearate, 180 g of a 19% by weight liquid of methyl methacrylate/styrene/butyl acrylate/hydroxyethyl methacrylate/acrylic acid copolymer (mass ratio of the copolymerization of 57/8/28/5/2) latex, 40 mL of a 15% by weight methanol solution of phthalic acid, 5.5 mL of a 1% by weight solution of a fluorocarbon surfactant (F-1), 5.5 mL of a 1% by weight aqueous solution of another fluorocarbon surfactant (F-2), 28 mL of a 5% by weight aqueous solution of sodium di(2-ethylhexyl) sulfosuccinate, and 21 g of poly(methyl methacrylate) fine particles (mean particle diameter of 3.6 μm, volume weighted mean distribution of 60%), and the obtained mixture was mixed, which was fed to a coating die so that 8.3 mL/m$^2$ could be provided.

Viscosity of the coating solution was 19 [mPa·s] which was measured with a B type viscometer at 40° C. (No. 1 rotor, 60 rpm).

<<Preparations of Coating Solution-2 to -13 for Second Layer of Surface Protective Layers>>Coating solution-2 to -13 for the second layer of the surface protective layers were prepared in a similar manner to the preparation of coating solution-1 for the second layer of the surface protective layers except that: the matting agent and the matting agent, poly (methyl methacrylate) fine particles (mean particle diameter of 3.6 μm, volume weighted mean distribution of 60%), were omitted; and the polymer described in Table 5 was added in an amount described in Table 5 as a solid content in place of 180 g of a 19% by weight liquid of methyl methacrylate/styrene/butyl acrylate/hydroxyethyl methacrylate/acrylic acid copolymer (mass ratio of the copolymerization of 57/8/28/5/2) latex.

Polymers used for the present invention are described below:

FL-2: Polymer latex described in Table 1 (mean particle diameter of 0.09 μm)

FL-8: Polymer latex described in Table 2 (mean particle diameter of 0.09 μm)

FL-10: Polymer latex described in Table 3 (mean particle diameter of 0.07 μm)

FL-11: Polymer latex described in Table 3 (mean particle diameter of 0.10 μm)

FL-14: Polymer latex described in Table 4 (mean particle diameter of 0.09 μm)

FL-100: AG-7000 (trade name, manufactured by Asahi Glass Co., Ltd.)

FL-101: NK Guard NDN-2000 (trade name, manufactured by Nicca Chemical Co., Ltd.)

TABLE 5

| | Back Layer | | | | Second Layer of Surface Protective Layers | | | | | Maximum Surface Roughness (Rt) | | |
|---|---|---|---|---|---|---|---|---|---|---|---|---|
| | | | | | | | Polymer | | Inert Gelatin | | Image Forming | |
| Sample No. | No. | Matting Agent | Mean Particle Size (μm) | Addition Amount (mg/m$^2$) | No. | Matting Agent | No. | Addition Amount (mg/m$^2$) | Addition Amount (mg/m$^2$) | Backside (μm) | Layer Side (μm) | Note |
| 1 | 1 | PEGDMA/MMA | 7.7 | 40 | 1 | Added | PL-1 | 233 | 680 | 6.44 | 3.43 | Comparative |
| 2 | 1 | PEGDMA/MMA | 7.7 | 40 | 2 | — | PL-1 | 233 | 680 | 6.44 | 0.72 | Invention |
| 3 | 1 | PEGDMA/MMA | 7.7 | 40 | 3 | — | FL-2 | 233 | 680 | 6.44 | 0.65 | Invention |
| 4 | 1 | PEGDMA/MMA | 7.7 | 40 | 4 | — | FL-8 | 233 | 680 | 6.44 | 0.70 | Invention |
| 5 | 1 | PEGDMA/MMA | 7.7 | 40 | 5 | — | FL-10 | 233 | 680 | 6.44 | 0.68 | Invention |
| 6 | 1 | PEGDMA/MMA | 7.7 | 40 | 6 | — | FL-11 | 233 | 680 | 6.44 | 0.69 | Invention |
| 7 | 1 | PEGDMA/MMA | 7.7 | 40 | 7 | — | FL-14 | 233 | 680 | 6.44 | 0.73 | Invention |
| 8 | 1 | PEGDMA/MMA | 7.7 | 40 | 8 | — | FL-100 | 233 | 680 | 6.44 | 0.74 | Invention |

TABLE 5-continued

| | Back Layer | | | | Second Layer of Surface Protective Layers | | | | | Maximum Surface Roughness (Rt) | | |
|---|---|---|---|---|---|---|---|---|---|---|---|---|
| | | | | | | | Polymer | | Inert Gelatin | | Image Forming | |
| Sample No. | No. | Matting Agent | Mean Particle Size (μm) | Addition Amount (mg/m²) | No. | Matting Agent | No. | Addition Amount (mg/m²) | Addition Amount (mg/m²) | Backside (μm) | Layer Side (μm) | Note |
| 9 | 1 | PEGDMA/MMA | 7.7 | 40 | 9 | — | FL-101 | 233 | 680 | 6.44 | 0.65 | Invention |
| 10 | 1 | PEGDMA/MMA | 7.7 | 40 | 10 | — | FL-2 | 283 | 630 | 6.44 | 0.62 | Invention |
| 11 | 1 | PEGDMA/MMA | 7.7 | 40 | 11 | — | FL-2 | 333 | 580 | 6.44 | 0.61 | Invention |
| 12 | 1 | PEGDMA/MMA | 7.7 | 40 | 12 | — | FL-2 | 383 | 530 | 6.44 | 0.63 | Invention |
| 13 | 1 | PEGDMA/MMA | 7.7 | 40 | 13 | — | FL-2 | 480 | 433 | 6.44 | 0.76 | Invention |

PEGDMA/MMA: Poly (ethylene glycol dimethacrylate-co-methyl methacrylate)
PMMA: Poly (methyl methacrylate)
PL-1: Methyl methacrylate/styrene/butyl acrylate/hydroxyethyl methacrylate/acrylic acid copolymer (mass ratio of the copolymerization of 57/8/28/5/2) latex 3. Preparations of Photothermographic Material <Preparations of Photothermographic Material-1 to -13>

Reverse surface of the back surface was subjected to simultaneous overlaying coating by a slide bead coating method in order of the coating solution for the image forming layer, coating solution for intermediate layer, coating solution for the first layer of the surface protective layers, and coating solution for the second layer of the surface protective layers, and thus sample of photothermographic material-1 to -13 was produced. The coating amount of the coating solution for the intermediate layer was 8.9 mL/m², the coating amount of the coating solution for the first layer of the surface protective layers was 26.1 mL/m², and the coating amount of the coating solution for the second layer of the surface protective layers was 8.3 mL/m².

The coating amount of each compound (g/m²) for the image forming layer is as follows.

| | |
|---|---|
| Silver salt of fatty acid | 5.42 |
| Pigment (C.I. Pigment Blue 60) | 0.036 |
| Organic polyhalogen compound-1 | 0.14 |
| Organic polyhalogen compound-2 | 0.28 |
| Phthalazine compound-1 | 0.18 |
| SBR latex (TP-1) | 2.83 |
| Isoprene latex (TP-2) | 6.60 |
| Reducing agent-1 | 0.40 |
| Reducing agent-2 | 0.40 |
| Hydrogen bonding compound-1 | 0.116 |
| Development accelerator-1 | 0.01 |
| Development accelerator-2 | 0.02 |
| Colo-tone-adjusting agent-1 | 0.007 |
| Mercapto compound-1 | 0.002 |
| Mercapto compound-2 | 0.012 |
| Silver halide (on the basis of Ag content) | 0.10 |

Conditions for coating and drying were as follows.

Coating was performed at the speed of 180 m/min. The clearance between the leading end of the coating die and the support was from 0.10 mm to 0.30 mm. The pressure in the vacuum chamber was set to be lower than atmospheric pressure by 196 Pa to 882 Pa. The support was decharged by ionic wind.

In the subsequent cooling zone, the coating solution was cooled by wind having the dry-bulb temperature of from 10° C. to 20° C. Transportation with no contact was carried out, and the coated support was dried with an air of the dry-bulb of from 23° C. to 45° C. and the wet-bulb of from 15° C. to 21° C. in a helical type contactless drying apparatus.

After drying, moisture conditioning was performed at 25° C. in the humidity of from 40% RH to 60% RH. Then, the film surface was heated to be from 70° C. to 90° C., and after heating, the film surface was cooled to 25° C.

Chemical structures of the compounds used in Examples of the invention are shown below.

Spectral sensitizing dye A

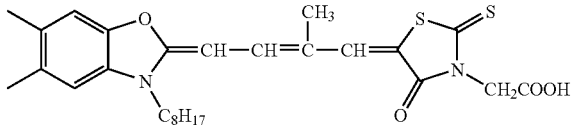

Spectral sensitizing dye B

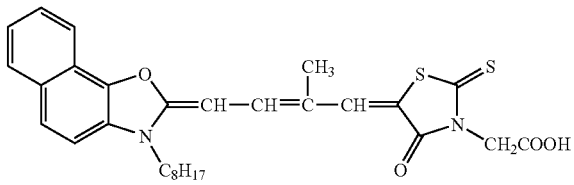

Tellurium sensitizer C

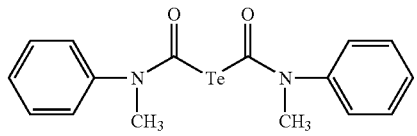

Base precursor-1

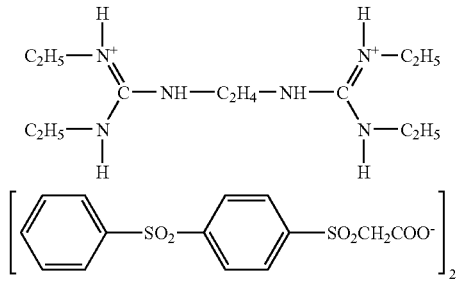

-continued

Cyanine dye-1

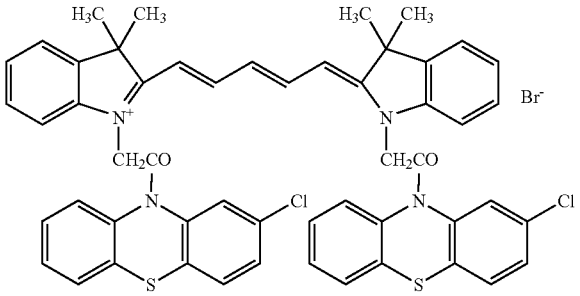

Compound 1 that is one-electron-oxidized to provide a one-electron oxidation product which releases one or more electrons

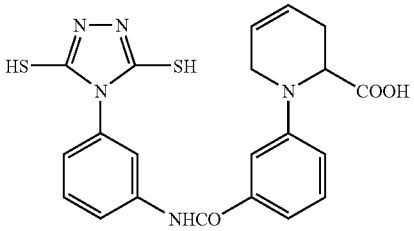

Compound 20 that is one-electron-oxidized to provide a one-electron oxidation product which releases one or more electrons

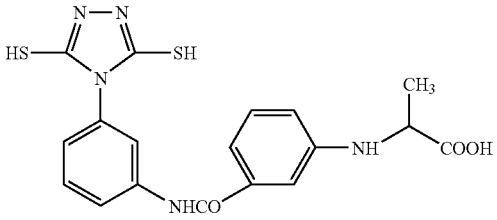

Compound 26 that is one-electron-oxidized to provide a one-electron oxidation product which releases one or more electrons

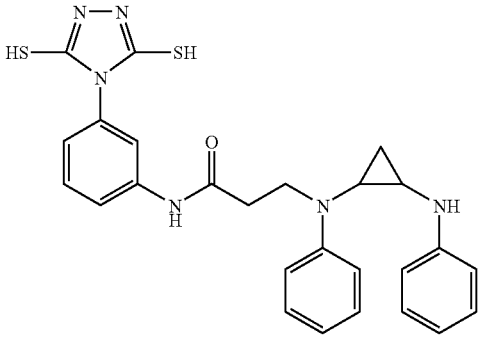

-continued

Reducing agent-1

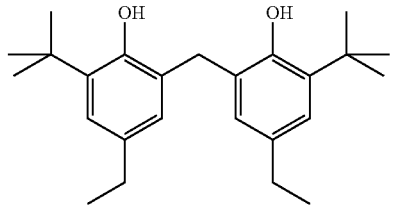

Reducing agent-2

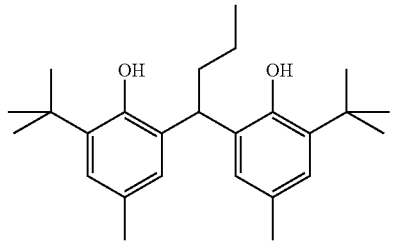

Hydrogen bonding compound-1

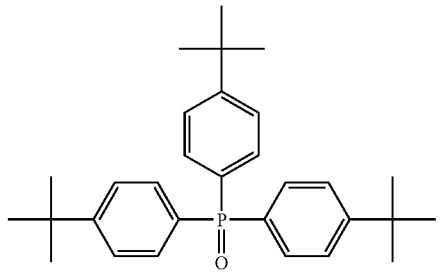

Organic polyhalogen compound-1

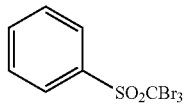

Organic polyhalogen compound-2

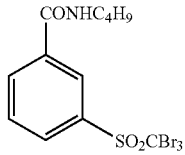

Mercapto compound-1

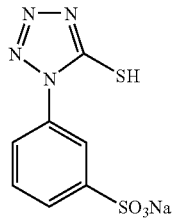

Mercapto compound-2

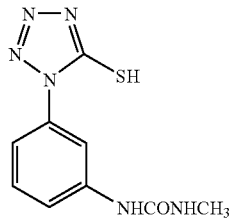

-continued

Phthalazine compound-1

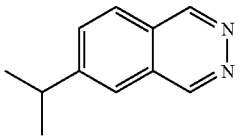

Development accelerator-1

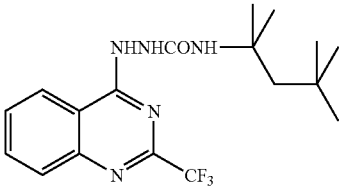

Development accelerator-2

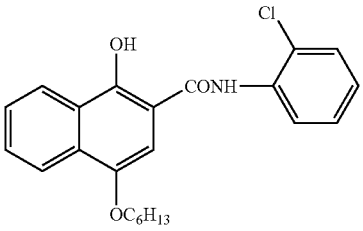

Color-tone-adjusting agent-1

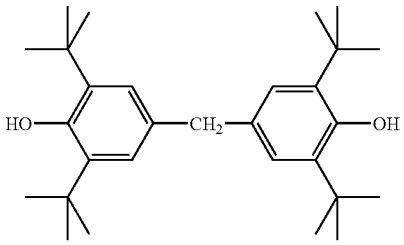

(F-1)

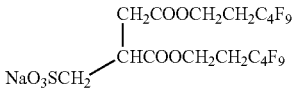

(F-2)

Mixture of

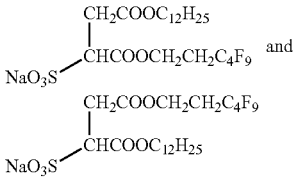

4. Evaluation of Performance

1) Preparation

The obtained sample was cut into a half-cut size, and was wrapped with the following packaging material under an environment of 25° C. and 50% RH, and stored for 2 weeks at an ambient temperature.

<Packaging Material>

A film laminated with PET 10 μm/PE 12 μm/aluminum foil 9 μm/Ny 15 μm/polyethylene 50 μm containing carbon at 3% by weight:

oxygen permeability at 25° C.: 0.02 $mL \cdot atm^{-1}m^{-2}day^{-1}$;

vapor permeability at 25° C.: 0.10 $g \cdot atm^{-1}m^{-2}day^{-1}$.

2) Imagewise Exposure and Thermal Development

To each sample, imagewise exposure and thermal development (14 seconds in total with 3 panel heaters set to 107° C.-121° C.-121° C.) with Fuji Medical Dry Laser Imager DRYPIX 7000 (equipped with 660 nm laser diode having a maximum output of 50 mW (IIIB)) were performed.

3) Evaluating Method (Measurement of Surface Roughness)

Surface roughness was measured with the use of a profilometer utilizing a needle contact method to obtain a cross section curve, and thereby a maximum surface roughness (Rt) defined in JIS B 0601 was determined.

(Measurement of F/C Ratio)

The elemental composition of the surface of the photothermographic material was determined by an X-ray photoelectron spectroscopy to obtain an intensity ratio of FlS/ClS peak, which was taken as a value of F/C ratio.

(Evaluation of Adhesion Resistance)

From each of the samples after thermal development of unexposed materials, two sheets of 3.5 cm×3.5 cm were prerared by cutting and stored under a condition of 25° C. and 75% RH for 2 hours, and then a combined set formed by bringing the image forming layer surfaces in contact with each other was prepared. The set was pressed with a load of 300 g and left under a condition of 40° C. for 3 days while loaded. Thereafter, the set was separated, and the sensory evaluation on the surface state of the image forming layers was performed with visual observation. The evaluation is based on the test in an accelerated condition, and thereby the rank over 3 is an acceptable level for practical use.

The obtained results are shown in Table 4.

The evaluation is carried out according to the following criteria:

5: no trace of adhesion is seen;

4: separation can be done easily without film peelings, but some unevenness in surface gloss is seen;

3: the area where film peelings are seen is 10% or less of the total surface area;

2: the area where film peelings are seen is from 10% to 40% of the total surface area;

1: the area where film peelings are seen is 40% or more of the total surface area.

(Photographic Properties)

Fog: Fog is expressed in terms of a density of the unexposed part.

Sensitivity (S): Sensitivity is expressed in terms of the inverse of the exposure value necessary for giving a density of fog+1.0. The sensitivities are shown in relative values, detecting the sensitivity of sample No. 1 to be 100.

(Evaluation of Sharpness)

Sharpness is evaluated by means of a measurement of CTF (Contrast Transfer Function) thereof.

Each sample was exposed with a rectangular chart for MTF measurement (spatial frequency; 0 cycles/mm to 10 cycles/mm) outputted by the aforementioned laser imager, and then subjected to thermal development.

Thereafter, the density of the obtained images was measured using a scanning microdensitometer with an aperture of 30 μm for the scanning direction and a slit of 500 μm perpendicular to the scanning direction, wherein sampling was performed every 30 μm to obtain a density profile. Further, the peak density of the rectangular wave was determined on this density profile to calculate the density contrast for each frequency.

The density contrast at a spatial frequency of 0 cycles/mm was normalized as 1, and then a CTF value at 2 cycles/mm was measured.

In this case, the value obtained by subtracting the CTF value from 1 represents CTF degradation degree of sharpness, and the sharpness of the photothermographic material was evaluated with a relative value of CTF degradation ratio based on the CTF degradation degree obtained for sample No. 1, of which degradation ratio was taken as 100%. The smaller is the value, the better is the sharpness.

4) Results of Evaluation

Results are shown in Table 5 and Table 6.

C: Poly(methyl methacrylate) particles, mean particle diameter of 5.0 μm

D: Poly(methyl methacrylate) particles, mean particle diameter of 9.5 μm

E: Poly(methyl methacrylate) particles, mean particle diameter of 12 μm (Results of Evaluation)

Results are shown in Table 7 and Table 8.

The photothermographic materials of the present invention produce images with low fog, high sensitivity, and high sharpness and also exhibit excellent performance in adhesion resistance.

TABLE 7

| | Back Layer | | | | Second Layer of Surface Protective Layers | | | | | Maximum Surface Roughness (Rt) | | |
|---|---|---|---|---|---|---|---|---|---|---|---|---|
| | | | | | | | Polymer | | Inert Gelatin | | Image Forming | |
| Sample No. | No. | Matting Agent | Mean Particle Size (μm) | Addition Amount (mg/m$^2$) | No. | Matting Agent | No. | Addition Amount (mg/m$^2$) | Addition Amount (mg/m$^2$) | Backside (μm) | Layer Side (μm) | Note |
| 3 | 1 | PEGDMA/ MMA | 7.7 | 40 | 3 | — | FL-2 | 233 | 680 | 6.44 | 3.43 | Invention |
| 21 | 2 | A | 7.1 | 40 | 3 | — | FL-2 | 233 | 680 | 5.80 | 3.43 | Invention |
| 22 | 3 | B | 8.1 | 40 | 3 | — | FL-2 | 233 | 680 | 7.30 | 3.43 | Invention |
| 23 | 4 | C | 5.0 | 40 | 3 | — | FL-2 | 233 | 680 | 3.50 | 3.43 | Invention |
| 24 | 5 | D | 9.5 | 40 | 3 | — | FL-2 | 233 | 680 | 8.50 | 3.43 | Invention |
| 25 | 6 | E | 12.0 | 40 | 3 | — | FL-2 | 233 | 680 | 10.50 | 3.43 | Invention |

The photothermographic materials of the present invention produce images with low fog, high sensitivity, and high sharpness and also exhibit excellent performance in adhesion resistance.

TABLE 6

| Sample No. | F/C Value | Adhesion Resistance | Fog | Sensitivity | Sharpness | Note |
|---|---|---|---|---|---|---|
| 1 | 0.51 | 2 | 100 | 100 | 100 | Comparative |
| 2 | 0.52 | 1 | 95 | 102 | 61 | Invention |
| 3 | 3.01 | 5 | 93 | 105 | 52 | Invention |
| 4 | 3.03 | 5 | 92 | 106 | 52 | Invention |
| 5 | 2.98 | 5 | 93 | 105 | 51 | Invention |
| 6 | 3.05 | 5 | 91 | 107 | 53 | Invention |
| 7 | 3.10 | 5 | 92 | 106 | 51 | Invention |
| 8 | 3.06 | 5 | 92 | 105 | 52 | Invention |
| 9 | 3.02 | 5 | 93 | 105 | 50 | Invention |
| 10 | 3.85 | 5 | 91 | 104 | 52 | Invention |
| 11 | 5.51 | 5 | 90 | 106 | 53 | Invention |
| 12 | 7.22 | 5 | 92 | 105 | 55 | Invention |
| 13 | 8.56 | 4 | 95 | 103 | 58 | Invention |

Example 2

Sample Nos. 21 to 25 were prepared in a similar manner to the process in the preparation of sample No. 3 of Example 1 except that the coating solution-2 to -6 for the back surface protective layer was used instead of the coating solution-1 for the back surface protective layer. For the obtained samples, evaluation was performed similar to Example 1.

(The matting agent used)

A: Poly(methyl methacrylate) particles, mean particle diameter of 7.1 μm

B: Polystyrene particles, mean particle diameter of 8.1 μm

TABLE 8

| Sample No. | F/C Value | Adhesion Resistance | Fog | Sensitivity | Sharpness | Note |
|---|---|---|---|---|---|---|
| 3 | 3.01 | 5 | 93 | 105 | 52 | Invention |
| 21 | 3.01 | 5 | 93 | 105 | 52 | Invention |
| 22 | 3.01 | 5 | 93 | 105 | 51 | Invention |
| 23 | 3.01 | 4 | 92 | 105 | 52 | Invention |
| 24 | 3.01 | 4 | 93 | 105 | 52 | Invention |
| 25 | 3.01 | 3 | 93 | 104 | 52 | Invention |

What is claimed is:

1. A photothermographic material comprising, on at least one side of a support, an image forming layer comprising at least a photosensitive silver halide, a non-photosensitive organic silver salt, a reducing agent, and a binder, a non-photosensitive outermost layer which is disposed on the same side of the support as the side having thereon the image forming layer, wherein 1) the non-photosensitive outermost layer comprises a copolymer latex having at least the following monomer (M1) and monomer (M2) as copolymerization components; and 2) a maximum surface roughness (Rt) on the image forming layer side is 1.5 μm or less; wherein monomer (M1) is a monomer having a salt or salt forming group, or a poly(alkylene oxide) group and having an unsaturated bond which performs radical polymerization; and monomer (M2) is a monomer containing a fluorine atom and having an unsaturated bond which performs radical polymerization; and 3) the non-photosensitive outermost layer and a layer adjacent to the outermost layer do not contain any matting agents;

and further comprising a back layer on the opposite side of the support from the side having thereon the image forming layer, and a maximum surface roughness (Rt) of the back layer surface is from 3 μm to 10 μm.

2. The photothermographic material according to claim 1, wherein the copolymer latex comprises from 0.5% by weight to 80% by weight of the monomer (M1) and from 20% by weight to 99.5% by weight of the monomer (M2).

3. The photothermographic material according to claim 1, wherein the copolymer latex further comprises a monomer (M3) as copolymerization components that has an unsaturated bond which performs radical polymerization and is different from either of the monomer (M1) and the monomer (M2), as a copolymerization component.

4. The photothermographic material according to claim 3, wherein the copolymer latex contains from 0.5% by weight to 79.5% by weight of the monomer (M3).

5. The photothermographic material according to claim 1, wherein the monomer (M2) is a fluorine atom-containing acrylate monomer or a fluorine atom-containing methacrylate monomer.

6. The photothermographic material according to claim 5, wherein the fluorine atom-containing acrylate monomer or the fluorine atom-containing methacrylate monomer is a monomer represented by the following formula (P):

$$(Rf)_p\text{-L-OCOC(R)}{=}CH_2 \qquad \text{Formula (P)}$$

wherein Rf represents a fluoroalkyl group having 1 to 20 carbon atoms and 1 or more fluorine atoms; p represents 1 or 2; L represents a bond or a hydrocarbylene group containing 1 to 12 carbon atoms; and R represents a hydrogen atom or a methyl group.

7. The photothermographic material according to claim 1, wherein the photothermographic material has an average gradation of from 2.5 to 4 on a photographic characteristic curve.

8. The photothermographic material according to claim 1, wherein 50% by weight or more of a binder of the non-photosensitive outermost layer is gelatin.

9. An image forming method for forming an image by imagewise exposing and thermally developing the photothermographic material according to claim 1, wherein the imagewise exposure is a scanning exposure by a laser beam, and an irradiation angle of the laser beam is from 3 degrees to 45 degrees with respect to a normal line on an exposure surface of the photothermographic material.

10. An image forming method for forming an image by imagewise exposing and thermally developing the photothermographic material according to claim 1, wherein the imagewise exposure and the thermal development are conducted while conveying the photothermographic material at a conveying speed of 16 mm/second or higher.

* * * * *